US007213915B2

(12) United States Patent
Tsutsumi et al.

(10) Patent No.: US 7,213,915 B2
(45) Date of Patent: May 8, 2007

(54) INK JET PRINTER AND IMAGE RECORDING METHOD

(75) Inventors: Takashi Tsutsumi, Hachioji (JP); Hidenobu Ohya, Hino (JP); Shinichi Suzuki, Hino (JP); Teruyuki Fukuda, Hino (JP); Minoru Yasuda, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 283 days.

(21) Appl. No.: 10/732,849

(22) Filed: Dec. 9, 2003

(65) Prior Publication Data

US 2004/0141041 A1 Jul. 22, 2004

(30) Foreign Application Priority Data

Dec. 11, 2002 (JP) ..... 2002-359824

(51) Int. Cl.
*B41J 2/01* (2006.01)
*B41J 29/38* (2006.01)

(52) U.S. Cl. ..... 347/102; 347/17; 347/14

(58) Field of Classification Search ..... 347/102, 347/19, 17, 14; 399/251, 320, 328
See application file for complete search history.

(56) References Cited

U.S. PATENT DOCUMENTS 5,619,240 A * 4/1997 Pong et al. ..... 347/103
5,771,054 A * 6/1998 Dudek et al. ..... 347/102
5,774,155 A 6/1998 Medin et al.
5,983,048 A * 11/1999 Moser ..... 399/67
6,027,196 A 2/2000 Hirabayashi et al.

(Continued)

FOREIGN PATENT DOCUMENTS

| | | | |
|---|---|---|---|
| EP | 0 307 251 A2 | | 3/1989 |
| EP | 0 668 165 A2 | | 8/1995 |
| GB | 2361670 A | | 10/2001 |
| JP | 05104706 A | * | 4/1993 |
| JP | 5-338126 | | 12/1993 |

OTHER PUBLICATIONS

Patent Abstracts of Japan, vol. 017, No. 324 (M-1433), Jun. 21, 1993, and JP 05-038818 A (Canon Inc.), Feb. 19, 1993—Abstract only.

*Primary Examiner*—Manish Shah
*Assistant Examiner*—Leonard Liang
(74) *Attorney, Agent, or Firm*—Frishauf, Holtz, Goodman & Chick, P.C.

(57) ABSTRACT

An ink jet printer includes: an image forming section for forming an image by ejecting a pigment ink toward a recording medium in which a surficial layer includes thermoplastic fine particles, in a case; a fixing member for fixing the image by heating and pressurizing the recording medium on which the image is formed by the image forming section; a drying member for drying the ink used for forming the image before the image is fixed to the recording medium by the fixing member; a temperature detecting member for detecting a temperature in the case; a humidity detecting member for detecting a humidity in the case; and a drying member control section for controlling an operation of the drying member in accordance with the temperature detected by the temperature detecting member and the humidity detected by the humidity detecting member.

4 Claims, 22 Drawing Sheets

U.S. PATENT DOCUMENTS 6,109,723 A * 8/2000 Castle et al. ..... 347/19
6,126,281 A * 10/2000 Shimoda et al. ..... 347/101
6,149,327 A * 11/2000 Ward et al. ..... 400/582
6,179,418 B1 * 1/2001 Mizoguchi et al. ..... 347/102
6,508,552 B1 * 1/2003 Steinfield et al. ..... 347/102
6,688,741 B2 * 2/2004 Nishikawa ..... 347/105
6,902,266 B2 * 6/2005 Kaga et al. ..... 347/104
2002/0118987 A1 8/2002 Takekoshi

* cited by examiner

FIG.8

| INPUT DATA | LIGHT INK DATA | DENSE INK DATA |
|---|---|---|
| 0 | 0 | 0 |
| 1 | 1 | 0 |
| 2 | 2 | 0 |
| 3 | 0 | 1 |
| 4 | 1 | 1 |
| 5 | 2 | 1 |
| 6 | 0 | 2 |
| 7 | 1 | 2 |
| 8 | 2 | 2 |

FIG.18A

RELATIVE HUMIDITY(%RH)

| TEMPERATURE(°C) | 30 | 35 | 40 | 45 | 50 | 55 | 60 | 65 | 70 | 75 | 80 |
|---|---|---|---|---|---|---|---|---|---|---|---|
| 10 | 1 | 1 | 1 | 1 | 1 | 1 | 1 | 1 | 1 | 2 | |
| 15 | 1 | 1 | 1 | 1 | 1 | 2 | 2 | 2 | 2 | 3 | |
| 20 | 1 | 1 | 2 | 2 | 2 | 3 | 3 | 3 | 3 | 3 | |
| 25 | 2 | 2 | 3 | 3 | 3 | 3 | 3 | 4 | 4 | 4 | |
| 30 | | | | | | | | | | | |

FIG.18B

| | SUBSTITUTE RATIO(%) |
|---|---|
| 1 | 30 |
| 2 | 40 |
| 3 | 50 |
| 4 | 60 |

FIG.18C

| | COLOR DENSITY(%) |
|---|---|
| 1 | 65 |
| 2 | 60 |
| 3 | 55 |
| 4 | 50 |

INK JET PRINTER AND IMAGE RECORDING METHOD

BACKGROUND OF THE INVENTION

1. Field of the Invention

The present invention relates to an ink jet printer and an image recording method.

2. Description of the Related Art

In recent years, images taken typically with digital cameras or the like, or stored in a data form in storage media such as flash memory and CD, are printed using ink jet printers which form images by ejecting inks onto recording media, rather than printed onto photographic paper.

Both of dye ink and pigment ink are available for the image printing using the ink jet printer. The pigment ink is superior to the dye ink in image storability, but inferior thereto in glossiness of the printed image while being adversely affected by scattered light or reflected light because the colorant molecule exists in a form of particle. In the image printing using the ink jet printer and pigment ink, it has therefore been a general practice to use a pigment ink containing a dispersant, to form the image on a recording medium having an ink accepting layer which contains a thermoplastic resin particle, and to fix the ink by heating and pressurizing the recording medium so as to fuse and smoothen the thermoplastic resin particle, to thereby make the ink accepting layer transparent and raise the glossiness of the printed image. The fixation is also successful in improving scratch-proof property of the printed image.

There is also known an ink jet printer which performs the fixation by blowing hot air from the back side of the recording medium having the image already formed thereon (Japanese Laid-Open Patent Publication No. 5-338126, referred to as "Patent Document 1", hereinafter).

The ink immediately after being ejected onto the recording medium remains undried due to a solvent contained in the ink. It has thus been anticipated that the printer disclosed in Patent Document 1 could not fully improve the glossiness of the printed image even after the fixation on the recording medium, and would result in only a degraded quality of the printed image. An ink jet printer having a relatively low image formation speed was not causative of any problem because a sufficient duration of time could be ensured after the ink was ejected onto the recording medium and before the ink was fixed, so that the ejected ink could naturally dry in a successive manner. In contrast to this, the recent ink jet printer having a large image formation speed could ensure only a short duration of time after the image formation and before the fixation, so that it has been necessary to separately secure a duration of time for the ink drying after the image formation on the recording medium.

SUMMARY OF THE INVENTION

In order to solve the above problem, the present invention is to provide an ink jet printer and an image recording method capable of further improving glossiness of the obtained image.

That is, in accordance with the first aspect of the present invention, an ink jet printer comprises:

an image forming section for forming an image by ejecting a pigment ink toward a recording medium in which a surficial layer includes thermoplastic fine particles, in a case;

a fixing member for fixing the image by heating and pressurizing the recording medium on which the image is formed by the image forming section;

a drying member for drying the ink used for forming the image before the image is fixed to the recording medium by the fixing member;

a temperature detecting member for detecting a temperature in the case;

a humidity detecting member for detecting a humidity in the case; and a drying member control section for controlling an operation of the drying member in accordance with the temperature detected by the temperature detecting member and the humidity detected by the humidity detecting member.

According to the first aspect of the present invention, operations of the drying member are controlled based on the temperature sensed by the temperature sensing section and on the humidity sensed by the humidity sensing section, so that it is made possible to add a photographic gloss to the surface of the recording medium by drying and thus removing an excessive solvent contained in the ink in the image formed on the recording medium, and carrying out the fixation of the image, based on the sensed temperature and sensed humidity inside the case. This is successful in further improving the glossiness of the image.

The ink jet printer may further comprise:

a temperature judging section for judging whether the temperature detected by the temperature detecting member is not less than a first predetermined value; and a humidity judging section for judging whether the humidity detected by the humidity detecting member is not less than a second predetermined value;

wherein the drying member control section operates the drying member when the temperature judging section judges that the temperature detected by the temperature detecting member is not less than the first predetermined value and the humidity judging section judges that the humidity detected by the humidity detecting member is not less than the second predetermined value.

According to this invention, it is made possible to operate the drying member when the temperature inside the case is not lower than the predetermined value and when the humidity inside the case is not lower than the predetermined value, so as to appropriately dry the excessive solvent contained in the ink.

The drying member may comprise an air blowing member for blowing air to the recording medium, and a heating member for heating the recording medium; and the drying member control section may control at least one of air blow carried out by the air blowing member and heating carried out by the heating member.

According to the present invention, the excessive solvent contained in the ink can be dried in an efficient and appropriate manner by at least either one of air blowing and heating to the recording medium.

The ink jet printer may further comprise:

a vapor volume calculating section for calculating a vapor volume per unit volume of air in the case in accordance with the temperature detected by the temperature detecting member and the humidity detected by the humidity detecting member; and a vapor volume judging section for judging whether the vapor volume calculated by the vapor volume calculating section is not less than a third predetermined value;

wherein the drying member control section operates the drying member when the vapor volume judging section judges that the vapor volume calculated by the vapor volume calculating section is not less than the third predetermined value.

According to this invention, the excessive solvent contained in the ink can be dried in an appropriate manner by allowing the drying member to operate only when the vapor volume per unit volume of air, which is calculated based on the temperature and humidity inside the case is not lower than the predetermined value.

The drying member may comprise an air blowing member for blowing air to the recording medium, and a heating member for heating the recording medium; and the drying member control section may control at least one of air blow carried out by the air blowing member and heating carried out by the heating member.

The ink jet printer may further comprise:

a heating control section for controlling heating of the recording medium, which is carried out by the fixing member;

wherein the heating control section controls the heating carried out by the fixing member in accordance with an operation condition of the drying member controlled by the drying member control section.

According to this invention, an excessive solvent contained in the ink is dried by the drying member, so that the fixing member can efficiently heat the recording medium thereafter considering the operational status of the drying member.

The drying member may comprise a heating member for heating the recording medium, the drying member control section may control heating carried out by the heating member; and the heating control section may control the heating carried out by the fixing member in accordance with a heating condition of the heating member controlled by the drying member control section.

According to the present invention, the recording medium is brought into a pre-heated status by the heating member of the drying member, and this allows the fixing member to efficiently heat the recording medium considering the heating status by the heating member.

The ink jet printer may further comprise:

an ink volume calculating section for calculating volume of the ink ejected to a predetermined unit area of the recording medium when the image is formed by the image forming section; and an ink volume judging section for judging whether the volume of the ink, which is calculated by the ink volume calculating section is not less than a fourth predetermined value;

wherein the drying member control section operates the drying member when it is judged by the ink volume judging section that the volume of the ink is not less than the fourth predetermined value.

According to the present invention, an excessive solvent contained in the ink can be dried in an appropriate manner only when the volume of the ink ejected to a predetermined unit area of the recording medium during image formation is not smaller than a predetermined value.

The drying member may dry the ink of the image formed on the recording medium so that the image has a C value of not less than 80 by fixing the image with the fixing member.

It is to be noted that the C value is an index for expressing image sharpness specified in JIS-K-7105, and more specifically to a value measured by the reflective method using a 2-mm optical frequency comb.

According to the present invention, the image recorded on the recording medium will have a C value of 80 or above after fixed by the fixing member, and this is successful in obtaining an image having a glossiness almost equivalent to that of the silver-salt photograph.

In accordance with the second aspect of the invention, an ink jet printer comprises:

an image forming section for forming an image by ejecting a pigment ink toward a recording medium in which a surficial layer includes thermoplastic fine particles, in a case;

a fixing member for fixing the image by heating and pressurizing the recording medium on which the image is formed by the image forming section;

a combination deciding section for deciding a combination of a plurality of inks used for forming the image by the image forming section;

a temperature detecting member for detecting a temperature in the case;

a humidity detecting member for detecting a humidity in the case; and an ink volume adjusting section for adjusting volume of the inks ejected to a predetermined unit area of the recording medium when the image is formed by the image forming section, by changing the combination of the plurality of inks, which is decided by the combination deciding section, in accordance with the temperature detected by the temperature detecting member and the humidity detected by the humidity detecting member so that the volume of the inks is not less than a first predetermined value.

According to the second aspect of the present invention, the volume of the ink ejected to a predetermined unit area of the recording medium can be adjusted by changing the combination of the plurality of the inks used for the image formation considering the detected temperature and detected humidity inside the case, and thereafter the image is fixed, so that it is made possible to add a photographic gloss to the surface of the recording medium. This is successful in further improving the glossiness of the image.

The ink jet printer may further comprise:

a temperature judging section for judging whether the temperature detected by the temperature detecting member is not less than a second predetermined value; and a humidity judging section for judging whether the humidity detected by the humidity detecting member is not less than a third predetermined value;

wherein the ink volume adjusting section adjusts the volume of the inks when the temperature judging section judges that the temperature detected by the temperature detecting member is not less than the second predetermined value and the humidity judging section judges that the humidity detected by the humidity detecting member is not less than the third predetermined value.

According to this invention, the volume of the ink ejected to a predetermined unit area of the recording medium can appropriately be adjusted by changing the combination of the plurality of the inks used for the image formation, when the temperature inside the case is not lower than the predetermined value, and when the humidity inside the case is not lower than the predetermined value.

The image forming section may form a color image; and the ink volume adjusting section may be configured so as to adjust the volume of the inks by removing undercolor to change the combination of the plurality of the inks, which is decided by the combination deciding section, when the color image is formed by the image forming section.

Undercolor removal herein refers to a technique of representing a color originally expressed by a blend of a plurality of color inks with a predetermined ink. In an exemplary case where four inks of yellow (Y), magenta (M), cyan (C) and black (K), a possible process of the undercolor removal is such as representing black color expressed by the YMC inks with the black (K) ink only. This successfully reduces the amount of use of the inks.

According to this invention, the ink volume can be adjusted by changing, through undercolor removal, a determined combination of the plurality of inks, so that it is made possible to reduce the amount of the ink used for the image formation, and to fix the image thereafter. This is successful in more appropriately improve the glossiness of the image recorded on the recording medium.

The image forming section may form the image by ejecting inks having different densities from each other; and the ink volume adjusting section may be configured so as to adjust the volume of the inks by changing the combination of the plurality of the inks, which is decided by the combination deciding section, so that a ratio of a dense ink is large.

According to this invention, the ink volume can be adjusted by changing the predetermined combination of the plurality of the inks so that a dense ink will have a larger ratio of content, so that it is made possible to reduce the amount of the ink used for the image formation, and to fix the image thereafter. This is successful in more appropriately improve the glossiness of the image recorded on the recording medium.

In accordance with the third aspect of the invention, an ink jet printer comprises:

an image forming section for forming an image by ejecting a pigment ink toward a recording medium in which a surficial layer includes thermoplastic fine particles, in a case;

a fixing member for fixing the image by heating and pressurizing the recording medium on which the image is formed by the image forming section;

a temperature detecting member for detecting a temperature in the case;

a humidity detecting member for detecting a humidity in the case; and a combination deciding section for deciding a combination of a plurality of inks used for forming the image by the image forming section in accordance with the temperature detected by the temperature detecting member and the humidity detected by the humidity detecting member so that volume of the inks ejected to a predetermined unit area of the recording medium when the image is formed by the image forming section is not less than a predetermined value.

According to the third aspect of the invention, a combination of a plurality of inks used for forming the image by the image forming section is decided in consideration with the detected temperature and the detected humidity in the case so that volume of the inks ejected to a predetermined unit area of the recording medium when the image is formed by the image forming section is not less than a predetermined value. After the image is formed at the decided combination of the plurality of inks, the image is fixed. This is successful in adding a photographic gloss to the surface of the recording medium and in further improving the glossiness of the image recorded on the recording medium.

The combination deciding section may decide the combination of the plurality of inks for forming the color image with the image forming section by removing undercolor.

According to this invention, because the combination of the plurality of inks for forming the color image by removing undercolor is decided, it is possible to reduce the amount of the ink used for the image formation, and to fix the image thereafter. This is successful in more appropriately improve the glossiness of the image recorded on the recording medium.

The image forming section may form the image by ejecting inks having different densities from each other; and the combination deciding section may decide the combination of the plurality of inks so that a ratio of a dense ink is large.

According to this invention, because the combination of the plurality of inks is decided so that a ratio of a dense ink is large, it is possible to reduce the amount of the ink used for the image formation, and to fix the image thereafter. This is successful in more appropriately improve the glossiness of the image recorded on the recording medium.

In accordance with the fourth aspect of the invention, an image recording method using an ink jet printer, comprises steps of:

forming an image by ejecting a pigment ink toward a recording medium in which a surficial layer includes thermoplastic fine particles;

fixing the image to the recording medium by heating and pressurizing the recording medium; and adjusting an amount of dryness of the ink used for forming the image after the forming step and before the fixing step, in accordance with a temperature and a humidity in the ink jet printer.

According to the fourth aspect of the present invention, the degree of drying of the ink for forming the image on the recording medium can be adjusted based on the sensed temperature and humidity inside the ink jet printer, so that it is made possible to dry and remove an excessive solvent contained in the ink in the image formed on the recording medium, and to fix the image thereafter considering the temperature and humidity inside the ink jet printer. This is successful in adding a photographic gloss to the surface of the recording medium and in further improving the glossiness of the image recorded on the recording medium.

In accordance with the fifth aspect of the invention, an image recording method using an ink jet printer, comprises steps of:

forming an image by ejecting a pigment ink toward a recording medium in which a surficial layer includes thermoplastic fine particles;

deciding a combination of a plurality of inks used for forming the image in the forming step;

adjusting volume of the inks ejected to a predetermined unit area of the recording medium when the image is formed, by changing the combination of the plurality of inks, which is decided in the deciding step, in accordance with a temperature and a humidity in the ink jet printer so that the volume of the inks is not less than a predetermined value; and fixing the image to the recording medium by heating and pressurizing the recording medium.

According to the fifth aspect of the present invention, the ink volume ejected to a predetermined unit area of the recording medium can be adjusted by changing the combination of the plurality of the inks used for the image formation, considering the sensed temperature and humidity inside the ink jet printer, and to fix the image thereafter. This is successful in adding a photographic gloss to the surface of the recording medium and in further improving the glossiness of the image recorded on the recording medium.

In accordance with the sixth aspect of the invention, an image recording method using an ink jet printer, comprises steps of:

forming an image by ejecting a pigment ink toward a recording medium in which a surficial layer includes thermoplastic fine particles;

deciding a combination of a plurality of inks used for forming the image in accordance with a temperature and a humidity in the ink jet printer so that volume of the inks ejected to a predetermined unit area of the recording medium when the image is formed in the forming step, is not less than a predetermined value; and fixing the image to the recording medium by heating and pressurizing the recording medium.

According to the sixth aspect of the invention, a combination of a plurality of inks used for forming the image by the image forming section is decided in consideration with the detected temperature and the detected humidity in the ink jet printer so that volume of the inks ejected to a predetermined unit area of the recording medium when the image is formed by the image forming section is not less than a predetermined value. After the image is formed at the decided combination of the plurality of inks, the image is fixed. This is successful in adding a photographic gloss to the surface of the recording medium and in further improving the glossiness of the image recorded on the recording medium.

BRIEF DESCRIPTION OF THE DRAWINGS

The present invention will become more fully understood from the detailed description given hereinbelow and the accompanying drawing which are given by way of illustration only, and thus are not intended as a definition of the limits of the present invention, and wherein;

FIG. 8 is a diagram showing correlation between input data and dense/light ink data:

FIG. 18A is a schematic view showing a combination decision table, FIG. 18B is a schematic view showing ratios of the removal of the undercolor corresponding to each value in the combination decision table of FIG. 18A, and FIG. 18C is a schematic view showing color densities at the beginning of using the dense ink, corresponding to each value in the combination decision table of FIG. 18A.

DETAILED DESCRIPTION OF THE PREFERRED EMBODIMENTS

The following paragraphs will describe specific embodiment of the present invention referring to the attached drawings. It is to be noted that the scope of the invention is by no section limited to the illustrated examples.

Figure 1:
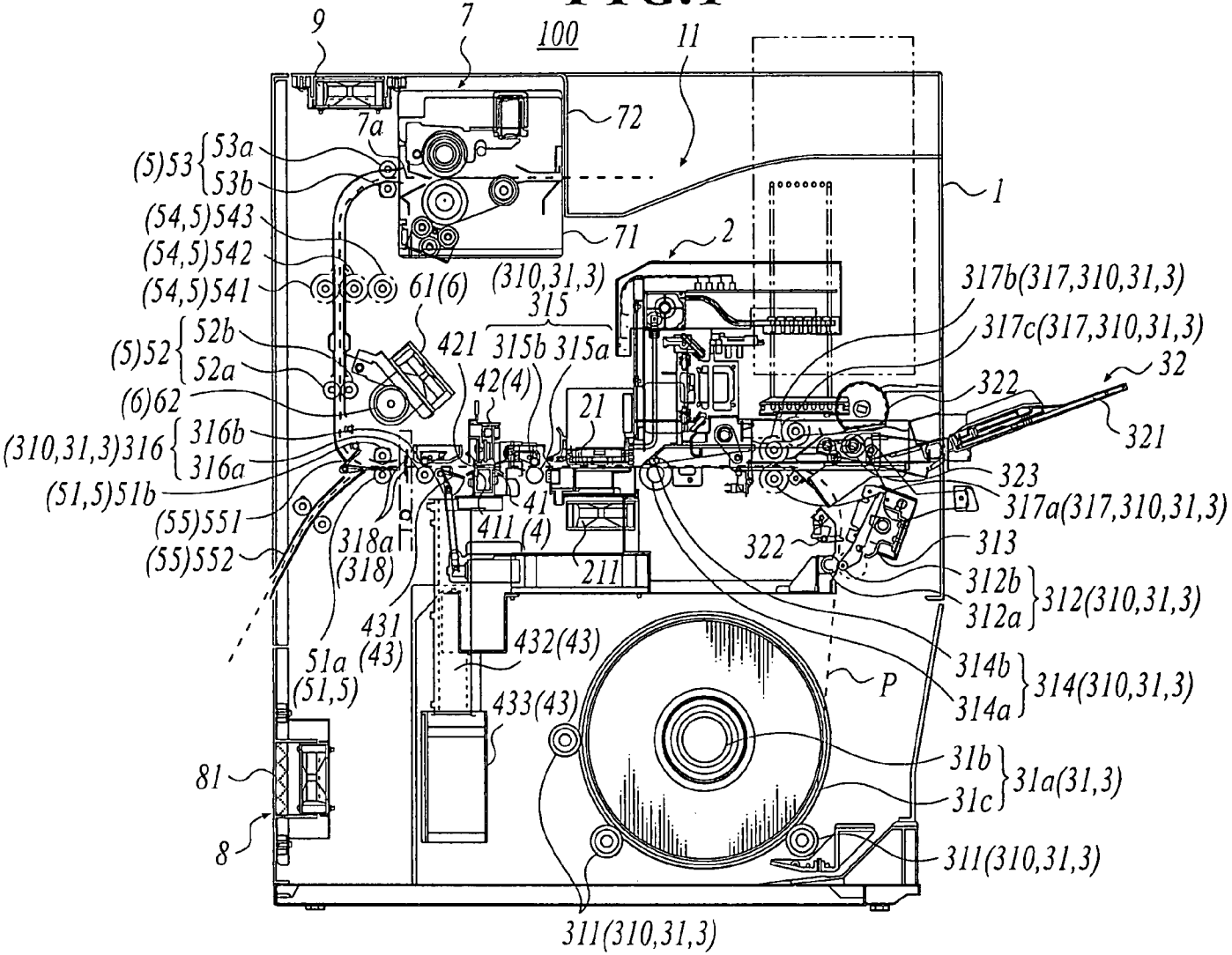
FIG. 1 is a sectional view of a main part of an ink jet printer exemplified as a first embodiment applied with the present invention.
Figure 2A:
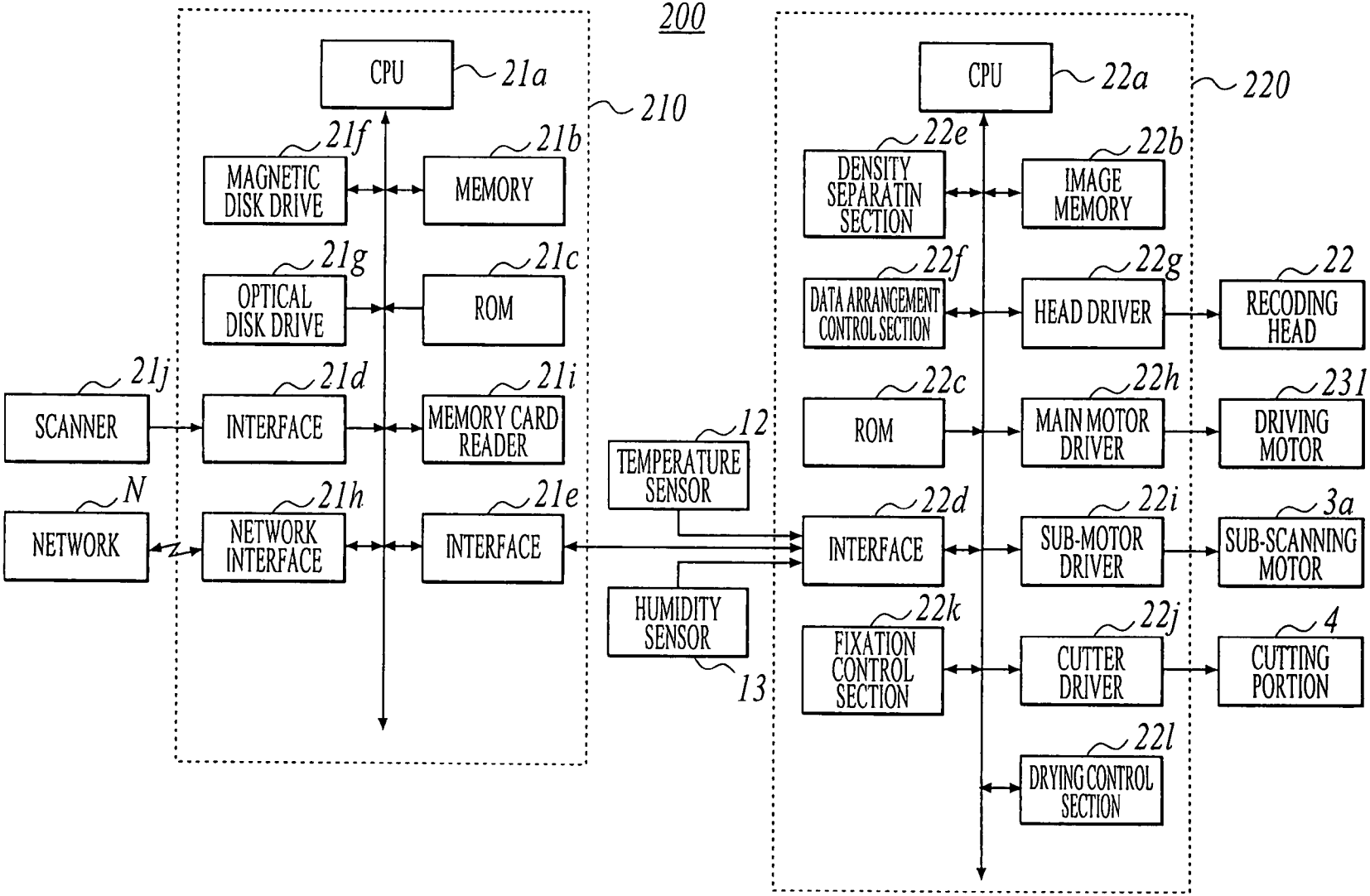
FIG. 2A is a block diagram showing a configuration of a main part of a control device owned by the ink jet printer shown in FIG. 1
Figure 2B:
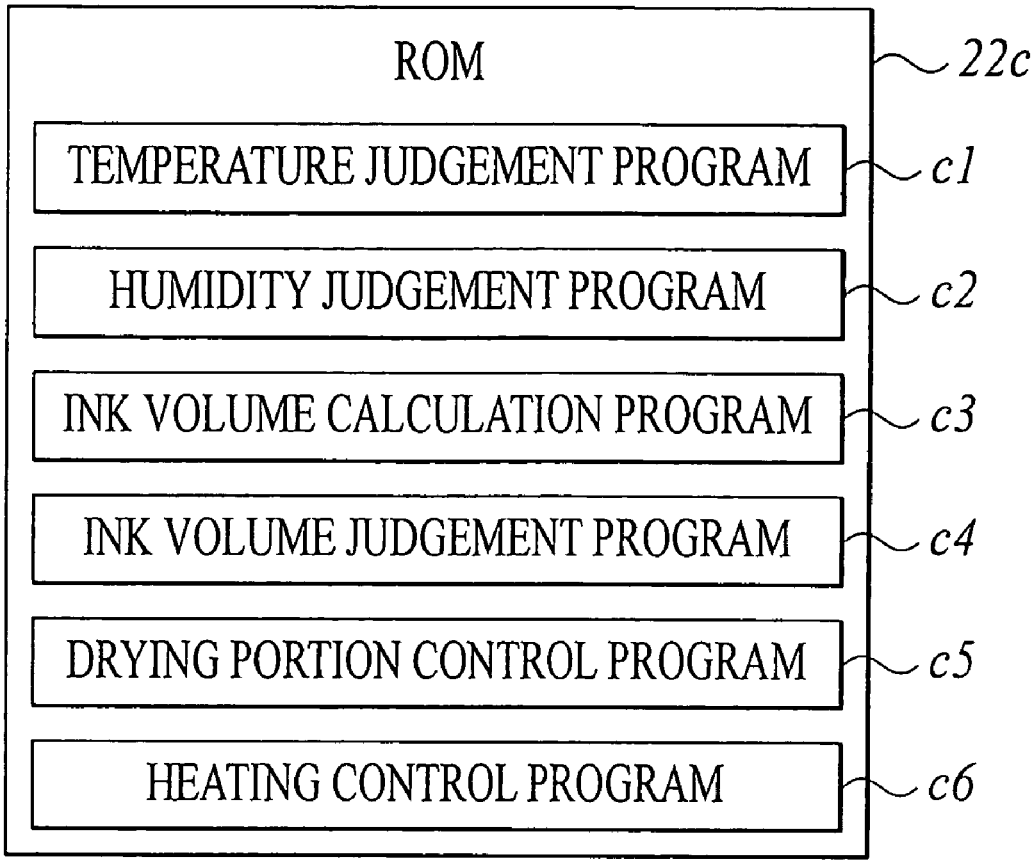
FIG. 2B is a view showing an internal structure of the ROM provided in the control device shown in FIG. 2A.

First Embodiment:

FIG. 1 is a sectional view of a main part of an ink jet printer exemplified as a first embodiment applied with the present invention, and FIG. 2A is a block diagram showing a configuration of a main part of a control device owned by the ink jet printer shown in FIG. 1 and FIG. 2B is a view showing an internal structure of the ROM provided in the control device shown in FIG. 2A.

As shown in FIGS. 1 and 2A, an ink jet printer 100 is schematically configured as having in a case 1 an image forming section 2 in charge of image formation by ejecting an ink and allowing it to be placed on a recording medium P, a recording medium feeding section 3 for feeding during the image formation the recording medium P to the image forming section 2 along a route of conveyance, a cutting section 4 for cutting the recording medium P after the image formation, a continuous conveying section 5 for continuously conveying the recording medium P cut by the cutting section 4 towards a fixing member 7 described later, a drying member 6 for drying the image formed on the recording medium P by blowing the air, the fixing member 7 in charge of gloss raising treatment for the recording medium P, an air intake fan 8 for introducing the outer air into the case 1, an exhaust fan 9 for exhausting the air inside the case 1 to the outside, and a control device 200 for generally controlling all of these portions.

The recording medium feeding section 3 comprises a web recording medium feeding section 31 for feeding web-formed recording medium P and a manual feeding unit 32 allowing feeding of cut-sheet-type recording medium P. The recording medium P is fed from either of the web recording medium feeding section 31 or manual feeding unit 32, and the sent sequentially through the image forming section 2, drying member 6, cutting section 4 and continuous conveying section 5.

The web recording medium feeding section 31 further comprises a housing unit 31*a* for housing the web-formed recording medium P as being wound up on a roll, and an intermittent conveying section 310 for intermittently conveying the recording medium P.

The housing unit 31*a* is disposed at a predetermined position below the main body of the ink jet printer 100, and comprises a shaft portion 31*b* on which the recording medium P to be taken up, and flange portions 31*c* connected to both ends of the axial portion 31*a* so as to concentrically align the centers thereof with the axial center of the shaft portion 31*b*.

The intermittent conveying section 310 is disposed so as to contact with the flange portion 31*c*, and comprises a flange portion-driven roller 311 . . . which rotates as being driven by the rotating flange portion 31*c* when the recording medium P is drawn out from the housing unit 31*a*, a paper feeding roller section 312 which rotates so as to draw out the recording medium P housed in the housing unit 31*a*, a pinching mechanism 313 for pinching the recording medium P with the aid of the paper feeding roller section 312, a first to third conveying roller sections 314 to 316 which rotate so as to intermittently convey the recording medium P drawn out by the paper feeding roller section 312, and first and second foreign matter removing mechanisms 317, 318 for removing foreign matters such as paper dust or dust adhered on the recording medium P conveyed along the route of conveyance.

The paper feeding roller section 312 is disposed on the upstream side of the housing unit 31*a*, and comprises the paper feeding roller 312*a* which rotates while being driven by a driving force fed from a driving force source (not shown), and a passive paper feeding roller 312*b* which is disposed so as to pinch the recording medium P in cooperation with the paper feeding roller 312*a* and feeds the recording medium P in cooperation with the paper feeding roller 312*a*. The passive paper feeding roller 312*b* is disposed on one end portion of the pinching mechanism 313.

The pinching mechanism 313 is supported around an axis so as to allow the passive paper feeding roller 312*b* to freely revolve, and in which the recording medium P is pinched between the passive paper feeding roller 312*b* and the paper feeding roller 312*a* when the passive paper feeding roller 312*b* is revolved to be brought into contact with the recording medium P.

Although the pinching mechanism 313 herein is configured so as to allow manual operation, it is also allowable to configure it so that the recording medium P is automatically pinched between the passive paper feeding roller 312*b* and the paper feeding roller 312*a*, in a manner typically in linkage with closing operation of a lid of a paper feeding unit (not shown) after the recording medium P is set.

The first conveying roller section 314 is disposed on the upstream side of the image forming section 2 on the conveying route, and the second conveying roller section 315 is disposed on the downstream side of the image forming section 2 on the conveying route but on the upstream side of the cutting section 4. The third conveying roller 316 is disposed on the downstream side of the cutting section 4 but on the upstream side of the continuous conveying section 5. The first to third conveying roller sections 314 to 316 are disposed at a nearly equal level of height.

The individual conveying roller sections 314 to 316 are connected to driving force sources (not shown), and comprise conveying rollers 314*a* to 316*a* which are connected to driving force sources and rotate as being driven by driving force fed from the driving force source, and driven rollers 312*b* which are disposed so as to pinch the recording medium P in cooperation with the paper feeding rollers 314*a* to 316*a*, and feed the recording medium P in cooperation with the paper feeding roller 314*a* to 316*a*.

These conveying roller sections 314 to 316 are configured so that the conveying rollers 314*a* to 316*a* can rotate as being driven by the individual driving force sources which rotate in a predetermined direction, and can convey the recording medium P while being pinched by the individual conveying roller sections 314 to 316 from the upstream side to the downstream side on the route of conveyance.

The first foreign matter removing mechanism 317 is disposed between the paper feeding roller section 312 and the first conveying roller section 314 on the route of conveyance, at a level of height nearly equal to that of the first to third conveying roller sections 314 to 316, connected to a driving force source (not shown), and comprises a conveying roller 317*a* which rotates as being driven by a driving force fed from a driving force source (not shown), a foreign matter removing roller 317*b* which is disposed so as to pinch the recording medium P in cooperation with the conveying roller 317*a* and rotates as being driven by rotation of the conveying roller 317*a*, to thereby convey the recording medium P in cooperation with the conveying roller 317*a*, and at the same time, to adhere and remove foreign matters caught on the image formation surface of the recording medium P, and a cleaning roller 317*c* which rotates as being driven by rotation of the foreign matter removing roller 317*b* under contact with the foreign matter removing roller 317*b*, and thereby adhere and remove the foreign matter caught on the surface of the foreign matter removing roller 317*b*.

The surfaces of the foreign matter removing roller 317*b* and cleaning roller 317*c* are provided with a foreign matter adhering portion composed of a material having a strong tacking property for foreign matters. The foreign matter adhering portion provided to the foreign matter removing roller 317*b* is designed to have an appropriate adhesive force not causative of bite or jam of the conveyed recording medium P. A further attention is paid on that the adhering portion provided to the cleaning roller 317*c* has a foreign matter adhesion property stronger than that of the foreign matter adhering portion provided to the foreign matter removing roller 317*b*.

The recording medium P, sent from the paper-feeding-roller-unit 312 side towards the image forming section 2, is thus drawn and pinched between the conveying roller 317*a* and foreign matter removing roller 317*b*, and this allows the foreign matters caught on the image forming surface of the recording medium P to be adhered and removed by the foreign matter adhering portion on the surface of the foreign matter removing roller 317*b*, and further allows thus adhered foreign matter adhered on the foreign matter adhering portion to be adhered and removed by the foreign matter adhering portion on the cleaning roller 317*c*.

It is to be noted that the individual rollers owned by the first foreign matter removing mechanism 317 are designed to rotate, during feeding of the recording medium P, at a speed nearly equal to that of the paper feeding roller 312*a* and the first conveying roller 314*a*.

The second foreign matter removing mechanism 318 is disposed between the third conveying roller section 317 and the continuous conveying section 5 on the route of conveyance, and comprises a paper dust removing brush 318*a* capable of sliding on the surface of the recording medium P so as to remove paper dust generated during cutting (detailed later) of the recording medium P by the cutting section 4 and adhered on the surface of the recording medium P, and a suction fan (see FIG. 10) 318*b* for sucking the paper dust adhered on the paper dust removing brush 318*a*.

The paper dust removing brush 318*a* is disposed in two on the upper and lower sides of the recording medium P so as to make it possible to sliding on the upper and back surfaces of the recording medium P at the same time. Each paper dust removing brush 318*a* is typically composed of a conductive material, so as to allow it to remove static electricity of the recording medium P, and to readily remove the paper dust adhered thereon. It is also allowable to dispose a single paper dust removing brush 318*a* on the image-forming-surface side so as to allow it to slide at least on the image-forming-surface side of the recording medium P. The paper dust removing brush 318*a* may also be of a rotating roller-type, rather than the illustrated one.

The suction fan 318*b* is configured so as to communicate with the outside of the ink jet printer 100, and a portion of the suction fan 318*b* which resides inside the ink jet printer has, attached thereto, a filter 318*c* for collecting the paper dust sucked by the suction fan 318*b*. Another possible configuration herein is such as utilizing air flow generated by the suction fan 318*b* in the drying of the image on the recording medium P, in place of using the air sent from the drying member 6.

The manual feeding unit 32 is disposed so as to feed the recording medium P on the upstream side of the first foreign matter removing mechanism 317 on the route of conveyance, formed so as to be projected out from the case 1 in an upper inclined direction, and comprises a recording medium placing unit 321 on which the recording medium P is placed; a recording medium detection sensor (not shown) for detecting the recording medium P placed on the recording medium placing unit 321; a conveying roller 322 which is disposed so as to contact with the image forming surface of the recording medium P placed on the recording medium placing unit 321, and rotates so as to feed the recording medium P towards the first-foreign-matter-removing-mechanism 317 side; and a driven roller 323 driven by the rotation of the conveying roller 322.

The conveying roller 322 has a half-moon-formed section, being notched along a chord, and rotation thereof makes the outer circumferential surface of the roller 322, having an archy section, pinch the recording medium P in cooperation with the edge portion of the recording medium placing unit 321 at the end portion housed inside the case 1, and this allows the recording medium P to be drawn and fed to the first-foreign-matter-removing-mechanism 317 side. The driven roller 323 herein is configured so as to be driven while pinching the recording medium P in cooperation with the outer circumferential surface of the conveying roller 322 having the archy section.

When the recording medium P is detected by the recording medium detection sensor of the manual feeding unit 32, the conveying rollers 314*a* to 316*a* owned by the first to third conveying roller sections 314 to 316, foreign matter removing roller 317*b* and paper feeding roller 312*a* are linked with each other to rotate in the direction opposite to that during the feeding of the recording medium P, so as to draw the recording medium P into the paper feeding roller 312*a* side.

When the front edge of the recording medium P is detected by a recording medium detection sensor 319 disposed between the first foreign matter removing mechanism 317 on the route of conveyance and the paper feeding roller unit 312, drawing of the recording medium P is interrupted so as to prevent the recording medium P from being drawn beyond the paper feeding roller unit 312 into the housing unit 31*a* side.

Next, the image forming section 2 will be explained referring to FIGS. 3 and 4A.

Figure 3:
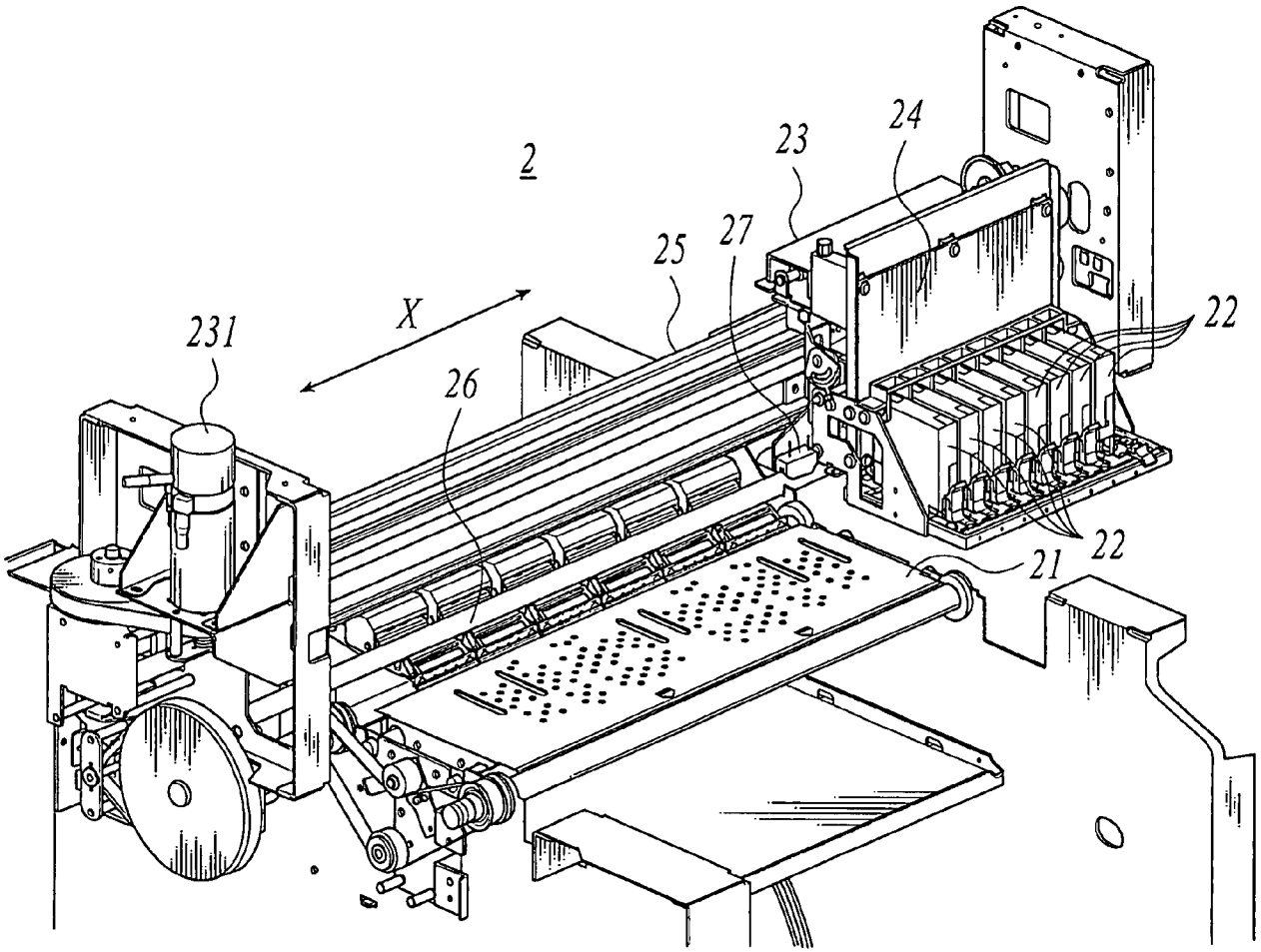
FIG. 3 is a perspective view of an image forming section owned by the ink jet printer shown in FIG. 1.
Figure 4A:
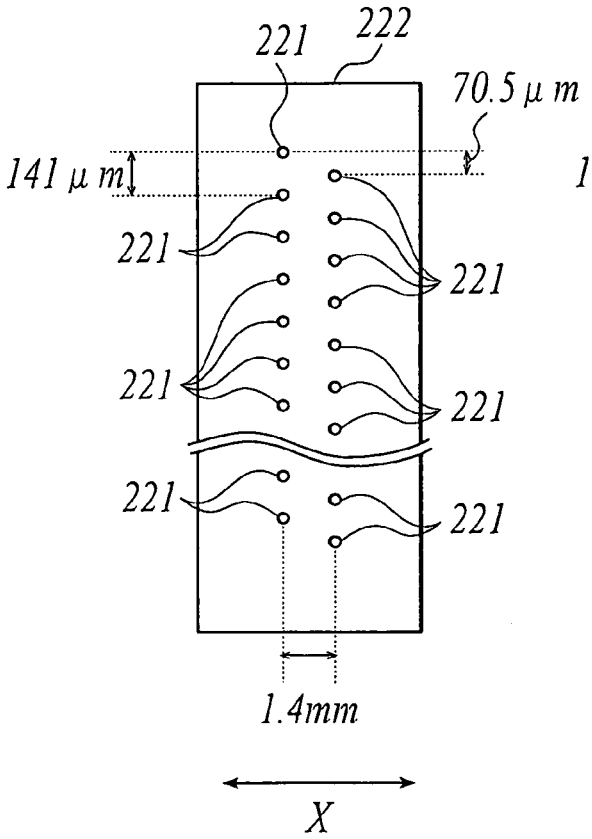
FIGS. 4A and 4B are plan views of the nozzle planes of recording heads owned by the image forming section shown in FIG. 3.

FIG. 3 is a perspective view of the image forming section 2 taken by an inclined downward view from a high point on the downstream side, and FIG. 4A is a schematic drawing of a nozzle array configured on the nozzle plane of the recording head.

As shown in FIG. 3, the image forming section 2 is disposed in a nearly horizontal manner, and is configured as having a platen 21 for supporting the recording medium P on its back surface (surface opposite to the image-forming surface) within a predetermined range with the aid of suction force activated by a suction device 211; eight recording heads 22 for ejecting the ink through ejection holes 221 of nozzles (not shown) towards the recording medium P; a carriage 23 for mounting these recording heads 22 and moved in the scanning direction X during the image formation; a circuit board 24 mounted on the carriage 23 and in charge of driving the carriage 23; a guide member 25 disposed as being extended along the scanning direction X and in charge of guiding the movement of the carriage 23; a linear scale 26 disposed as being extended along the scanning direction X, and having an optical pattern at 180-dpi intervals in the longitudinal direction; and a linear encoder sensor 27 mounted on the carriage, and in charge of reading the optical pattern given on the linear scale 26 and of making an output in a form of clock signal.

The moving direction of the carriage 23 is altered depending on the direction of rotation of a driving motor 231, and this makes the carriage 23 reciprocate in the scanning direction X. In the image formation, the carriage 23 moves forward or backward, or reciprocates in the scanning direction X when the recording medium P is kept stationary. The moving speed herein is set maximum at 705 mm/s.

The recording head 22 is disposed so that, during the image formation, a nozzle plane 222 thereof, on which the ejection holes 221 are arrayed, is opposed to the image-forming surface of the recording medium P conveyed on the platen 21. On the nozzle plane 222, two nozzle arrays 1.4 mm distant from each other, and each comprising 255 ejection holes 211, . . . arranged in line at a 141-μm pitch (180 dpi). These nozzle layers a displaced by 70.5 μm (half pitch) in the in-line direction of the array. Thus the nozzle plane 222 has 550 ejection holes 211, . . . in total opened therein.

Each recording head 22 has an ejection section (not shown) typically such as a piezoelectric device incorporated therein, and configured so as to separately eject ink droplets from each ejection hole 221 with the aid of operation of the ejection section.

Figure 4B:
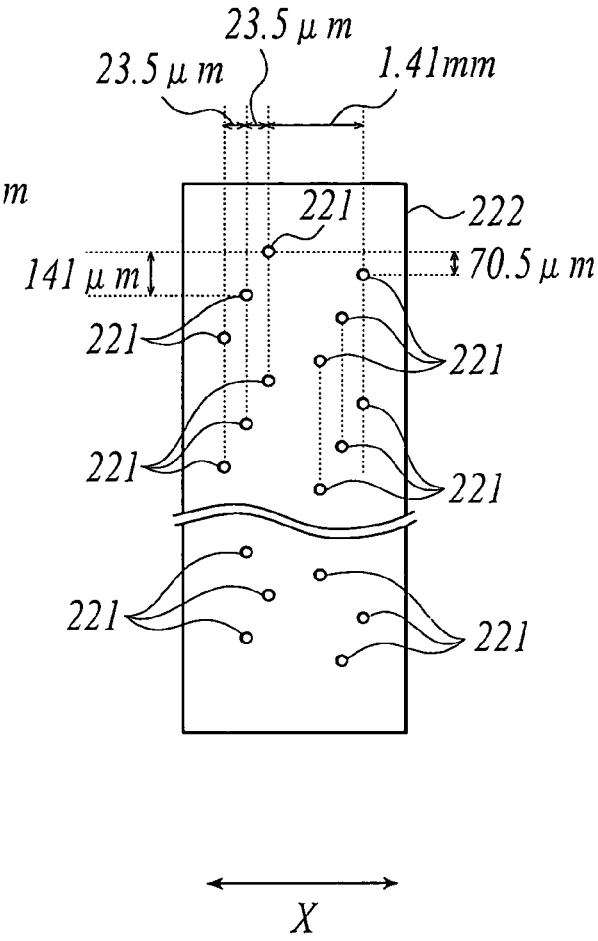

On the nozzle plane 222, it is also allowable, as shown in FIG. 4B, to group the ejection holes 221 in each array by threes so as to configure each unit by three nozzles 221, . . . in succession, and to arrange three ejection holes 221, . . . in each unit 23.5 μm distant from each other in the scanning direction X.

The ink used herein is a pigment ink containing a dispersant. Specific compositions and methods of the preparation will be described later.

Also the linear scale 26 and the linear encoder sensor 27 will be described later.

The cutting section 4 mainly comprises a main unit 41 extended typically in the width-wise direction of the recording medium P; a cutter unit 42 for cutting the recording medium P on which the image formation is completed; the driving force source (not shown) for reciprocate the cutter unit 42 in the width-wise direction of the recording medium P; and a driving force transmission section (not shown), such as a wire, for transmitting driving force of the driving force source to the cutter portion 42.

The cutter unit 42 has a nearly-disk-formed rotary cutter 421 for cutting the recording medium P in the width-wise direction (direction nearly in parallel with the scanning direction X).

The main unit 41 has a stationary edge 411 disposed nearly at the center thereof, and located below a paper pass slot, through which the recording paper P is passed during the conveyance thereof, so as to extend along the longitudinal direction of the paper pass slot, and can make contact with the rotary cutter 421 from the lower side.

The height of the paper pass slot is adjusted nearly equal to that of the route of conveyance at the second and third feeding roller units 315, 316.

In thus-configured cutting section 4, when the recording medium P after the image formation is kept stationary, the cutter unit 42 moves along the longitudinal direction of the main unit 41 while being driven by the driving force source and being guided by a guide member (not shown), so as to make the stationary edge 411 and the rotary cutter 421 hold the recording medium P in between. The recording medium P is thus cut in the width-wise direction thereof.

The cutter unit 42 is configured to recede back to either one end portion of the main unit 41 when it is not used for cutting the recording medium P, so as not to interfere the passage of the recording medium P through the paper pass slot.

The cutting section 4 may have a paper dust removing section for removing paper dust generated from the cutting of the recording medium P. More specifically, the cutting section 4 may have a dust-on-recording-medium removing brush for removing paper dust adhered on the image-forming surface of the recording medium P, and a dust-on-cutter removing brush for removing paper dust adhered on both surfaces of the rotary cutter 421.

These dust removing brushes are preferably configured so as to move together with the cutter unit 42 when the recording medium P is cut, during which the image-forming surface of the recording medium P is swept by the dust-on-recording-medium removing brush, an the surface of the rotary cutter 421 is swept by the dust-on-cutter removing brush.

On the downstream side of cutting section 4 on the route of conveyance, there is provided a cutting chip recovery unit 43 for collecting cutting chips or the like generated from the cutting of the recording medium P at the cutting section 4.

The cutting chip recovery unit 43 comprises a change valve 431 which composes the route of conveyance of the recording medium P, and guides the collected cutting chips into a recovery vessel 433; a guide way 432 which is disposed below the change valve 431 and vertically extends; and the recovery vessel 433 which is connected to the lower end of the guide way 432 and collects the cutting chips.

The exchange valve 431 is a nearly-plate-formed member having the base end portion thereof supported around an axis so as to freely revolve, which is normally kept nearly horizontal so as to support the recording medium P under conveyance from the lower side, and is revolved so that the end portion thereof is inclined downward as being operated by a change valve control mechanism when the cutting chips are collected, so as to guide the cutting chips on the guide way 432 side.

The recovery container 433 is preferably configured as being detachable from the main unit of the ink jet printer 100 for the convenience of collection of the cutting chips.

The cutting chips herein section paper strips generated when the recording medium P is cut at the boundary of the adjacent images printed thereon in a marginless manner, but may also include other cutting pieces or paper dust.

The drying member 6 is disposed over the second foreign matter removing mechanism 318, and comprises a fan (blowing member) 61 which rotates to blow the air towards the recording medium P; and a heater (heating member) 62 which generates heat for raising temperature of the air blown by the fan 61.

This configuration allows the heating member 6 to blow hot air towards the recording medium P, and thereby allows an excessive solvent contained in the ink in the image formed on the recording medium P to be removed by vaporization, and to dry the ink. A specific procedure for controlling the drying member 6 will be described later.

The heating member 6 is oriented so as to blow the air towards the recording medium P conveyed through the continuous conveying section 5.

The heater 62 may be a coil heater or halogen heater, or may typically be configured so as to dispose a metal plate on the image-forming-surface side of the recording medium P and to heat the metal plate through electro-magnetic induction heating.

The continuous conveying section 5 comprises first to third conveying roller units 51 to 53 which rotate so as to continuously convey the recording medium P after passing through the second foreign matter removing mechanism 318, and a foreign matter removing mechanism 54 for removing paper dust or other particles adhered on the recording medium P conveyed along the route of conveyance.

The first conveying roller unit 51 is disposed at the almost same level of height with the second foreign matter removing mechanism 318, the second conveying roller unit 52 is disposed on the downstream side of the first conveying roller unit 51 on the route of conveyance and at a higher level of height over the first conveying roller unit 51, and the third conveying roller unit 53 is disposed on the downstream side of the second conveying roller unit 52 on the route of conveyance and at a higher level of height over the second conveying roller unit 52.

These conveying roller units 51 to 53 are configured similarly to the aforementioned conveying roller units 314 to 316 owned by the intermittent conveying section 31, that is, configured so as to have conveying rollers 51*a* to 53*a*, and driven rollers 51*b* to 53*b*, in which the recording medium P is conveyed while being held by the individual conveying roller units 51 to 53 from the upstream side to the downstream side towards the fixing member 7.

Between the first and second conveying roller units 51 and 52, a conveyance direction change mechanism 55 for changing the direction of conveyance of the recording medium P into the direction towards the fixing member 7 and the direction outwardly from the main unit of the ink jet printer 100.

The conveyance direction change mechanism 55 comprises a conveyance direction change valve 551, and a paper discharge guide way 552 for guiding the cut recording medium P outwardly from the main unit of the ink jet printer 100.

With this conveyance direction change mechanism 55, the direction of conveyance of the recording medium P can be altered through operation of the conveyance direction change valve 551 into the direction outwardly from the main unit of the ink jet printer 100, and the recording medium P can be discharged through the paper discharge guide way 552 out from the main unit of the ink jet printer 100. The mechanism is effective when the fixing is not necessary, or when the recording medium P cannot be conveyed towards the fixing member 7 due to jamming at the fixing member.

Between the second and third conveying roller units 52 and 53, the foreign matter removing mechanism 54 is disposed.

The foreign matter removing mechanism 54 is configured similarly to the above-described first foreign matter removing mechanism 53, in which the foreign matter adhered on the recording medium P is removed therefrom through adhesion, while the recording medium P is passed between the conveying roller 541 and the foreign matter removing roller 542. The foreign matter caught on the foreign matter removing roller 542 is removed through adhesion by a cleaning roller 543.

The length of the route of conveyance within thus-configured continuous conveying unit 5 is set longer than the maximum image formation length of the recording medium P so as to minimize difference between velocities of the intermittent conveyance by the image forming section 2 and of the continuous conveyance by the fixing member 7. It is also allowable to dispose an accumulator unit for making the recording medium bend on midway of the route of conveyance within the continuous conveying unit 5.

On the downstream side of the third conveying roller unit 53 on the route of conveyance, the fixing member 7 is disposed.

The fixing member 7 will be described in the next referring to FIGS. 5 to 7.

Figure 5:
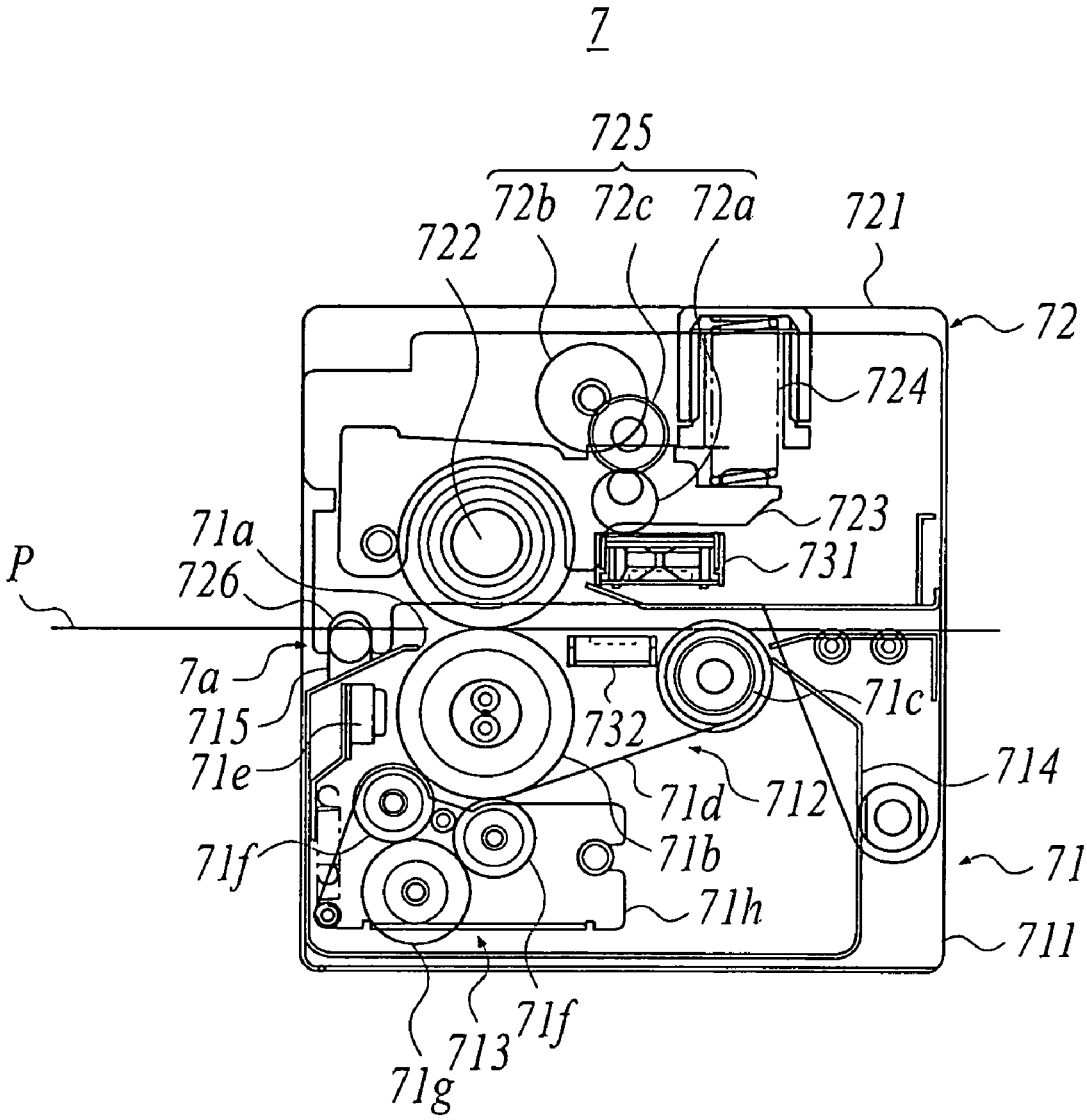
FIG. 5 is a transverse sectional view of a fixing member owned by the ink jet printer shown in FIG. 1.
Figure 6:
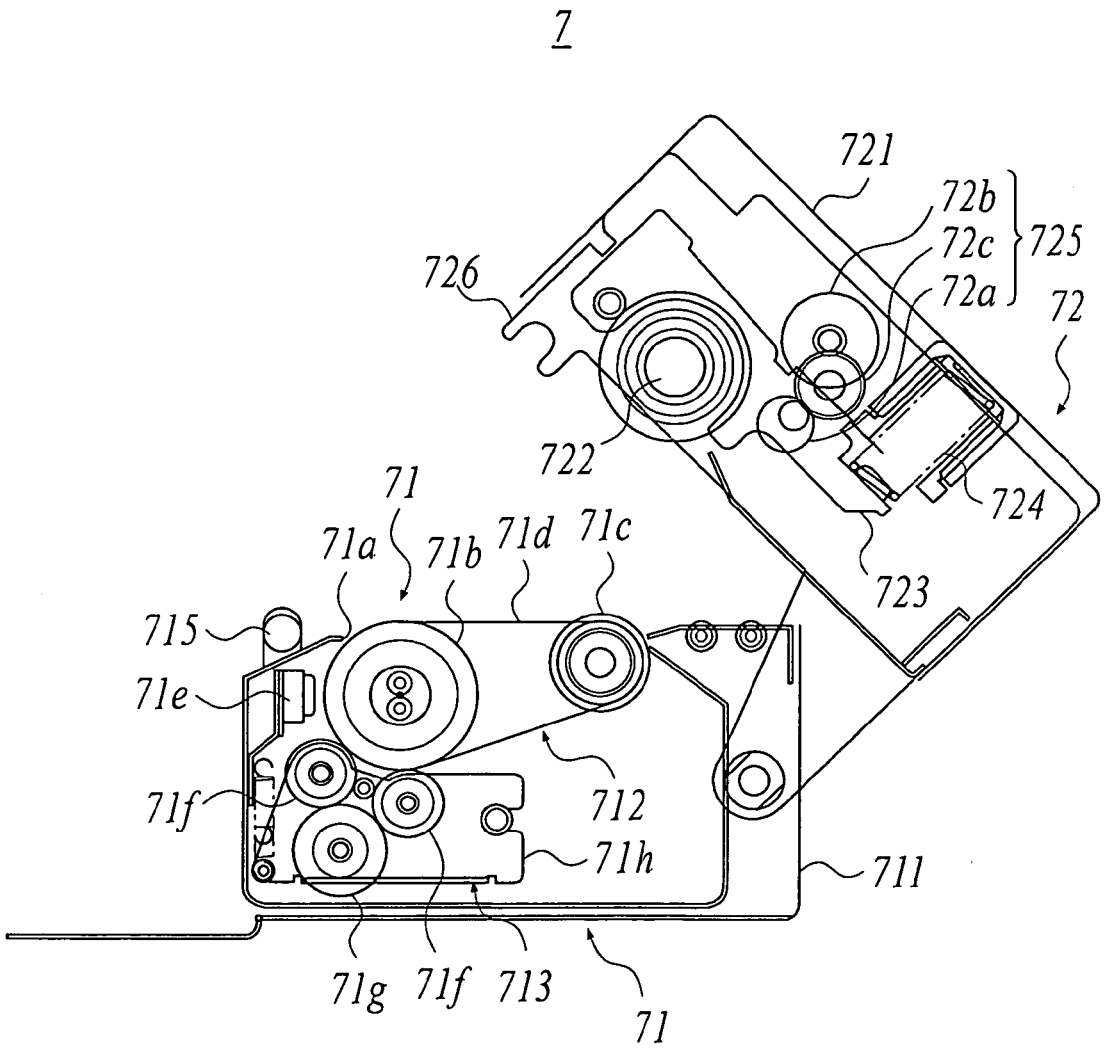
FIG. 6 is a transverse sectional view of a fixing member owned by the ink jet printer shown in FIG. 1.

FIGS. 5 and 6 are transverse sectional views of the fixing member 7, where FIG. 5 shows a closed status of a pressure unit 72 owned by the fixing member 7, and FIG. 6 shows an opened status of the pressure unit 72. FIG. 7 is a transverse sectional view of a dust-proof case 714, a heating mechanism 712, and a foreign matter removing mechanism 713 of the fixing member 7.

The fixing member 7 is disposed above the main body of the ink jet printer 100, and comprises, as shown in FIG. 5, a heating unit 71 disposed on the image-forming-surface (lower surface) side of the recording medium P, and a pressure unit 72 disposed on the back-surface (upper surface) side of the recording medium P so as to hold the recording medium P in cooperation with the heating unit 71.

The heating unit 71 has an outer case 711, and further has, as being disposed therein, the heating mechanism 712 for heating the recording medium P; the foreign matter removing mechanism 713 for removing foreign matters adhered on a fixing belt (described later) 71*d* owned by the heating mechanism 712; and the dust-proof case 714 for enclosing the foreign matter removing mechanism 713 and heating mechanism 712, and in charge of preventing these mechanisms from catching foreign matters such as dust.

The outer case 711 is a container-like member designed to be opened upwardly, as shown in FIG. 6, in which a face plate on the upstream side of the recording medium P is supported around an axis at the lower end thereof so as to be liberated. This makes it possible to readily draw the dust-proof case 714 out from the outer case 711 by opening the face plate on the upstream side during maintenance works such as clearing jamming of the recording medium P or replacing the foreign matter removing mechanism 713, fixing belt 71*d*, or the like (see FIG. 7).

The dust-proof case 714 has an opening 71*a* on the upper end thereof, and covers the heating mechanism 712 and foreign matter removing mechanism 713 so as to expose, in the opening 71*a*, only the surface of the fixing belt 71*d* owned by the heating mechanism 712.

Figure 7:
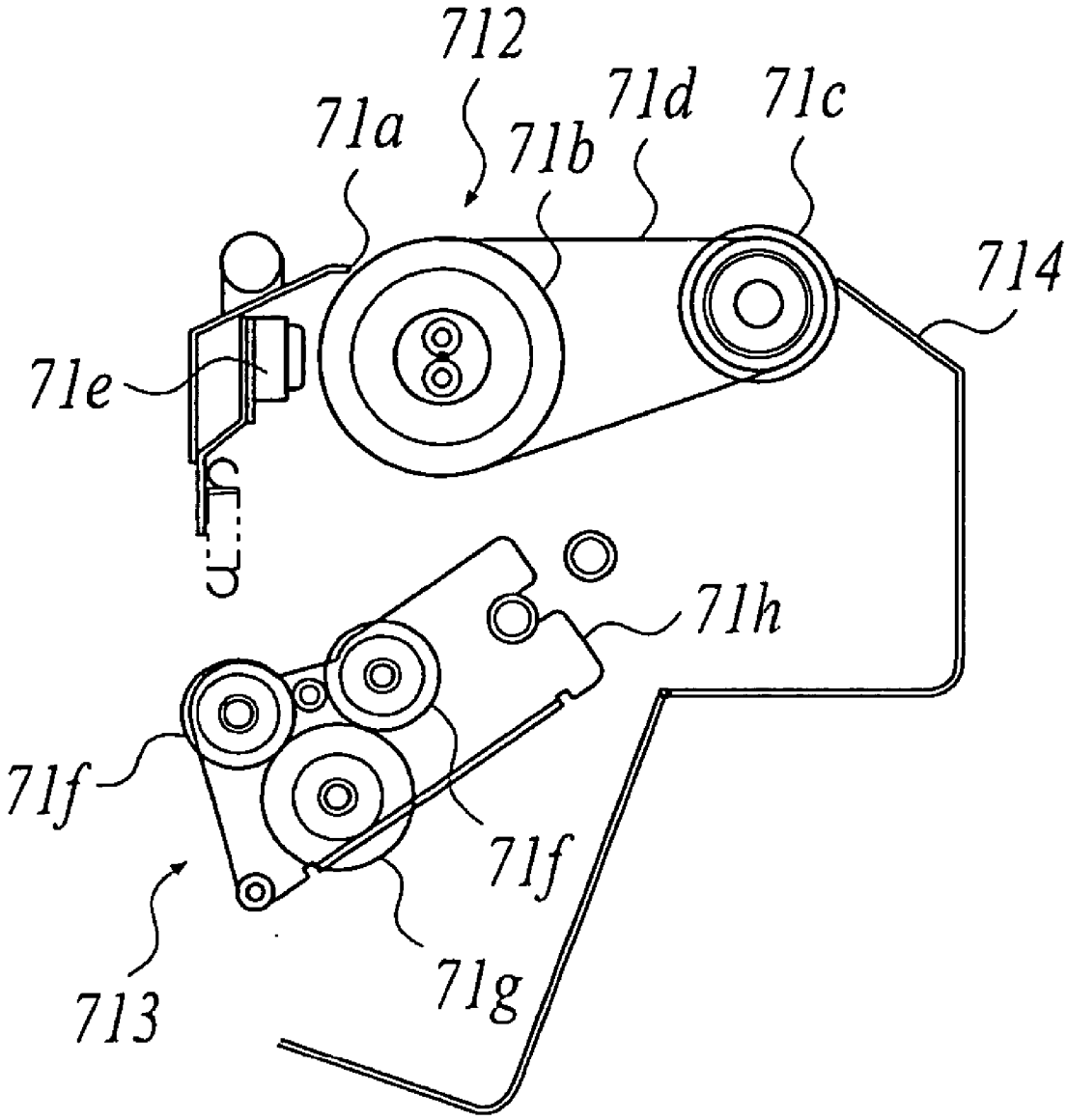
FIG. 7 is a transverse sectional view of a dust-proof case, heating mechanism, and foreign matter removing mechanism owned by the fixing member shown in FIG. 5.

As shown in FIG. 7, the dust-proof case 714 is also configured so that a portion thereof ranging from the near center portion of the lower face plate to the near center portion of the face plate on the upstream side is supported around an axis at the near center portion of the lower face place, so as to allow the portion freely revolute with respect to the main body of the dust-proof case 714. This facilitate, for example, replacement of the foreign matter removing mechanism 713 or fixing belt 71*d*.

When the fixing belt 71*d* is replaced, it is preferable to set the belt while being covered with a protective member such as a protective sheet so as to prevent the surface thereof from getting scratches, and to remove the protective member after completion of the assembling. It is also allowable to replace the heating mechanism 712 and foreign mater removing mechanism 713 together with the dust-proof case 714.

The heating mechanism 712 comprises a heating roller 71*b* disposed on the upstream side of the route of conveyance in the fixing member 7, and having halogen lamps for generating heat in order to heat the recording medium P; a drive roller 71*c* disposed on the down streamside of the heating roller 71*b* on the route of conveyance, and can rotate as being connected to a driving force source (not shown); the fixing belt 71*d* wound around the drive roller 71*c* and the heating roller 71; and a fixing temperature sensor 71*e* for detecting the temperature.

The fixing belt 71*d* is disposed so that the surface thereof is placed nearly in parallel with the image-forming surface of the recording medium P to be conveyed.

It is necessary to configure the fixing belt 71*d* so as to have a releasing property, and to have a smooth and durable surface. The fixing belt 71*d* capable of satisfying such conditions will be explained below.

Examples of combination of the base/outer layer of the fixing belt 71*d* include:

nickel belt/cured silicone;
nickel belt/silicone rubber;
nickel belt/fluorine-containing resin (PFA);
SUS belt/cured silicone;
SUS belt/silicone rubber;
SUS belt/fluorine-containing resin (PFA);
polyimide belt/cured silicone;
polyimide belt/silicone rubber; and
polyimide belt/fluorine-containing resin (PFA).

For the case where the fixing belt 71*d* is configured as having the intermediate layer disposed between the base and outer layer, possible examples of combinations of the base/intermediate layer/outer layer of the fixing belt 71*d* include:

nickel belt/silicone rubber/cured silicone;
nickel belt/silicone rubber/fluorine-containing resin (PFA);
SUS belt/silicone rubber/curable silicone;
SUS belt/silicone rubber/fluorine-containing resin (PFA);
polyimide belt/silicone rubber/curable silicone; and
polyimide belt/silicone rubber/fluorine-containing resin (PFA).

The nickel belt and SUS belt composing the base for the fixing belt is as thick as 10 to 60 μm, and more preferably 40 μm or around. The polyimide belt is as thick as 20 to 200 μm, and more preferably 100 μm or around.

The halogen lamps are designed so that both of them are activated when a predetermined temperature must be reached within a short time, for example, immediately after the ink jet printer 100 is powered on, and so that the number of activated lamps will be reduced after the predetermined temperature (e.g., 100° C.) was reached so as to control the temperature within a predetermined range (e.g., 100 to 110° C.). The halogen lamps are also designed so that the number of activated lamps is controlled depending on the width of the recording medium P and volume of processing. The halogen lamps are also designed so that the light distribution property thereof is adjusted by modifying the arrangement or length of the filament in correspondence with the width of the recording medium P or number of rows of the recording medium P so as to constantly achieve a uniform temperature distribution.

The fixing temperature sensor 71*e* is disposed on the upstream side on the route of conveyance of the recording medium P, and at a position opposing to the fixing belt 71*d*. The fixing temperature sensor 71*e* may be disposed inside the loop of the fixing belt 71*d*, or may be disposed in contact with the fixing belt 71*d*, although not in contact therewith in the aforementioned configuration, and still may be disposed in contact with the heating roller 712.

The fixing temperature sensor 71*e* is disposed in a plural number so as to correspond with the row of a plurality of recording media having a narrow width.

The drive roller 71*c* preferably has a curvature of R30 mm or smaller so as to readily separate the recording medium P from the surface of the fixing belt 71*d*. The diameter of the drive roller thus preferably falls within a range from 20 to 50 mm.

The foreign matter removing mechanism 713 comprises two foreign matter removing rollers 71*f*, . . . for removing foreign matters adhered on the surface of the fixing belt 71*d*, disposed so as to oppose with the heating roller 71*b* while placing the fixing belt 71*d* in between, and can rotate as being driven in contact with the fixing belt 71*d*; a cleaning roller 71*g* for removing foreign matters adhered on the surface of the foreign matter removing roller 71*f* by tacking, which can rotate as being driven in contact with the foreign matter removing rollers 71*f*; and a support member 71*h* for supporting these rollers 71*f*, 71*g*.

The foreign matter removing mechanism 713 is disposed as being positioned within the dust-proof case 714 using an engaging portion which is provided on one end of the support member 71*h* and is engaged with an engaged portion provided on the inner surface of the dust-proof case 714.

The foreign matter removing roller 71*f* and cleaning roller 71*g* are configured almost similarly to the aforementioned foreign matter removing roller 542 and the cleaning roller 543, in which the foreign matter transferred from the image-forming surface of the recording medium P onto the fixing belt 71*d* can be removed through adhesion, while the recording medium P is passed through the fixing member 7.

Thus-configured foreign matter removing mechanism 713 is maintained base on number of sheets of the recording medium P ever processed, the length along which the recording medium P was passed, and the time over which the recording medium P was passed. In the maintenance, the reduced adhesive force of the foreign matter removing roller 71*f* is restored by washing the foreign matter removing roller 71*f*, or by removing the foreign matter caught on the surface thereof using an adhesive sheet.

The foreign matter removing mechanism 713 may be disposed on the pressure unit 72 side if necessary, where number of the foreign matter removing rollers 71*f* and cleaning rollers 71*g* may arbitrarily be altered. It is further allowable to configure the foreign matter removing mechanism 713 as having a cleaning web, a brush, a blade and the like, in place of the foreign matter removing roller 71*f* and the cleaning roller 71*g*.

The pressure unit 72 comprises, in an outer case 721 thereof, a pressure roller 722 for pressurizing the recording medium P; an arm portion 723 on which the pressure roller 722 is supported so as to freely rotate therearound; a pressure spring 724 for downwardly energizing the arm portion 723 at the end portion thereof on the downstream side on the route of conveyance; and a pressure releasing mechanism 725 for releasing the pressurized status of the recording medium P effected by the pressure roller 722.

The outer case 721 is supported around an axis so as to freely revolve therearound with respect to the outer case 711 of the heating unit 71, and as shown in FIGS. 5 and 6, the pressure unit 72 is positioned with respect to the heating unit 71 through engagement of a pressurizing-side reference hole 726 with the heating-side reference pin 715 provided to the heating unit 71. This successfully aligns the center axes of the pressure roller 722 and the heating roller 71*b*, so as to limit displacement of the fixing belt 71*d*, pressurizing conditions or the like within a predetermined range. Torsion between the center axes of the pressure roller 722 and the heating roller 71*b* herein is only allowable within ±1 mm, and more preferably ±0.5 mm.

The arm portion 723 is supported, on the front end portion thereof on the route of conveyance, with respect to the outer case 721, around an axis so as to freely revolve therearound.

The pressure roller 722 is opposed with the heating roller 71*b* at the position slightly shifted from the front end portion of the arm portion 723 on the downstream side on the route of conveyance, and while being downwardly energized by the pressure spring 724 via the arm portion 723, it pressurizes the recording medium P in cooperation with the fixing belt 71*d* wrapped around the heating roller 71*b*, and rotates to convey the recording medium P in the conveyance direction while being driven by the running of the fixing belt 71*d*.

The pressure roller 722 necessarily has a releasing property, and the surface thereof is necessarily composed of a material not causative of surface degradation of the opposed fixing belt 71*d*. Materials for composing the pressure roller 722, which can satisfy these conditions, will be explained below.

Possible combinations of the base/outer layer of the pressure roller 722 include:

aluminum roller/silicone rubber; and aluminum roller/fluorine-containing resin (PFA).

For the case where the pressure roller 722 is configured as having an intermediate layer between the base and outer layer, possible combination of base/intermediate layer/outer layer of the heating roller relates to:

aluminum roller/silicone rubber/fluorine-containing resin.

The silicone rubber used herein preferably has a hardness of 10 to 70°, more preferably 30°, and a thickness of 0.5 to 5 mm, preferably 1 mm or around.

To cancel the deflection of the pressure roller 722 under pressure, and to keep the pressurizing force within a constant range, the pressure roller 722 may have a crown form in which the center portion has a diameter larger than that of the edge portions.

The pressure releasing mechanism 725 comprises a pressure releasing cam 72*a* for releasing the pressurized status of the recording medium P caused by the pressure roller 722; a driving motor 72*b* which rotates so as to rotate the pressure releasing cam 72*a*; and a transmission member 72*c* for transmitting driving force of the driving motor 72*b* to the pressure releasing cam 72*a*.

The pressure releasing mechanism 725 releases the pressure effected by the pressure roller 722 in such a way that the driving motor 72*b* operates to rotate the pressure releasing cam 72*a* via the transmission member 72*c*, and thereby move the arm portion 723 in an upwardly revolving manner, typically during the idle time of the ink jet printer 100, or during dejamming of the recording medium P.

Fixation conditions during the image formation using thus-configured fixing member 7 may appropriately be changed depending on the environmental conditions, where the fixing temperature on the surface of the recording medium P is preferably not lower than Tg, and is selected within a range not exceeding the heat resistant temperature of the recording medium P. The fixation time is preferably set to 0.1 seconds or longer.

The pressurizing force is adjusted to 3 kg/cm$^2$ or above, and preferably 5 to 10 kg/cm$^2$ or around.

In the route of conveyance in the fixing member 7, it is preferable to dispose the heating unit 71*t* on the lower side, and to dispose and the fixing belt 71*d* almost horizontally, almost vertically, or as being inclined at the intermediate angle therebetween. In other words, it is preferable to use the gravity in a supplemental manner in view of ensuring adhesiveness between the image-forming surface of the recording medium P and the fixing belt 71*d*, and for the case where the fixing belt 71*d* is disposed at the angle other than those described in the above, it is preferable to dispose a guide member or the like on the back surface side of the recording medium P so as to secure a sufficient adhesiveness.

The fixing member 7 has, as shown in FIG. 5, also a cooling fan 731 and a cooling element 732, both of which are provided to cool the heated and pressurized recording medium P. The cooling fan 731 and the cooling element 732 are not illustrated in FIG. 6 for simplicity.

The cooling fan 731 is disposed on the lower side of the pressure releasing cam 71*a* of the pressure unit 72, and the cooling element 732 is disposed between the heating roller 71*b* and the drive roller 71*c* of the heating unit 71.

The cooling fan 731 and the cooling element 732 are configured so as to decrease the temperature of the heated and pressurized recording medium P lower than the fixing temperature by 5° C. or more, and preferably by 20° C. or more. This is successful in lower the temperature of the recording medium P so that the resin-containing layer on the surface of the recording medium P softened during the fixation can be cured to a sufficient degree.

The cooling fan 731 and the cooling element 732 may be disposed anywhere so far as they can cool the recording medium P. Any other cooling section may substitute the cooling fan 731 and cooling element 732.

The exhaust fan 9 is provided in the vicinity of the fixing member 7.

The cooling fan 9 has a role of discharging heat generated in the fixing member 7, vapor ascribable to vaporization of water contained in the ink, and heat generated by other heat sources within the ink jet printer 100 towards the outside of the ink jet printer 100.

The air intake fan 8 is disposed at the lower portion of the ink jet printer 100, and is provided with a filter 81 for preventing any external particles or dust from coming into the ink jet printer 100.

The filter 81 adopted herein has a mesh sufficiently as fine as being capable of catching 50 μm or larger particle and dust, for the purpose of preventing invasion of such particle and dust. The air capacity of the intake fan 8 is set larger than that of the exhaust fan 9, and this makes it difficult for the particle and dust to go inside the ink jet printer 100.

The recording medium P after passing through the fixing member 7 is sent out into a recording medium receiving unit 11 disposed at the top portion of the case 1.

The recording medium receiving unit 11 is a member extended almost in a linear manner. For the case where this section is provided with a curvature for some reasons of design or so, the curvature should be larger than the reference R of the recording medium P, and is preferably adjusted to R250 mm or larger. The recording medium P once heated to a high temperature during the passage through the fixing member 7 is gradually cooled after being discharged into the recording medium receiving unit 11, and the shape of the recording medium P under the storage herein tends to remain as a curl. The aforementioned limitation of the curvature is successful in preventing the problem.

For the route of conveyance in thus-configured ink jet printer 100, any curved portion of the route has a curvature of at least 30 mm or larger in order to avoid surface cracking of the recording medium P to be conveyed. It is also necessary to configure the route of conveyance as being free from any projections or edges, and having a smooth surface so as to avoid scratching on the image-forming surface of the recording medium P to be conveyed.

The control device 200 comprises a host computer 210, and a control section 220 equipped to the main unit of the ink jet printer 100 and electrically connected with the host computer 210 through interfaces interface 21*e*, 22*d*.

The host computer 210 comprises a CPU 21*a*, a memory 21*b*, a ROM 21*c*, interfaces 21*d*, 21*e*, a magnetic disk drive 21*f*, an optical disk drive 21*g*, a network interface 21*h*, and a memory card reader 21*i*.

The CPU 21*a* executes operation according to a control program typically stored in the ROM 21*d* while using the memory 21*b* as a working area.

The interface 21*d* is connected with a scanner 21*j*, and the interface 21*e* is connected with the control section 220 of the main unit of the ink jet printer 100.

The control section 220 comprises a CPU 22*a*, an image memory 22*b*, a ROM 22*c*, an interface 22*d*, a density separating section 22*e*, a data arrangement control section 22*f*, a head driver 22*g*, main and sub-motor driver 22*h*, 22*i*, a cutter driver 22*j*, a fixation control section 22*k*, and a drying control section 221.

The CPU 22*a* generally controls the image recording by the ink jet printer 100 through controlling individual sections owned by the control section 220 using various image data sent from the host computer 210.

The CPU 22*a* also judges, as a temperature judging section, whether a temperature detected by a temperature sensor (temperature sensing section) 12 is not lower than a predetermined value or not, according to a temperature judgment program c1 (see FIG. 2B) read out from the ROM 22*c*. The CPU 22*a* also judges, as a humidity judging section, whether a humidity detected by a humidity sensor (humidity sensing section) 13 is not lower than a predetermined value or not, according to a humidity judgment program c2 (see FIG. 2B) read out from the ROM 22*c*.

The CPU 22*a* also calculates, as an ink volume calculating section, volume of the ink ejected per a predetermined unit area of the recording medium P during image formation by the image forming section 2, based on the image data entered after being output from the host computer 210, according to an ink volume calculation program c3 (see FIG.

2B) read out from the ROM 22*c*. The CPU 22*a* judges, as an ink volume judging section, whether a calculated volume of the ink ejected per a predetermined unit area of the recording medium P is not lower than a predetermined value (for example 15 ml/m$^2$) or not, according to an ink volume judgment program c4 (see FIG. 2B) read out from the ROM 22*c*.

The recording head 22 is connected to the head driver 22*g*; the drive motor 231 is connected to the main motor driver 22*h*; the sub-scanning motor 3*a*, which is a driving force source owned by the conveying roller unit, paper feeding roller unit or the like, is connected to the sub-motor driver 22*i*; and the cutting section 4 is connected to the cutter driver 22*j*.

The drying control section (drying member control section) 221 is electrically connected to the drying member 6, and controls drying etc., of the images by the drying member 6 under control of the CPU 22*a*. More specifically, the drying control section 221 controls operations of the drying member 6, based on the temperature sensed by the temperature sensor 12 and on the humidity sensed by the humidity sensor 13, according to the execution of the drying member control program c5 (see FIG. 2B) read out from the ROM 22*c* under control of the CPU 22*a*. More specifically, the drying control section 221 operates the drying member 6, only when the temperature inside the case is judged by the CPU 22*a* as being not lower than the predetermined value (e.g., 20° C.), and when the humidity inside the case is judged again by the CPU 22*a* as being not lower than the predetermined value (e.g., 50%). The drying control section 221 herein is configured so as to control at least either one of air blowing by the fan 61 and heating by the heater 62. In other words, the drying control section 221 operates only the fan 61 when the humidity was found to be a specific value not lower than the predetermined value (e.g., 60%), but operates not only the fan 61 but also the heater 62 when the humidity was found to exceed the predetermined value, so as to dry an excessive solvent contained in the ink on the recording medium P.

The drying control section 221 is also configured so as to control the operation of the drying member 6 when the volume of the ink ejected per a predetermined unit area of the recording medium P is judged by the CPU 22*a* as being not lower than the predetermined value.

The drying member 6 thus controlled by the drying control section 221 is expected to dry the excessive solvent contained in the ink in the image formed on the recording medium P to a degree that the C value of the image can be adjusted to 80 or larger after being fixed by the fixing member 7.

The fixation control section 22*k* is electrically connected to the fixing member 7, and typically controls fixation of the image onto the recording medium P under control of the CPU 22*a*. More specifically, the fixation control section 22*k* allows the heating roller 71*b* to heat the recording medium P by controlling, as a heating control section, voltage applied to the halogen lamps or PWM duty typically based on the temperature sensed by the fixation temperature sensor 71*e*, according to the execution of the drying control program c6 (see FIG. 2B) read out from the ROM 22*c* under control of the CPU 22*a*. The fixation control section 22*k* herein is expected to control heating of the recording medium P by the heating roller 71*b*, depending on the heating status of the recording medium P by the heater 62 controlled by the drying control section 221.

To the interface 22*d*, the temperature sensor 12 for sensing temperature inside the ink jet printer 100, and the humidity sensor 13 for sensing humidity inside the ink jet printer 100 are connected.

The next paragraphs will describe the image recording by the ink jet printer 100 under control of the control device 200.

When the recording medium P is set to the housing unit 31*a*, and the image recording on the recording medium P is selected through operation on the operation panel (not shown), the CPU 22*a* controls the paper feeding roller unit 312 and conveying roller units 314 to 316, to thereby convey the recording medium P housed in the housing unit 31*a* so as to adjust the front edge thereof to the recording start position in the image forming section 2.

It is also allowable that the setting of the recording medium P to the housing unit 31*a* automatically activates the conveyance of the recording medium P so as to adjust the front edge thereof to the recording start position in the image forming section 2.

In the image recording typically by the ink jet printer 100, the CPU 21*a* of the host computer 210 reads out image data from a memory card, optical disk or the like and expand it into the memory 22*b*. More specifically, the image data is expanded so that RGB data having a predetermined number of bits, and expressing luminance of the red, green and blue components of the individual pixel composing the image are arranged according to a predetermined rule.

The image data herein may be such as those read through a scanner 21, or may be such as those stored in a magnetic disk or in a memory card after being transmitted through a network N.

The CPU 21*a* then converts the data expanded in the memory 21*b* into YMCK data, based on an LUT (look-up table) which corresponds to YMCK data typically stored in the magnetic disk.

The CPU 21*a* then applies error diffusion processing (see FIG. 8) to the image data after converted into the YMCK data, and then transfer the resultant image data through the interface 21*e* to the control section 200 of the main unit of the ink jet printer 100.

Upon reception of the error-diffused image data, the CPU 22*a* of the control section 220 controls the density separating section 22*e* to thereby decompose the image data into dense ink data and light ink data, and stores them in the image memory 22*b*. In an exemplary method for decomposing the dense and light inks shown in FIG. 8, nine error-diffused input data from 0 to 8 are individually decomposed into dense and light inks respectively having three step values corresponded to the density.

FIG. 8 is a drawing for explaining interrelation among the input data, dense ink data and light ink data, where "0" indicates no ejection of the ink, "1" indicates that the ink is ejected in a form of small droplet (4 pl (picoliter)), and "2" indicates that the ink is ejected in a form of large droplet (7 pl).

In the image forming section 2, the image is formed on the recording medium P by ejecting the ink based on the image data under control of the CPU 22*a* (image forming step). More specifically, upon storage of a predetermined volume of image data into the image memory 22*b*, the CPU 22*a* controls the drive motor 231 to thereby move the carriage 23 in the scanning direction X. During this movement, the linear encoder sensor 27 mounted on the carriage 23 reads an optical pattern given on the linear scale 26 and having a 180-dpi frequency, produces a clock signal of 180 dpi, about 5 kHz, and outputs it to the data arrangement control section 22*f*.

Figure 9:
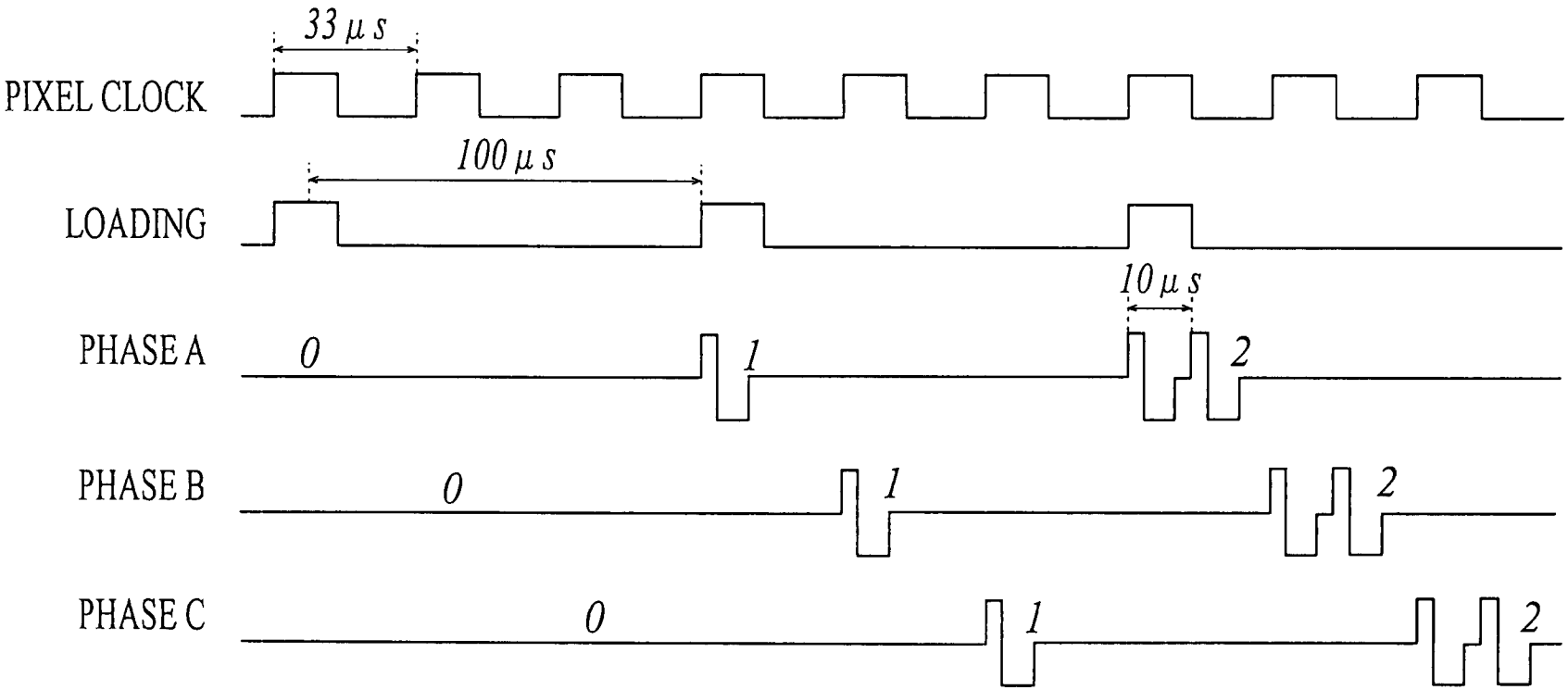
FIG. 9 is a timing chart showing a pixel clock and the individual phases A to C.

Upon enter of the clock signal, the data arrangement control section 22*f* multiplies the clock signal by 6 to thereby generate a pixel clock signal of 1080 dpi, about 30 kHz, and in synchronization with the pixel clock signal, an image data corresponded to the nozzle arrangement is read out from the image memory 22*b*. That is, as shown in FIG. 9, within a clock period of 100 μs over 3 pixel clocks, a 255-pixel data is read out for each array of the recording head 22, and is transferred to the head driver 22*g*. The head driver 22*g* generates head driving pulse signal(s) for the three-stepped data corresponded to the individual nozzles in a timing matched to phases of the individual nozzles. More specifically, the pulse signal is not generated for data "0", a single pulse is generated for data "1", and two pulses are generated at an interval of approximately 10 μs for data "2". The head driving pulses for the individual phases A to C are generated in a timing sequentially shifted by 33 μs, the length of a single pixel clock.

The nozzle (ejection hole 221) having data "0" and therefore not applied with the pulse signal do not eject the ink, and the nozzle having data "1" and applied with a single pulse ejects an ink droplet having a volume of approximately 4 pl, and forms an ink dot of approximately 35 μm in diameter on the recording medium P. The nozzle having data "2" and therefore applied with two pulses ejects an ink droplet of 4 pl or around in response to the first pulse and an ink droplet of 3 pl or around in response to the second pulse, where the second ink droplet having a larger flight speed over the first ink droplet can catch up with the first ink droplet and fuse therewith during the flight, and the resultant ink droplet of 7 pl or around can form an ink dot of approximately 44 μm in diameter on the recording medium P after being placed thereon.

Since eight recording heads 22, . . . are arranged as being shifted in the scanning direction X, the data arrangement control section 22*f* is configured so as to read the image data out from the image memory 22*b* in a timing corresponded to the position of the individual recording heads 22, and to make control so that the positions of the ink dots formed by the individual recording heads 22 almost coincide with each other on the recording medium P as a consequence.

This makes it possible to form ink dots according to the image data at 3-pixel intervals in 1080 dpi during a single scanning of the carriage 23.

After completion of a single scanning by the carriage 23, the CPU 22*a* controls the sub-scanning motor 3*a* or the like, to thereby convey the recording medium P by 170 pixels in 1080 dpi, or more specifically by 4 mm.

The CPU 22*a* then controls the driving motor 231 to move the carriage 23 in the opposite direction, and forms the ink dots corresponded to the image data in a reverse manner according to the procedures similar to those in the forward run. More specifically, since the nozzles (ejection holes 221) of the recording heads 22 in two rows are distant from each other by 70.5 μm in 360 dpi, the second scanning (backward scanning) after the recording medium P was conveyed by 4 mm results in formation of dots distant by 1080 dpi pixels of the dots formed in the first (forward) scanning, which is equivalent to 23.5 μm.

By repeating the above-descried scanning, a single image corresponded to the image data transferred from the host computer 210 is completed.

For the case where the nozzle (ejection hole 221) arrangement shown in FIG. 4B is adopted, the image is formed in a resolution of 1080×1080 dpi. In a continuous image formation of a plurality of images, the images are formed in a continuous manner without producing a boundary between the adjacent images.

With the progress of the image formation by the image forming section 2, the recording medium P is intermittently conveyed by the intermittent conveying section 310 sequentially towards the cutting section 4 and continuous conveying section 5.

When the recording medium P is sent out from the image forming section 2 and the image boundary reaches the cutter-cutting position in the cutting section 4, the CPU 22*a* controls the cutting section 4 to thereby move the rotary cutter 421 in the scanning direction X to thereby cut the recording medium P. When the marginless print is desired, the recording medium P is cut on both sides of the image boundary in a width of 4 mm. The cutting chips generated from the cutting of the recording medium P are collected in the cutting recovery unit 43.

After completion of the last image formation, the CPU 22*a* controls the conveying roller units 314 to 316 and so forth to thereby convey the recording medium P until the rear edge of the last image formed on the recording medium P reaches the cutter-cutting position and to cut the rear edge of the image using the rotary cutter 421, then makes the recording medium P recede by allowing the conveying rollers 314*a* to 316*a* to inversely rotate to thereby adjust the front edge of the unrecorded recording medium P to the start position for the image recording.

On the other hand, upon completion of the cutting of the recording medium P, the continuous conveying section 5 under control of the CPU 22*a* continuously conveys the recording medium P to the fixing member 7, and the drying control section 221, again under control of the CPU 22*a*, further controls the drying member 6 so as to rotate the fan 61 or heating the heater 62, to thereby dry the ink for forming the image on the recording medium P while adjusting the dry volume of the ink (drying step).

Specific procedures for controlling the drying member 6 carried out by the CPU 22*a* will be described in the next.

The CPU 22*a* outputs a predetermined control signal to the drying control section 221 based on the temperature and humidity sensed by the temperature sensor 12 and the humidity sensor 13, and makes the drying control section 221 change voltage of the heater 52 or PWM duty. More specifically, for example, when it is judged by the CPU 22*a* that the temperature and humidity are not lower than the predetermined values and not higher than the specific values, the drying control section 221 raises voltage to be applied to the fan 61 to thereby increase the air volume, dries the image on the recording medium P. When the it is judged by the CPU 22*a* that the temperature and humidity exceed the specific values, the drying control section 221 raises voltage to be applied not only to the fan 61 but also to the heater 62 so as to elevate the temperature of the hot air, to thereby effectively dry the image on the recording medium P. It is now also allowable that, also in a situation of higher-temperature and lower-humidity as compared with the predetermined values, in a situation of lower-temperature and higher-humidity, or in a situation of lower-temperature and lower-humidity, the voltage to be applied to the heater 62 and the fan 61 can be controlled by the CPU 22*a* depending on these situations.

The drying control section 221 is further configured so as to control operations of the drying member 6, that is, the operations of the fan 61 and the heater 62, when the CPU 22*a* judges that the volume of the ink ejected per a predetermined unit area of the recording medium P is not lower than the predetermined value.

This is successful in vaporize the excessive solvent contained in the ink in the image formed on the recording medium P, and in appropriately drying it. In other words, the drying control section 221 can control at least either operation of air blowing by the fan 61 and heating by the heater 62 with respect to the recording medium P, and can efficiently dry the excessive solvent contained in the ink. The drying control section 221 can make the drying member 6 operate so as to appropriately dry the excessive solvent contained in the ink, when the volume of the ink ejected per a predetermined unit area of the recording medium P is not lower than the predetermined value.

When the recording medium P conveyed by the continuous conveying section 5 arrives at the fixing member 7, the recording medium P is then sent through the sending-in slot 7*a* of the fixing member 7 into the fixing member 7.

The fixing member 7 under control of the CPU 22*a* rotates the fixing belt 71*d* and the pressure roller 722, to thereby continuously convey the recording medium P while heating and pressurizing it so as to effect the gloss-enhancing (fixing) treatment with respect to the recording medium P. Because the formed image is dried, before the fixation, with the air blown by the drying member 6 so as to remove the excessive solvent contained in the image on the recording medium P, the fixing member 7 can effectively carry out the gloss-enhancing treatment, and can fully enhance the glossiness of the recorded image. Because the drying member 6 is configured so as to dry the excessive solvent contained in the ink in the image formed on the recording medium P so as to attain a C value of 80 or above after fixed by the fixing member 7, it is made possible to obtain the image having a glossiness comparable with that obtainable by silver salt photograph.

The heating temperature of the recording medium P is adjusted by the CPU 22*a* through varying voltage to be applied to the halogen lamps or PWM duty, based on the temperature sensed by a fixation temperature sensor 71*e*. Because the fixation control section 22*k* is configured so as to control the heating of the recording medium P by the heating roller 71*b* depending on the heating status of the recording medium P by the heater 62 which is controlled by the drying control section 221 under control of the CPU 22*a*, the recording medium P is brought into a status as being preliminarily heated by the heater 62, and this makes it possible to efficiently heat the recording medium P by the heating roller 71*b* of the fixing member 7 while taking the heating status by the heater 62 into consideration. It is also allowable that the adjustment is effected by accelerating or decelerating the conveyance depending of the environmental conditions.

In case of jamming of the recording medium P in the fixing member 7, the operation of the fixing member 7 is interrupted, jamming is indicated on the display section (not shown), pressure contact is released, and in addition, the image formation for the succeeding recording medium P is processed.

More specifically, if the image formation is interrupted halfway and restarted later, the resultant image tends to be non-uniform due to misalignment of positions of the recording medium P or the ink ejection, before and after the interruption. It is allowable that the recording medium P on its way of image formation is allowed to continue and complete the image formation, the recording medium P on which the image formation has been finished is sent through the paper discharge guide way 552 and discharged out from the ink jet printer 100, and the succeeding image formation is pended; or all of the succeeding image formation are completed, and the recording medium P on which the image formation has been finished is sent through the paper discharge guide way 552 and discharged out from the ink jet printer 100. Upon recovery of the fixing member 7, the recording medium P on which the image formation has been finished is sent through a conveyance route, not shown, to the fixing member 7, where the formed image is fixed.

The recording medium P after the gloss-enhancing treatment is sent out from the fixing member 7 and stacked in the recording medium receiving unit 11.

<Embodiments>

Embodiments of the present invention will be described below.

(Ink)

Each dense and light ink of yellow, magenta, cyan and black, that is, eight colors of ink was used.

(Method for Preparing Ink)

As a pigment for yellow ink, C.I. Pigment Yellow 74 was used. As a pigment for magenta ink, C.I. Pigment red 122 was used. As a pigment for cyan ink, C.I. Pigment Blue 15:3 was used. As a pigment for black ink, carbon black was used. Each pigment was mixed with a predetermined amount of acryl, styrene resin, glyceline and ion-exchange water to prepare pigment dispersion.

Dense yellow ink, dense magenta ink: 15% each pigment dispersion, 30% solvent (ethylene glycol or the like), 0.1% surfactant, 54.9% ion-exchange water were mixed, stirred and filtered with filter (made by ToyoRoshi Kaisha, Ltd. 1 μm cartridge filter) to prepare them.

Light cyan ink, black ink: 10% each pigment dispersion, 30% solvent (ethylene glycol or the like), 0.1% surfactant, 59.9% ion-exchange water were mixed, stirred and filtered with filter (made by ToyoRoshi Kaisha, Ltd. 1 μm cartridge filter) to prepare them.

Light yellow ink, light magenta ink: 3% each pigment dispersion, 35% solvent (ethylene glycol or the like), 0.1% surfactant, 61.9% ion-exchange water were mixed, stirred and filtered with filter (made by ToyoRoshi Kaisha, Ltd. 1 μm cartridge filter) to prepare them.

Light cyan ink: 2% each pigment dispersion, 35% solvent (ethylene glycol or the like), 0.2% surfactant, 62.8% ion-exchange water were mixed, stirred and filtered with filter (made by ToyoRoshi Kaisha, Ltd. 1 μm cartridge filter) to prepare them.

Light black ink: 2% each pigment dispersion, 35% solvent (ethylene glycol or the like), 0.1% surfactant, 62.9% ion-exchange water were mixed, stirred and filtered with filter (made by ToyoRoshi Kaisha, Ltd. 1 μm cartridge filter) to prepare them.

(Recording Medium, etc.)

Preparation of coating liquid for lower layer: Coating liquid for lower layer was prepared by using polyvinyl alcohol solution (19%) and pure water (21%) in silica dispersion (60%).

Preparation of coating liquid for upper layer: Coating liquid for upper layer was prepared by adding acrylic latex having Tg of 82° C., which is a thermoplastic fine particle, to the coating liquid for lower layer so as to adjust the solid adhesion ratio between the thermoplastic fine particle and a filler (silica) to 55/45.

The coating liquid for lower layer was coated on a paper support having a thickness of 220 μm, which was coated with polyethylene on both surfaces thereof, from the support side so that the coating amount of silica was 18 g/m$^2$. Further, the coating liquid for upper layer was coated on the coating liquid for lower layer so that the coating amount of silica was 3 g/m$^2$. Then, the recording medium having ink absorption amount of not less than 25 ml/m$^2$ was prepared by drying and refining it.

(Image Recording Operation)

An image was formed by ejecting the above-described eight colors of ink to a rolled recording medium (width 297 mm) so that the conveyance length of the recording medium was 4 mm, the recording density was 1080×1080 dpi and a volume of droplet was 7 pl.

The accelerated velocity of the cartridge was 1 [G] during the acceleration and deceleration thereof, and the moving velocity was 780 mm/s.

(Drying Condition)

Heater: A halogen lamp heater having the rating of 78V, 280 W, was used. The voltage thereof was adjusted according to the loss on drying of the excess solvent included in the ink for forming an image.

Blowing fun: A crossflow fan having the rating of 24V, 1.0 A was used. The airflow thereof was adjusted so as to be not less than 2.2 L/s on the surface of the recording medium.

(Fixing Process Condition)

Structure of image forming surface side of fixing member: A seamless nickel belt having a thickness of 40 μm, on which curable silicone was coated, was attached to a heating roller made of aluminum, which comprises halogen lamps, and a driven roller.

Structure of rear surface side of fixing member: A silicon rubber having a thickness of 1 mm, which has a core made of aluminum, and a PFA tube were used as a coated pressure roller.

Pressure force: A surface pressure was adjusted to 7 Kgf/cm$^2$ throughout the width of the recording medium.

Fixing temperature: A surface temperature of the nickel belt was controlled so as to set it to 105° C.±5° C.

Conveyance speed: It was set to about 10 mm/s. Thereby, the fixing time (heating and pressing time) was not less than 0.2 second at a nip width of not less than 2 mm.

(Method of Measuring C Value)

Among the image sharpness specified in JIS K 7105, a value measured by the reflective method using a 2-mm optical frequency comb was defined herein as C value.

(Tests on Effects of Environmental Conditions)

A temperature of 25° C. and a humidity of 50% inside the ink jet printer during the image forming operation was defined as environmental condition 1, a temperature of 25° C. and a humidity of 60% as environmental condition 2, a temperature of 25° C. and a humidity of 70% as environmental condition 3, a temperature of 30° C. and a humidity of 60% as environmental condition 4, and a temperature of 30° C. and a humidity of 70% as environmental condition 5. Under the individual conditions, images were formed on the recording medium with an ink volume varied as 12.5, 15, 17.5, 20 and 24 ml/m$^2$. After the images were fixed, the C values of the images were measured. Results are shown in FIG. 13.

Figure 13:
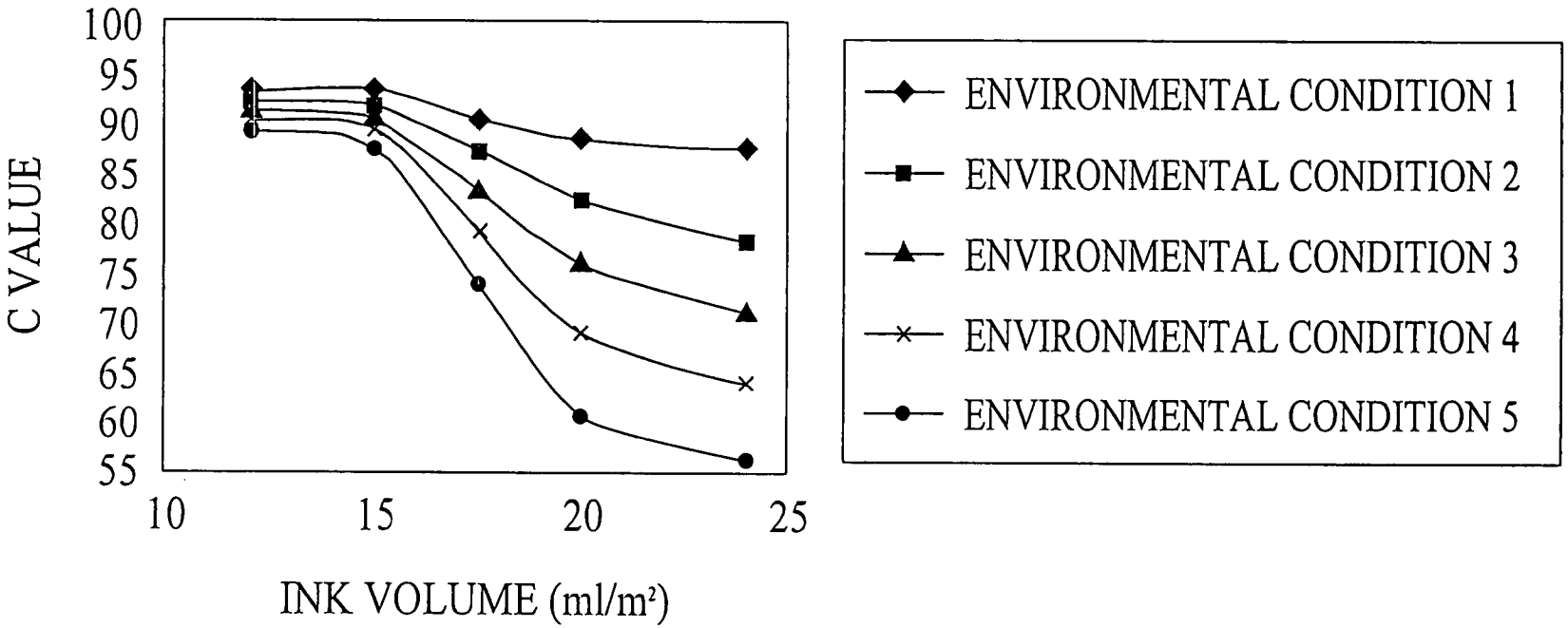
FIG. 13 is a graph showing interrelations among volume of the ink ejected onto the recording medium, environmental conditions and C value of the recorded image.

As shown in FIG. 13, the C value of the recorded image was lowered only to a small degree at 25° C., 50% RH according to environmental condition 1 even if the ink volume was increased, but lowered to a larger degree as the humidity increased (environmental conditions 2 and 3), and under the environments having a humidity of 70%, the C values of the recorded images were lowered to as low as below 80 even when the ink volume was as small as 20 ml/m$^2$. Under a temperature of 30° C. as under environmental condition 4 (60% RH) and environmental condition 5 (70% RH), the C values of the recorded images were considerably lowered as compared with those observed at 25° C. under environmental condition 2 (60% RH) and environmental condition 3 (70% RH), respectively.

(Tests on Effects of Loss-on-Drying)

An image was formed under environmental conditions of 30° C. and 70% RH, with an ink volume on the recording medium of 20 ml/m$^2$, and an excessive solvent contained in the ink forming the image was removed by adjusting the voltage of the heater to 30, 40, 50, 60 and 70V in the condition of operating the fan of the drying member, so as to attain values of loss-on-drying of 1, 2, 3, 4 and 5 g/m$^2$. The image was fixed, and the C value of the recorded image was measured. Results are shown in FIG. 14.

Figure 14:
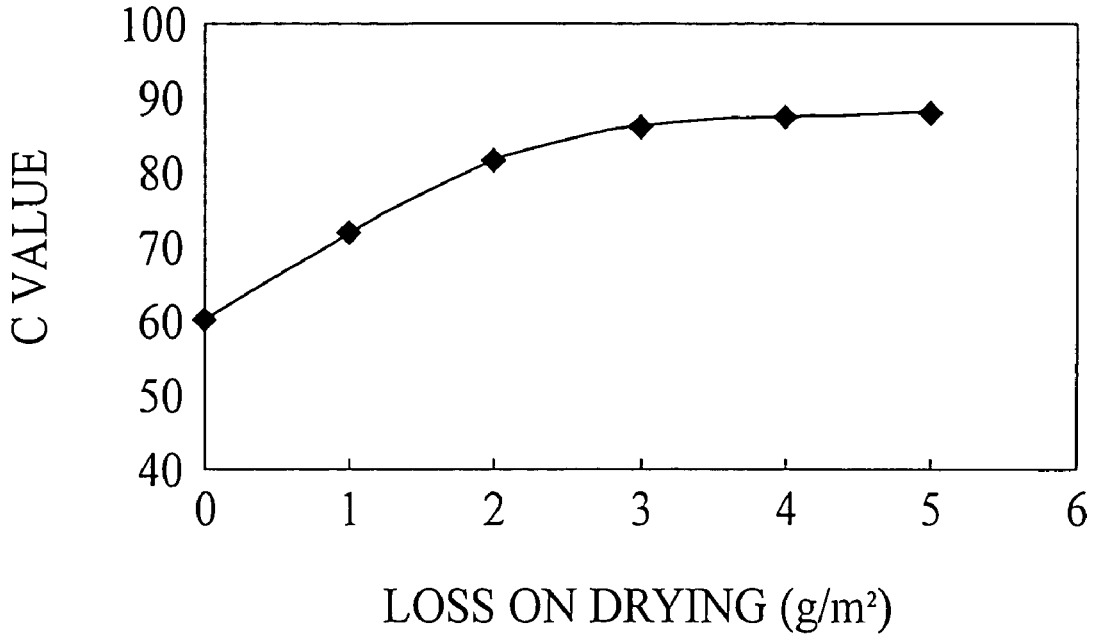
FIG. 14 is a graph showing a relation between loss-on-drying of the ink and C value of the recorded image.

As shown in FIG. 14, the C value of the recorded image was successfully raised to a level exceeding 80 or around under a loss-on-drying of 2 g/m$^2$, that is, when the ink volume was reduced by approximately 10%. Under a loss-on-drying of 4 g/m$^2$, that is, when the ink volume was reduced by approximately 20%, the C value of the recorded image was successfully raised to as high as 90 or around, which was equivalent to that observed under environmental conditions of 25° C. and 50% RH.

As is clear from the above, decrease in the glossiness. (C value) of the recorded image tends to be more distinctive as the ink volume increases under the hot-and-humid environmental conditions (e.g., 30° C., 70% RH), but the glossiness of the recorded image can be improved by removing, by drying, the excessive solvent contained in the ink forming the image on the recording medium.

Because the C value of the recorded image was found to decrease to a larger degree when the ink volume was increased under the hot-and-humid environment, it was considered that the C value could be raised also by reducing the amount of ink used for the image formation.

It is to be understood that all of level number of error diffusion, number of colors of the ink, number of the recording heads 22, head scanning speed, configuration of the recording head 22, number of nozzles, pitch of the nozzles (ejection holes 221), resolution of the recording, linear scale frequency, recording frequency, volume of ink droplet, step number of volume of the ink droplet are exemplary ones, and may properly be modified in an arbitrary manner.

While the drying control section 221, in the above-described embodiment, was configured so as to control the drying member 6 based on the execution of the drying member control program c5, the configuration is by no section limited to this example, wherein the drying control section 221 may also be configured as a predetermined logic circuit, or as a CPU or the like, under control of which a predetermined program is executed so as to realize the functions of the drying member control section. It is still also allowable to adopt a configuration in which the control of the drying control section 221 is supported by a host computer 210.

MODIFIED EXAMPLE

The following paragraphs will describe several modified examples of the components of the ink jet printer 100 referring to the attached drawings.

It is to be noted that the modified examples described below will have portions in common with the above-described example except for portions specific to the individual modified examples, so that the common portions will be given with the same reference numerals, and will not repeatedly be explained.

Modified Example of Continuous Conveying Section

A modified example of the continuous conveying section will be described referring to FIG. 10.

Figure 10:
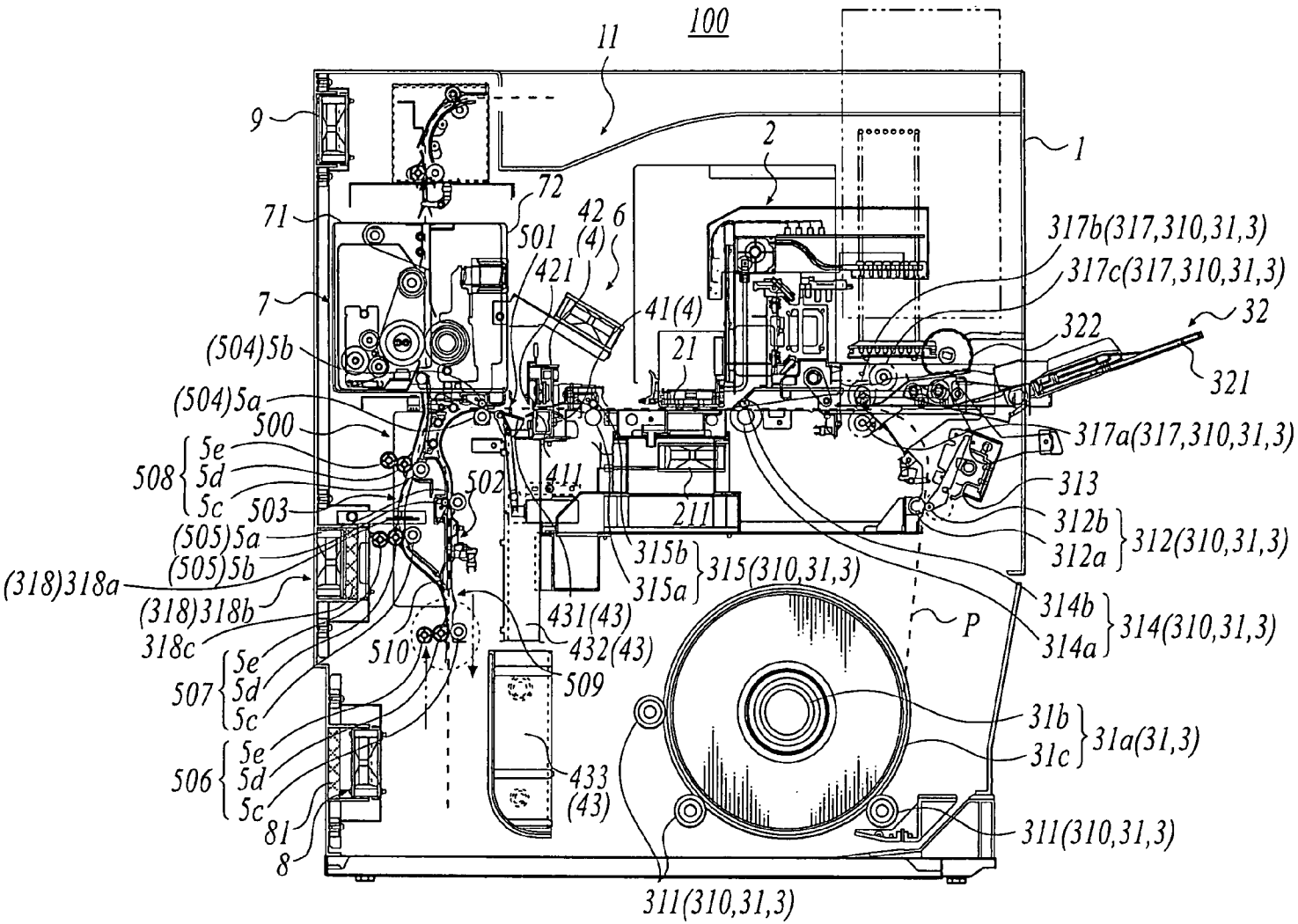
FIG. 10 is a transverse sectional view of a main part of the ink jet printer equipped with a modified example of a continuous feeding potion.

FIG. 10 is a transverse sectional view of a main part of the ink jet printer 100 equipped with a modified example of the continuous conveying section.

A continuous conveying section 500 of this modified example is provided for conveying the recording medium P based on the switch-back system, and is disposed on the downstream side of the cutting chip recovery unit 43 on the route of conveyance.

The continuous conveying section 500 comprises a sending-in slot 501 for introducing the recording medium P sent out from the cutting section 4; a first conveyance route 502 composing a downward route of conveyance for the recording medium P from the sending-in slot 501 down to the conveyance route change portion (described later) 509; a second conveyance route 503 composing an upward route of conveyance for the recording medium P from the conveyance route change portion 509 up to the fixing member 7; and first to fifth conveying roller units 504 to 508 which rotate to continuously convey the recording medium along the individual routes of conveyance.

The end point of the first conveyance route 502 and the start point of the second conveyance route 503 compose a route having a nearly-Y-formed section so as to commonly occupy the route of conveyance with each other, and this portion of the route having the nearly-Y-formed section serves as the conveyance route change portion 509.

The conveyance route change portion 509 is provided so as to change the downward conveyance of the recording medium P along the first conveyance route 502 into the upward conveyance along the second conveyance route 503. The conveyance route change portion 509 has also a conveyance route limiting valve 510 for limiting the conveyance of the recording medium P along the first conveyance route 502 and then guiding the recording medium P along the second conveyance route 503, when the recording medium P is conveyed from the conveyance route change portion 509 to the fixing member 7. The conveyance route limiting valve 510 is typically disposed at the intersection of the first conveyance route 502 and the second conveyance route 503.

The first and second conveying roller units 504, 505 rotate so as to convey the recording medium P downwardly along the first conveyance route 502; the third conveying roller unit 506 rotates so as to change the conveyance route of the recording medium P from the first conveyance route 502 to the second conveyance route 503 at the conveyance route change portion 509; and the fourth and fifth conveying roller units 507, 508 rotate so as to convey the recording medium P upwardly along the second conveyance route 503.

The first conveying roller unit 504 is disposed on the first conveyance route 502 and at the position slightly close to the send-in slot 501; the second conveying roller unit 505 is disposed on the first conveyance route between the first conveying roller unit 504 and the third conveying roller unit 506; the fourth conveying roller unit 507 is disposed on the second conveyance route 503 almost at the middle point thereof; and the fifth conveying roller unit 508 is disposed on the second conveyance route 503 and at the position slightly close to the fixing member 7.

The first and second conveying roller units 504, 505 respectively comprise a conveying roller 5*a* which is connected to a driving force source (not shown) and rotates while being powered by the driving force source; and a driven roller 5*b* which is disposed so as to sandwich the recording medium P together with the conveying roller 5*a*, and conveys the recording medium P in cooperation with the conveying roller 5*a*.

The third to fifth conveying roller units 506 to 508 respectively comprise a conveying roller 5*c* which is connected to a driving force source (not shown) and rotates while being powered by the driving force source; a foreign matter removing roller 5*d* which is disposed so as to sandwich the recording medium P together with the conveying roller 5*c*, rotates as being driven by the rotation of the conveying roller 5*c*, and removes the foreign matter adhered on the image-forming surface of the recording medium P through adhesion; and a cleaning roller 5*e* which is disposed in contact with the foreign matter removing roller 5*d*, rotates as being driven by the rotation of the foreign matter removing roller 5*d*, and removes the foreign matter adhered on the surface of the foreign matter removing roller 5*d*.

In the continuous conveying section 5, the CPU 22*a* controls the first and second conveying roller units 504, 505 so as to allow the conveying roller 5*a* to rotate in a predetermined direction, to thereby convey the recording medium P downward along the first conveyance route 502.

When the recording medium P is conveyed to reach the conveyance route change portion 509, the CPU 22*a* controls the third conveying roller unit 506 so as to allow the conveying roller 5*c* to rotate in a predetermined direction, to thereby convey the recording medium P downward until the rear edge thereof passes through the conveyance route limiting valve 510. After the rear edge of the recording medium P passed through the conveyance route limiting valve 510, the conveying roller 5*c* rotates in a direction opposite to the predetermined direction, and thereby the conveyance direction of the recording medium P is inverted upward. Any foreign matter adhered herein on the image-forming surface of the recording medium P can be removed by the foreign matter removing roller 5*d* of the third conveying roller unit 506 through adhesion.

The recording medium P of which conveying direction has been changed is guided by the conveyance route limiting valve 510 along the second conveyance route 503, and is then conveyed along the second conveyance route 503 upward under control of the CPU 22*a* which controls the fourth and fifth conveying roller units 507, 508 so as to allow the conveying roller 5*c* to rotate in a direction opposite to the predetermined direction. Any foreign matter adhered herein on the image-forming surface of the recording medium P can be removed by the foreign matter removing rollers 5*d* of the fourth and fifth conveying roller units 507, 508 through adhesion.

As described in the above, the continuous conveying section 500 can convey the recording medium P based on continuous, constant-velocity conveyance, after being changed from the intermittent conveyance effected by the intermittent conveying section 310, and can change the conveyance direction into upward so as to convey the recording medium P towards the fixing member 7 disposed above the continuous conveying section 500.

A foreign matter removing mechanism 518 is disposed on the second conveyance route 503 between the fourth conveying roller unit 504 and the fifth conveying roller unit 508.

The foreign matter removing mechanism 518 is configured similarly to the second foreign matter removing mechanism 318 exemplified in the above-described embodiment, and is equipped with the paper dust removing brush 318*a* and the suction fan 318*b*, so as to remove the paper dust adhered on the image-forming surface of the recording medium P.

Modified Example 1 of Fixing Member

Modified example 1 of the fixing member will be explained referring to FIG. 11.

Figure 11:
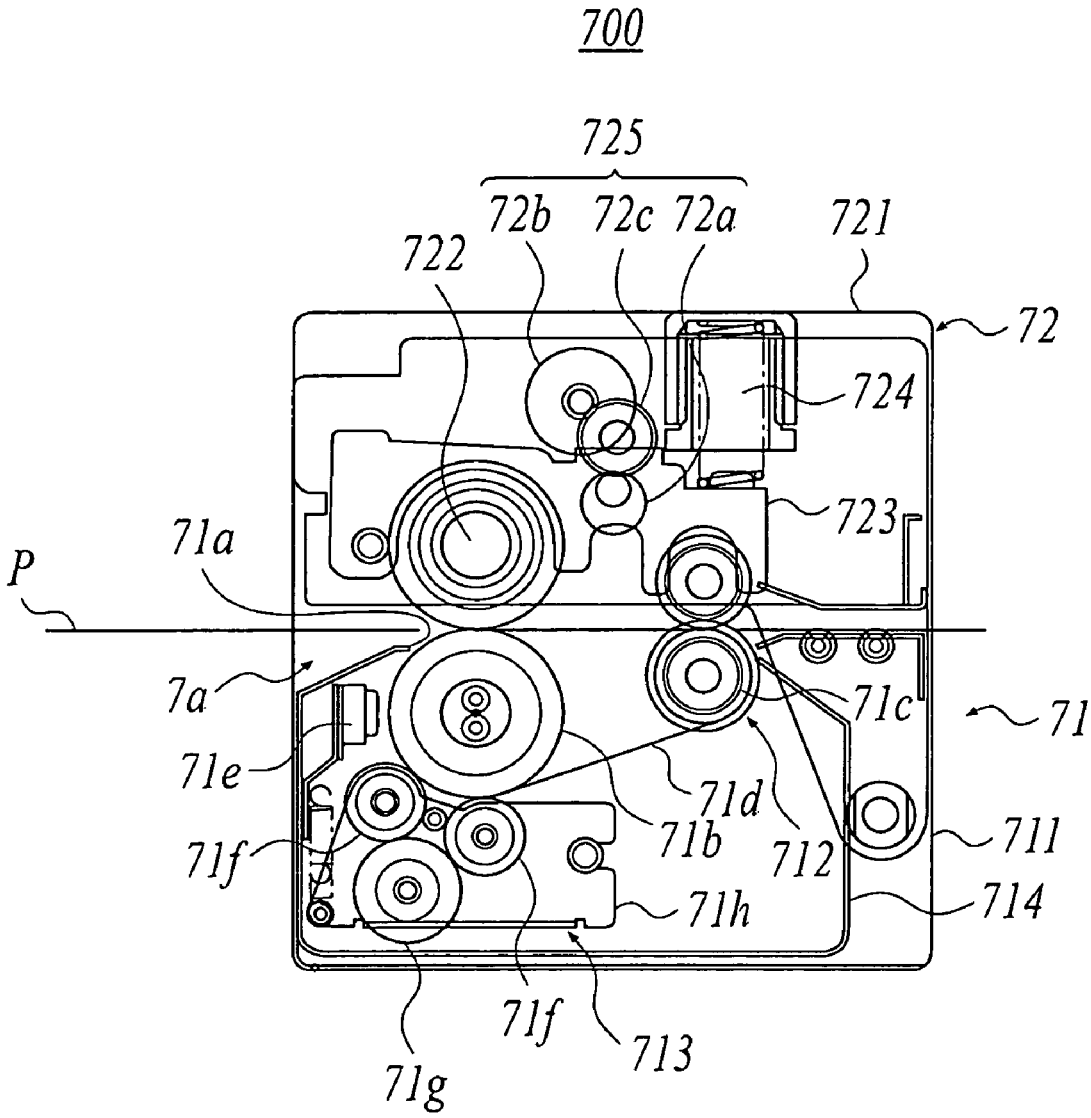
FIG. 11 is a transverse sectional view of a first modified example of the fixing member.

FIG. 11 is a transverse sectional view of a modified example of the fixing member.

A fixing member 700 in modified example 1 comprises a drive roller 727 which is disposed on the downstream side of the pressure roller 722 on the route of conveyance, and can rotate as being connected to a driving force source (not shown); and the pressure unit 72 which has a conveying belt 728 stretched between the drive roller 727 and the pressure roller 722.

The conveying belt 728 is disposed so as to align the surface thereof almost in parallel with the back surface of the recording medium P to be conveyed.

The conveying belt 728 has properties almost similar to those of the fixing belt 71*d*, and has constituents again almost similar to those of the fixing belt 71*d*.

The drive roller 727 is disposed so as to nearly oppose to the drive roller 71*c* of the heating unit 71. The position of the drive roller 727 may appropriately be altered depending on the length of the conveying belt 728, roller diameter, and so forth.

Thus-configured fixing member 700 is advantageous in readily keeping the adhesiveness between the fixing belt 71*d* and the recording medium P, and this is also successful in raising the degree of freedom in positioning of the fixing member 700.

Modified Example 2 of Fixing Member

Modified example 2 of the fixing member will be explained referring to FIG. 12.

Figure 12:
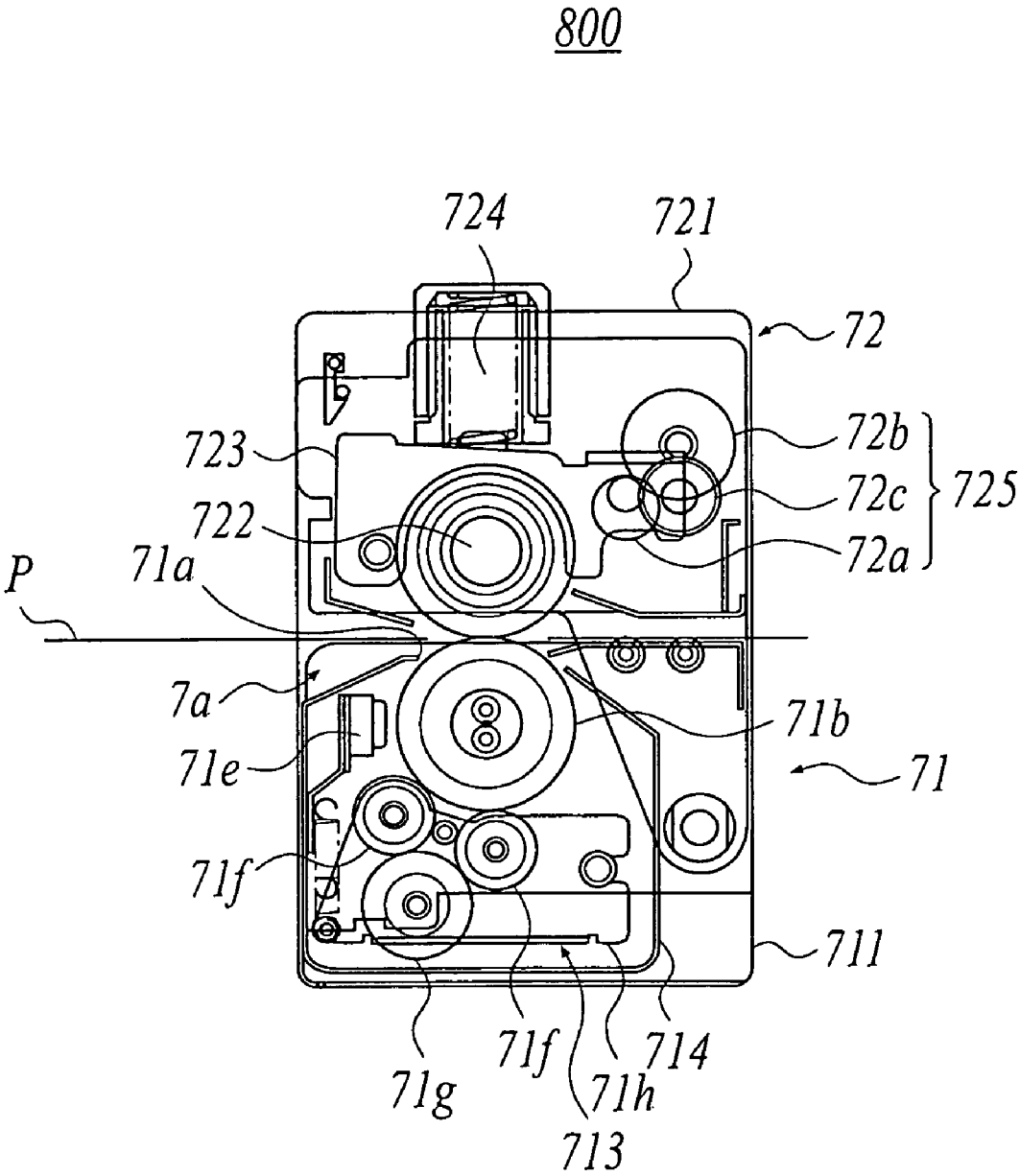
FIG. 12 is a transverse sectional view of a second modified example of the fixing member.

FIG. 12 is a transverse sectional view of a modified example 2 of a fixing member 800.

The fixing member 800 of the modified example 2 has the heating unit 71 having the heating roller 71*b* which is disposed so as to oppose with the pressure roller 722, and can rotate under contact with the pressure roller 722.

The heating roller 71*b* is connected to a driving force source such as a drive motor (not shown), the pressure roller 722 can rotate while being driven by the rotation of the heating roller 71*b*, and the recording medium P can be conveyed based on cooperation of these rollers.

It is necessary for the heating roller 71*b* to have releasing property and durability, and also to have a smooth surface. Materials for composing the heating roller 71*b* which can satisfy the above-described needs will be explained.

Possible combinations of base/outer layer of the heating roller 71*b* include:

aluminum roller/cured silicone; and aluminum roller/fluorine-containing resin (PFA).

For the case where the heating roller 71*b* is configured as having an intermediate layer between the base and outer layer, possible combinations of base/intermediate layer/outer layer of the heating roller include:

aluminum roller/silicone rubber/cured silicone; and aluminum roller/silicone rubber/fluorine-containing resin.

The hardness and thickness of the silicone rubber layer are preferably adjusted to be equivalent to those of the pressure roller 722.

This configuration of the fixing unit 800 is advantageous in needing only a less number of components, being low in cost, and being easy in assembly and wire routing.

Modified Example of Control Device

A modified example of the control device will be explained referring to FIGS. 15A and 15B.

Figure 15A:
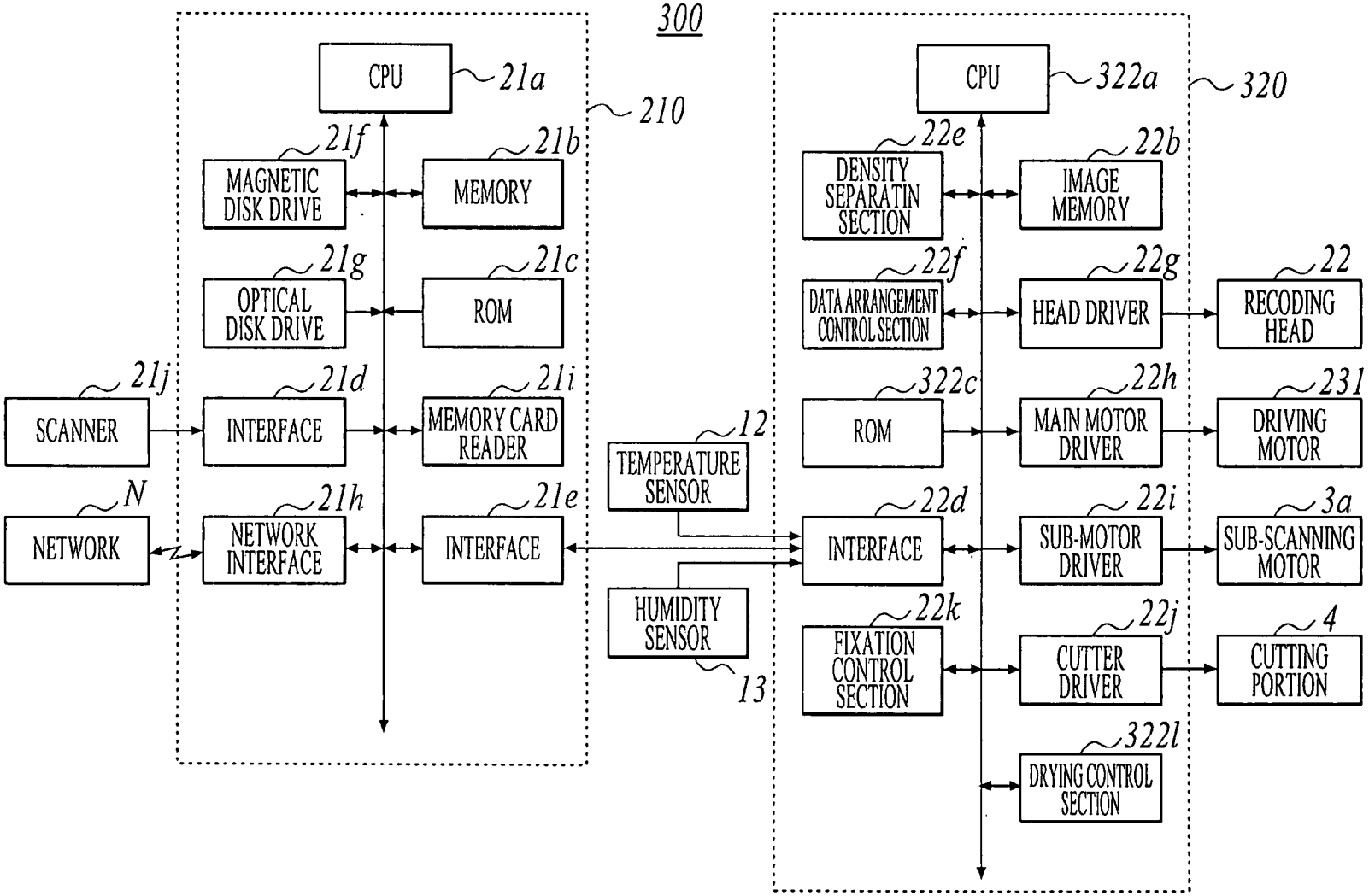
FIG. 15A is a block diagram showing a configuration of a main part of the control device according to a modified example and FIG. 15B is a view showing an internal structure of the ROM provided in the control device shown in FIG. 15A.
Figure 15B:
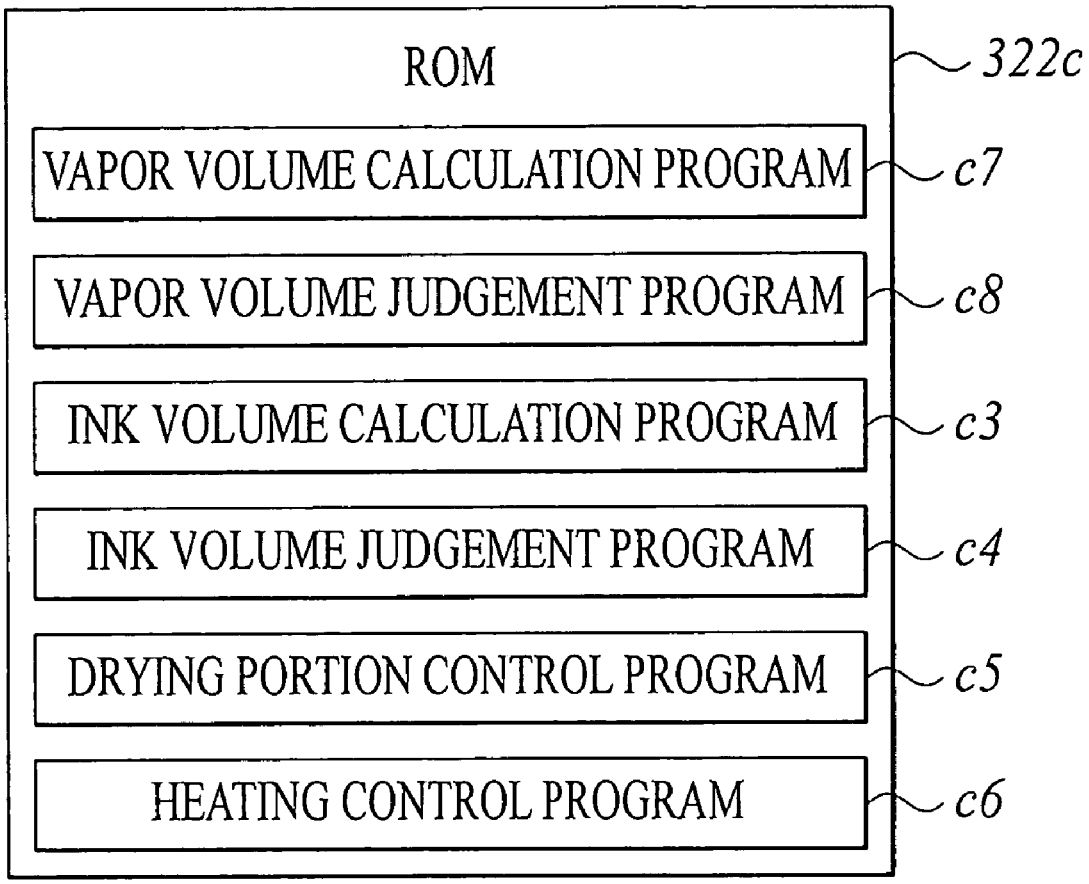

FIG. 15A is a block diagram showing a configuration of a main part of the control device 300 according to the modified example, and FIG. 15B is a view showing an internal structure of the ROM 322*c* provided in the control device 300 shown in FIG. 15A.

As shown in FIGS. 15A and 15B, CPU 322*a* owned by a control section 320 of the modified example reads, as the vapor volume calculating section, a vapor volume calculation program c7 out from a ROM 322*c*, and calculates the vapor volume, which is an amount of moisture per a predetermined unit volume of air within the case 1, based on the temperature sensed by the temperature sensor 12 and humidity sensed by the humidity sensor 13, according to the vapor volume calculation program c7. At the same time, the CPU 322*a* also reads, as a vapor volume judging section, the vapor volume judgment program c8 out from the ROM 322*c*, and judges whether the calculated vapor volume is not lower than a predetermined value (e.g., 12 ml/m$^3$) or not, according to the vapor volume judgment program c8.

A drying control section 3221 is configured so as to control at least either one of operations of the drying member 6, that is, air blowing by the fan 61 and heating by the heater 62, when the CPU 322*a* judged that the vapor volume was not lower than the predetermined value.

As described in the above, the drying control section 3221 can make the drying member 6 operate so as to appropriately dry the excessive solvent contained in the ink, when the vapor volume calculated based on the temperature and humidity inside the case were found to be not lower than the predetermined values.

Figure 16A:
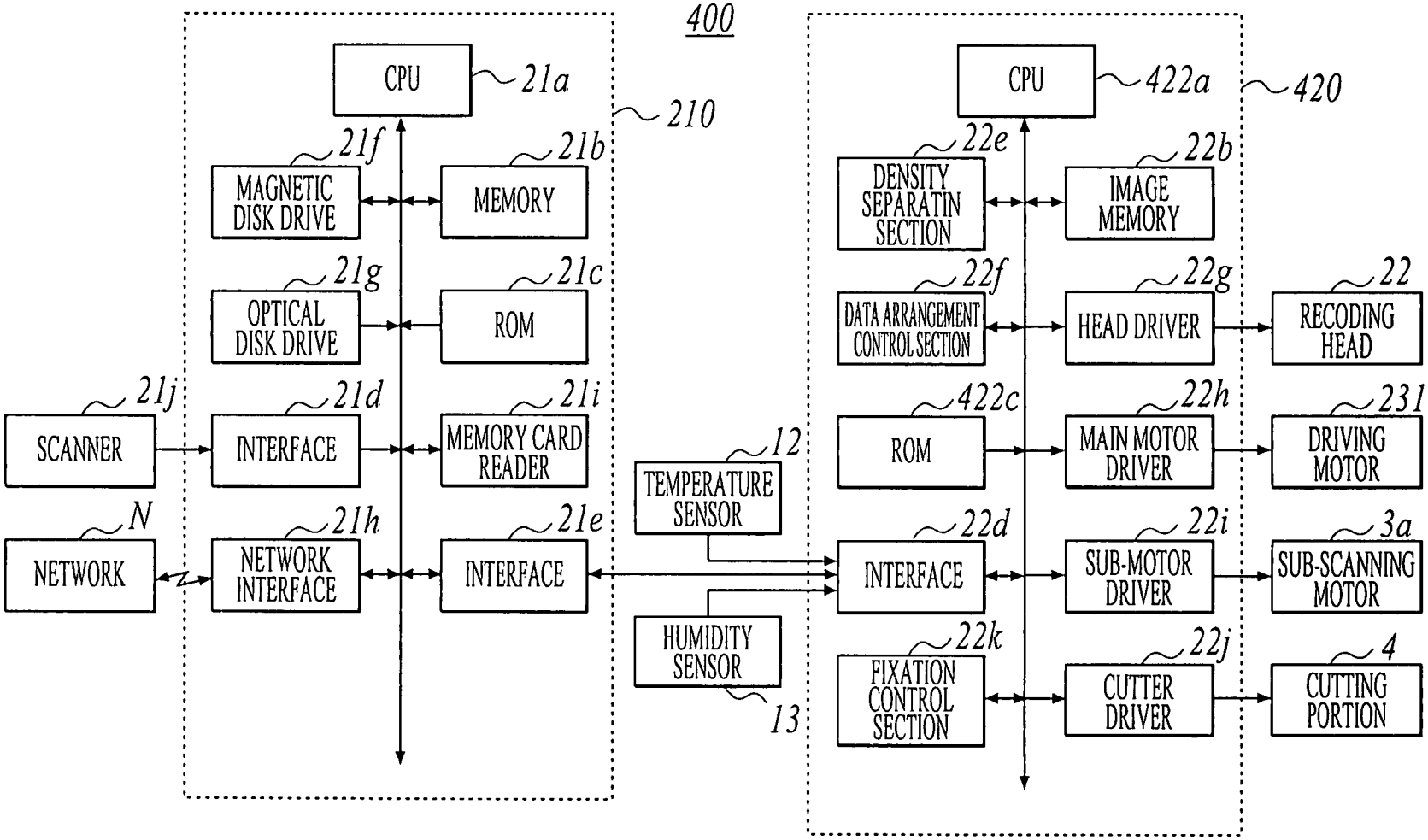
FIG. 16A is a block diagram showing a configuration of a main part of the control device owned by an ink jet printer exemplified as a second embodiment of the present invention and FIG. 16B is a view showing an internal structure of the ROM provided in the control device shown in FIG. 16A.
Figure 16B:
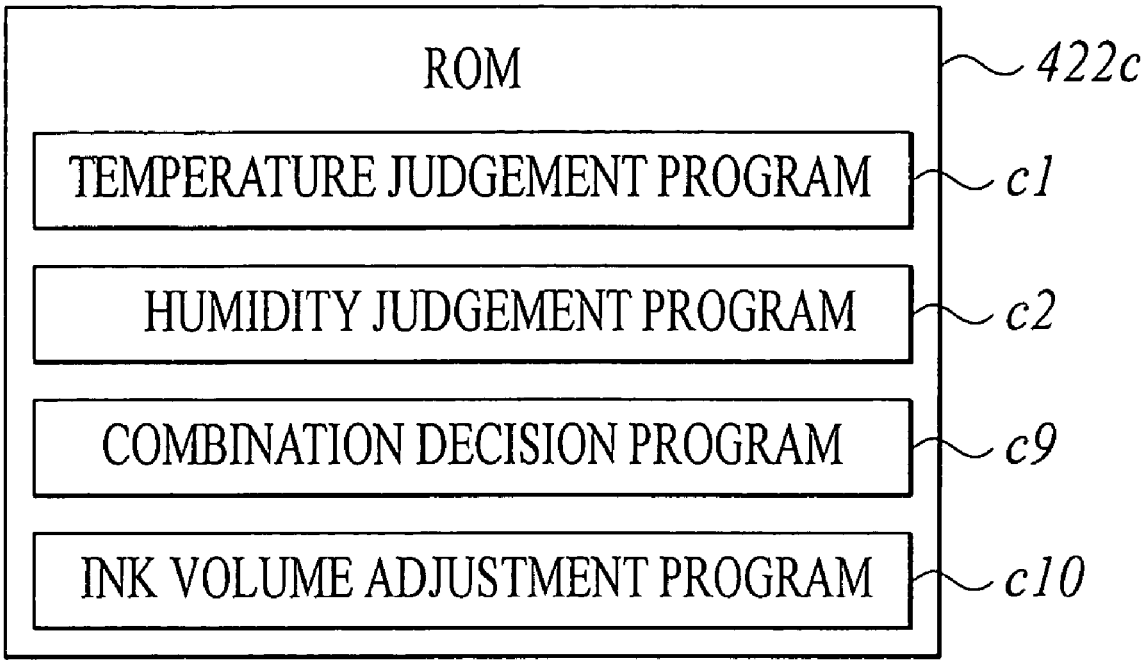

Second Embodiment:

The following paragraphs will describe an ink jet printer according to the second embodiment applied with the present invention, referring to FIGS. 16A and 16B.

It is to be noted that the second embodiment will have portions in common with the previous embodiment except for portions specific to the second embodiment, so that the common portions will be given with the same reference numerals as in the previous embodiment, and will not repeatedly be explained.

FIG. 16A is a block diagram showing a configuration of a main part of the control device 400 according to the second embodiment, and FIG. 16B is a view showing an internal structure of the ROM provided in the control device shown in FIG. 16A.

The ink jet printer of the second embodiment is configured as having no drying member and no drying control section, and as shown in FIG. 16A, in the combination deciding step during the image formation, a CPU 422*a* of a control section 420 reads, as a combination deciding section, a combination decision program c9 out from a ROM 422*c*, and determines combination of colors, ejection volume, etc. of a plurality of the inks ejected from the recording heads 22 during the image formation effected by the image forming section 2 based on the input image data, according to the combination decision program c9. The CPU 422*a* also reads, as an ink volume adjusting section, an ink volume adjustment program c10 out from the ROM 422*c*, and adjusts the volume of the ink ejected per a predetermined unit area of the recording medium P by changing the determined combination of the plurality of the inks, so that the ink volume does not reach and exceed the predetermined value, based on the temperature sensed by the temperature sensor 12 and humidity sensed by the humidity sensor 13, according to the ink volume adjustment program c10. More specifically, the CPU 422*a* adjusts the ink volume when it is judged according to the temperature judgment program c1 read out from the ROM 422*c* that the temperature sensed by the temperature sensor 12 is not lower than a predetermined value (e.g., 25° C.), and when it is judged according to the humidity judgment program c2 read out from the ROM 422*c* that the humidity senses by the humidity sensor 13 is not lower than a predetermined value (e.g., 50%).

The CPU 422*a* herein is configured so as to adjust the ink volume by changing the predetermined combination of a plurality of the inks through undercolor removal during the color image formation by the image forming section 2, or by changing ratio of content of, for example, dense inks out of all inks used for the image formation, such as yellow dense ink, magenta dense ink, cyan dense ink and black dense ink, so that they will have a larger ratio of content with respect to light inks such as yellow light ink, magenta light ink, cyan light ink and black light ink. This is successful in reducing the amount of the ink used in the image formation by the image forming section 2.

Undercolor removal herein refers to a technique of representing a color originally expressed by a blend of a plurality of color inks with a predetermined ink. In an exemplary case where four inks of yellow (Y), magenta (M), cyan (C) and black (K), a possible process of the undercolor removal is such as representing black color expressed by the YMC inks with the black (K) ink only. This successfully reduces the amount of use of the inks.

Therefore, according to the ink jet printer having the above configuration, the volume of the ink ejected per a predetermined unit area of the recording medium P can appropriately be adjusted by changing the combinations of the plurality of the inks used for the image formation, considering the temperature and humidity inside the case. That is, as is obvious from the above-described embodiment (see FIG. 13), a photographic gloss can be added to the surface of the recording medium P if the image is formed while reducing the ink volume used for the image formation, and then fixed on the recording medium P. This is successful in further raising the glossiness of the image.

Figure 17A:
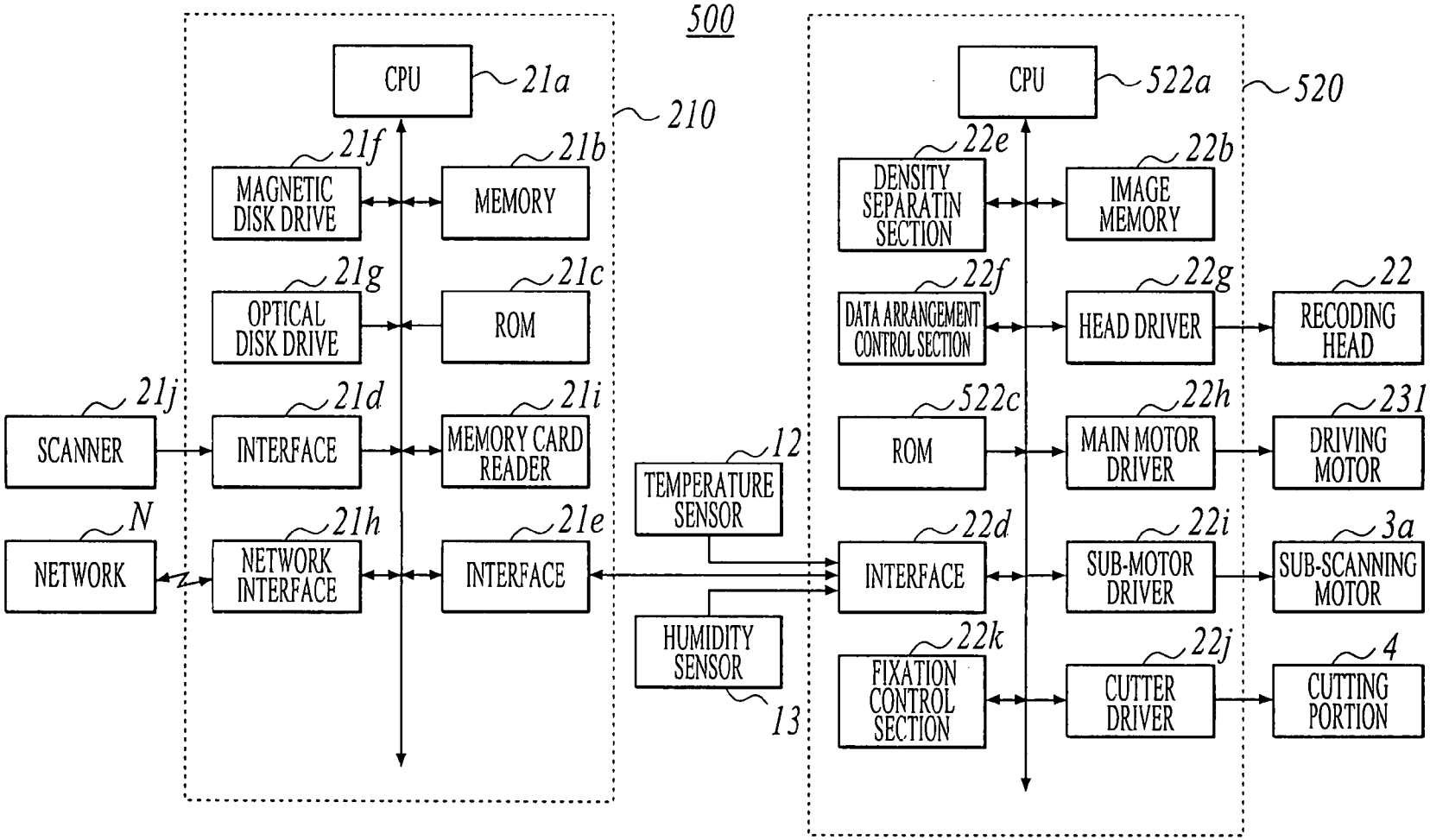
FIG. 17A is a block diagram showing a configuration of a main part of the control device owned by an ink jet printer exemplified as a third embodiment of the present invention and FIG. 17B is a view showing an internal structure of the ROM provided in the control device shown in FIG. 17A.
Figure 17B:
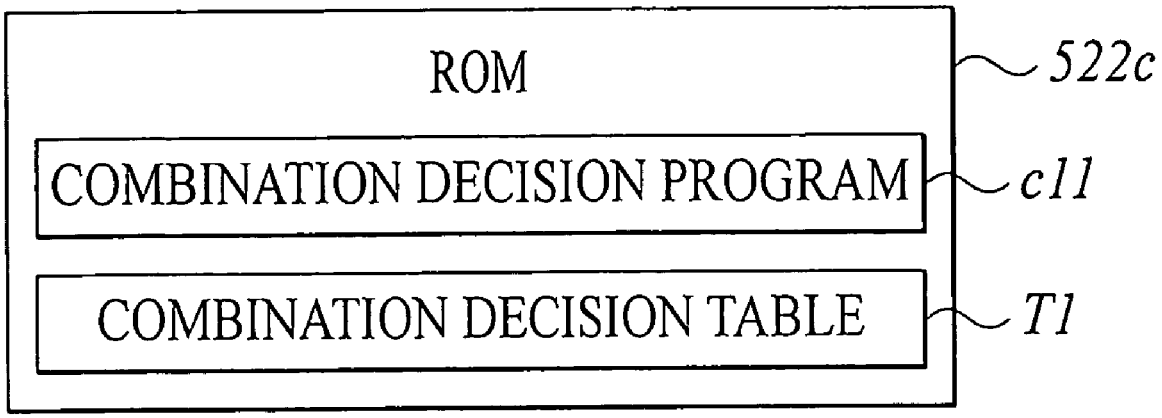

Third Embodiment:

The following paragraphs will describe an ink jet printer according to the third embodiment applied with the present invention, referring to FIGS. 17A and 17B.

It is to be noted that the third embodiment will have portions in common with the previous embodiment except for portions specific to the third embodiment, so that the common portions will be given with the same reference numerals as in the previous embodiment, and will not repeatedly be explained.

FIG. 17A is a block diagram showing a configuration of a main part of the control device 500 according to the second embodiment, and FIG. 17B is a view showing an internal structure of the ROM 522*c* provided in the control device 500 shown in FIG. 17A.

The ink jet printer of the third embodiment is configured as having no drying member and no drying control section like the second embodiment. As shown in FIGS. 17A and 17B, as a combination deciding section, a CPU 522*a* of the control section 520 reads out a combination decision program c11 out from a ROM 522*c* in the combination deciding step during the image formation carried out by the ink jet printer. The CPU 522*a* determines combination of colors, ejection volume, etc. of a plurality of the inks used during the image formation effected by the image forming section 2 based on the temperature detected by the temperature sensor 12 and the humidity detected by the humidity sensor 13, according to the combination decision program c11, so that the volume of the ink ejected per a predetermined unit area of the recording medium P does not reach and exceed the predetermined value during the image formation effected by the image forming section 2. That is, the CPU 522*a* determines the combination of the plurality of inks according to the combination decision table T1 (see FIG. 18A) stored in the ROM 522*c* under the condition that the ink volume in which a fixed image has a predetermined gloss value, does not exceed.

In this case, each value in the combination decision table T is related to the ratio (ratio of the removal of the undercolor) of the substitution of ink (K) for a common area of three colors of inks (Y, M, C) as shown in, for example, FIG. 18B. For example, as shown in FIG. 18C, each value in the combination decision table T is related to the color density at the beginning of using the dense ink. In this case, the color density is a value calculated by assuming that Dmax of each color is 100%. However, a value of brightness, which indicates brightness of each color, may be used as a color density.

In accordance with the combination decision table T1, the CPU 522*a* determines the combination of a plurality of inks for forming a color image with the image forming section 2 by removing the undercolor according to the temperature detected by the temperature sensor 12 and the humidity detected by the humidity sensor 13. Further, the CPU 522*a* determines the combination of a plurality of inks among the inks used for the image formation, by changing the color density at the beginning of using the dense ink so that the ratio of the predetermined dense ink to the predetermined light ink becomes large.

Therefore, according to the ink jet printer having the above configuration, the combination of a plurality of inks used for the image formation is determined in consideration of the temperature and the humidity in the ink jet printer so that the ink volume does not reach and exceed the predetermined value during the image formation. Thereby, it is possible to decrease the volume of the ink used for the image formation carried out by the image forming section 2. After the image is formed at the determined combination of a plurality of inks, it is possible to obtain the gloss on a surface of the recording medium P like a photograph by carrying out the fixing process of the image. This is successful in further raising the glossiness of the image.

The following paragraphs will detail the recording medium used in the foregoing embodiments.

The recording medium is configured as having the surficial portion containing a thermoplastic resin.

Preferable examples of the thermoplastic resin include polyacryl ester, polycarbonate, polyacrylonitrile, polystyrene, polybutadiene, polyacrylic acid, polymethacrylic acid, polyvinyl chloride, polyvinylidene chloride, polyvinyl acetate, polyester, polyamide, polyether, copolymers thereof and salts thereof, where polyacryl ester copolymer, styrene-acrylic ester copolymer, vinyl chloride-vinyl acetate copolymer, vinyl chloride-acrylic ester copolymer, ethylene-vinyl acetate copolymer, ethylene-acrylic ester copolymer, SBR latex are particularly preferable.

Glass transition point (Tg) may be exemplified as a criterion for selecting the thermoplastic resin.

The ink jet recording medium having the surficial layer containing the thermoplastic resin is preferably used in a style in which the thermoplastic resin is subjected to post-processing such as fusion, softening or film formation after the recording, for the purpose of adding gloss, and improving image storability and abrasion-proof property. Particularly preferable style of the post-processing involves a heating step, and Tg can be selected so as to ensure best attainment of the above-described purpose in the post-processing involving the heating step. It is also necessary to select Tg as being higher than a maximum temperature possibly reached during manufacture, transportation or storage of the recording medium, because it is necessary for the manufacturing process thereof to avoid reduction or disappearance of void formed by the thermoplastic fine particle, which allows infiltration of the ink. The temperature of the post-processing involving the heating step should be lower than the temperature causative of heat-induced deformation of the support so as to avoid such deformation. It is therefore preferable that Tg is set lower than the temperature causative of deformation of the support. Considering the above, a preferable range of Tg of the thermoplastic fine particle is 50 to 150° C., and more preferably 70 to 120° C. The minimum filming temperature (MFT) preferably falls within a range from 50 to 150° C.

With respect to the molecular weight and molecular weight distribution of the thermoplastic resin, the weight-average molecular weight preferably resides in a range from 50,000 to 2,000,000, and the ratio of weight-average molecular weight to number-average molecular weight resides in a range from 4 to 15 in view of ensuring an excellent mold releasing property in the post-processing, and a desirable abrasion resistance of the image afterimage formation. The molecular weight and molecular weight distribution of the thermoplastic resin can be measured by gel permeation chromatography (GPC) described later, where the value being expressed relative to polystyrene standards.

An excellent mold releasing property during the post-processing and a desirable abrasion resistance of the image after image formation can be attained also by the thermoplastic resin having a content of THF-insoluble component of 0.1 to 20% by weight, and a weight-average molecular weight of THF-soluble component of 50,000 to 2,000,000. It is to be noted that the THF-insoluble component described herein refers to that remains after dissolving 5 g of the thermoplastic resin into 100 ml of THF, and allowed to stand under stirring at 40° C. for 3 hours. The weight-average molecular weight of the THF-soluble component, after being separated from the insoluble component, is measured by gel permeation chromatography calibrated using polystyrene.

The thermoplastic resin is preferably used in a form of thermoplastic fine particle in view of the ink absorption property. The particle size preferably falls within a range from 0.05 to 10 μm, more preferably 0.1 to 5 μm, and still more preferably 0.1 to 1 μm. The particle size of the thermoplastic fine particle less than 0.05 μm may retard separation between the pigment particle in the pigment ink and ink solvent, and undesirably result in a lowered ink absorption speed. On the contrary, the particle size exceeding 10 μm is not undesirable in view of keeping a proper adhesion property with the solvent absorbing layer which is possibly brought into close contact with the ink accepting layer during coating on the support, or in view of film strength of the ink jet recording medium after coating and drying. It is preferable to suppress the content of 2-μm or larger fraction of the thermoplastic fine particle to as small as 5% in view of ink absorption speed and gloss expression.

The ionic property of the thermoplastic fine particle is preferably nonionic or cationic, where the former is more preferable. A particularly preferable thermoplastic fine particle is such as having polyvinyl alcohol as a protective colloid. It is also allowable to prepare the thermoplastic fine particle by adding a nonionic or cationic surfactant in order to control the emulsifying power during the polymerization. In this process, the degree of polymerization of polyvinyl alcohol is preferably adjusted to 300 to 1,500 in view of suppressing cracking failure of the recording medium during manufacturing, or enhancing the film strength of the image-formed film, where the range being more preferably from 500 to 1,500, and still more preferably from 800 to 1500. The degree of saponification of polyvinyl alcohol is preferably 90 mol % or below, and 20 mol % or above although the lower limit is not specifically limited.

The thermoplastic fine particle is preferably used in a water-dispersed form in view of environmental adaptability, and a water-base latex obtained by emulsion polymerization is particularly preferable.

The thermoplastic fine particle used herein preferably has only a small content of the residual monomer component in view of odor and safety, and the content with respect to the total solid weight of the polymer is preferably 3% or less, more preferably 1% or less, and still more preferably 0.1% or less.

The solid adhesion amount of the thermoplastic resin is determined in consideration of ink absorption property, gloss expression, image storability, film strength, productivity and so forth, and preferably falls within a range from 0.5 to 9 g/m$^2$ and more preferably from 2 to 5 g/m$^2$. For the case where the pigment ink is used as the recording ink, the amount of the thermoplastic resin in the surficial layer of the recording medium should be determined corresponding to the weight of the ejected pigment solid component in consideration of the gloss expression, ink absorption property, image quality or the like. The amount of the thermoplastic resin preferably falls within a range from 0.5 to 1.8 g/m$^2$, and more preferably from 0.7 to 1.6 g/m$^2$. Assuming now that a maximum amount of implanted pigment solid component as X g/m$^2$ and that the amount of the thermoplastic resin in the surficial layer of the recording medium as Y g/m$^2$, it is preferable that the following relation holds from the above-described viewpoints:

$$1 \leqq Y/X \leqq 16.$$

The surficial layer containing the thermoplastic resin also preferably contain a binder. Water-soluble binder can preferably be used in an amount of 1 to 10% of the thermoplastic resin, and available species thereof include polyvinyl alcohol, gelatin, polyethylene oxide, polyvinyl pyrrolidone, polyacrylic acid, polyacrylamide, polyurethane, dextran, dextrin, carrageenan (κ, ι, λ, etc.), agar, pullulan, water-soluble polyvinyl butyral, hydroxyethyl cellulose and carboxymethyl cellulose. It is also allowable to use these water-soluble resins in combination of two or more species thereof.

A typical water-soluble resin preferably used in the present invention is polyvinyl alcohol. Examples of polyvinyl alcohol preferably used in the present invention include not only ordinary polyvinyl alcohol obtained by hydrolysis of polyvinyl acetate, but also those modified at the terminal thereof with a cationic group, and anion-modified ones having an anionic group.

Polyvinyl alcohol obtained by hydrolysis of polyvinyl acetate preferably used herein has an average degree of polymerization of 1,000 or above, and more preferably 1,500 to 5,000. The degree of saponification preferably falls within a range from 70 to 100%, and more preferably 80 to 99.5%.

An exemplary cation-modified polyvinyl alcohol is a polyvinyl alcohol having a primary to tertiary amino group or a quaternary ammonium group in the principal chain or side chain thereof, typically disclosed in Japanese Laid-Open Patent Publication No. 61-10483, which is obtained by saponifying a copolymer of ethylenic unsaturated monomer having a cationic group and vinyl acetate.

Examples of ethylenic unsaturated monomer having a cationic group include trimethyl-(2-acrylamide-2,2-dimethylethyl)ammonium chloride, trimethyl-(3-acrylamide-3,3-dimethylpropyl)ammonium chloride, N-vinylimidazole, N-vinyl-2-methyl imidazole, N-(3-dimethylaminopropyl) methacrylamide, hydroxyethyl trimethylammonium chloride, trimethyl-(2-methacrylamidopropyl)ammonium chloride, and N-(1,1-dimethyl-3-dimethylaminopropyl) acrylamide.

Ratio of cationic modification group-containing monomer in the cation-modified polyvinyl alcohol is preferably 0.1 to 10 mol % with respect to vinyl acetate, and more preferably 0.2 to 5 mol %.

The anion-modified polyvinyl alcohol can be exemplified by polyvinyl alcohol having an anionic group described in Japanese Laid-Open Patent Publication 1-206088; copolymers of vinyl alcohol and vinyl compound having a water-soluble group such as disclosed in Japanese Laid-Open Patent Publication Nos. 61-237681 and 63-307979; and modified polyvinyl alcohol having a water-soluble group such as disclosed in Japanese Laid-Open Patent Publication No. 7-285265.

Examples of the nonion-modified polyvinyl alcohol include polyvinyl alcohol derivatives in which a part of the vinyl alcohol units are added with polyalkylene oxide group as disclosed in Japanese Laid-Open Patent Publication No. 7-9758; and block copolymer of a vinyl compound having a hydrophobic group and vinyl alcohols disclosed in Japanese Laid-Open Patent Publication No. 8-25795.

It is also allowable to combine two or more species of polyvinyl alcohol differing in the degree of polymerization of types of modification.

The surficial layer containing the thermoplastic resin preferably includes a film hardener for the binder. The film hardener can be added expecting that it reacts with and thereby crosslinks the water-soluble resin particles in the ink absorbing layer, or crosslinks the water-soluble resin and fine particle in the ink absorbing layer.

The film hardener can properly be selected and used depending on species of the water-soluble resin and fine particle.

Specific examples of the film hardener include epoxy-base film hardeners (diglycidyl ethyl ether, ethylene glycol diglycidyl ether, 1,4-butanediol diglycidyl ether, 1,6-diglycidyl cyclohexane, N,N-diglycidyl-4-glycidyl oxyaniline, sorbitol polyglycidyl ether, glycerol polyglycidyl ether, etc.); aldehyde-base film hardener (formaldehyde, glyoxal, etc); active halogen-base film hardener (2,4-dichloro-4-hydroxy-1,3,5-s-triazine, etc.); active vinyl-base compounds (1,3,5-tris(acryloyl)-hexahydro-s-triazine, bis(vinylsulfonyl)methyl ether, etc.); boric acid and its salts; borax and aluminum alum. For the case where polyvinyl alcohol and cation-modified polyvinyl alcohol are used as the particularly preferable water-soluble resins, it is preferable to use a film hardener selected from boric acid and the salts thereof, or epoxy-base film hardener. Most preferable one is a film hardener selected from boric acid and the salts thereof. Boric acid and salts thereof indicate oxygen acid having a boron atom as a center atom, and the salt thereof, and specific examples include orthoboric acid, diboric acid, metaboric acid, tetraboric acid, pentaboric acid, octaboric acid and their salts. The amount of use of the film hardener may vary depending, for example, on species of the water-soluble resin, species of the film hardener, species of the inorganic fine particle and its ratio with respect to the water-soluble resin, it generally falls within a range from 5 to 500 mg per 1 g of the water-soluble resin, and preferably from 10 to 300 mg. The film hardener may be added in a water-soluble coating liquid for forming the ink absorbing layer when the coating liquid is coated, or may preliminarily be coated on the support, in a form of a coating liquid containing the film hardener, before the water-soluble coating liquid for forming the ink absorbing layer is coated.

The surficial layer containing the thermoplastic resin preferably contain a cationic water-soluble polymer in view of improving the image quality. It is particularly preferable to contain a cationic water-soluble polymer having a quaternary ammonium base in its molecular structure, generally in an amount of 0.1 to 10 g, and more preferably 0.2 to 5 g, per 1 $m^2$ of the ink jet recording medium.

It is particularly preferable to add an inorganic fine particle to the surficial layer containing the thermoplastic resin, in expectations of:

1) raising the ink absorption speed, suppressing degradation of image quality such as beading and color bleeding, and obtaining a high-speed printing suitability;

2) obtaining a highly glossy image;

3) avoiding failures such as peeling or swelling of the film in the post-treatment process involving heating process;

4) enhancing strength of the image surface (less likely to get scratches during conveyance within the printer, and high in the surface strength of the finally-obtained image);

5) making it less likely to cause fusion during storage of the image in a stacked form;

6) obtaining an excellent productivity of the recording medium based on coating, and allowing simultaneous coating of all layers including the top layer in particular for the case of multi-layered configuration; and 7) ensuring pencil writability.

The inorganic fine particle to be mixed herein may be white inorganic pigments such as precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatom earth, calcium silicate, magnesium silicate, synthetic amorphous silica, colloidal silica, alumina, colloidal alumina, pseudo-Boehmite, aluminum hydroxide, lithopone, zeolite and magnesium hydroxide.

The average particle size of the inorganic fine particle can be determined by observing, under an electron microscope, the particles per ce, or those appeared on the section or the surface of the surficial layer, and by calculating a simple average value (number average) of diameter of arbitrary 1,000 particles. It is to be noted that the particle size of each particle is expressed as a diameter of a hypothetical circle having an area equal to the projected area of the particle.

The inorganic fine particle is preferably a solid fine particle selected from silica, alumina and alumina hydrate, and among others, silica is more preferable.

Examples of silica preferably used include those synthesized by the general wet process, colloidal silica, and those synthesized by the vapor phase process. Among others, colloidal silica and silica synthesized by the vapor phase process are preferably used, and in particular, fine particle silica synthesized by the vapor phase process is advantageous in obtaining a large void ratio. Alumina and alumina hydrate may be either of crystal and amorphous, and available in an arbitrary form of irregular-formed particle, spherical particle or needle.

The inorganic fine particle preferably has a particle size of 100 nm or smaller. More specifically for the case of the fine particle silica obtained by the vapor phase process, the inorganic fine particle dispersed in a form of primary particle (particle size measured in a form of a dispersion liquid before coating) preferably has an average size of 100 nm, more preferably 4 to 50 nm, and most preferably 4 to 20 nm.

This sort of silica having an average particle size of the primary particle of 4 to 20 nm, and synthesized by the vapor phase process, can be commercially available under the trade name of Aerosil, manufactured by Nippon Aerosil Co., Ltd. This vapor-phase fine particle silica can readily be dispersed in water to the primary particle by suction dispersion using, for example, a jet stream inductor mixer manufactured by Mitamura Riken Kogyo Co., Ltd.

The ratio of mass, on the solid basis, of the thermoplastic resin and inorganic fine particle in the surficial layer can appropriately be selected from the aforementioned viewpoints 1) to 7). The ratio preferably resides within a range from 2/8 to 8/2, more preferably from 3/7 to 7/3, and still more preferably from 4/6 to 6/4.

It is also preferable that the ratio of the inorganic fine particle with respect to the total solid content is adjusted to 30% to 70% particularly in view of ink absorption property.

For the case where the inorganic fine particle is mixed in addition to the thermoplastic fine particle, it is important from the aforementioned viewpoints 1) to 7) to control electric charge of both particles, where a combination of cationic or nonionic thermoplastic resin particle and cationic inorganic pigment fine particle is preferable. The cationic inorganic pigment particle is preferably a silica having a positively-charged surface, which is obtained by dispersing an alumina hydrate having a positively-charged surface together with a cationic polymer.

The particle size of the thermoplastic fine particle is preferably larger than the resultant pore size, particularly in view of ink absorption property. The average pore size of this composite porous material can be measure using a mercury porosimeter (Porelyzer Model 9220, product of Shimadzu Corporation) at an initial pressure of 10.34 kPa.

It is also preferable that a peak attributable to the thermoplastic resin particle and a peak attributable to the inorganic fine particle can separately be found in the number-base particle size distribution obtained by a microscopic observation of the surface of the recording medium, and that both peaks are distant from each other by 40 nm or more on the basis of summit particle size, from the viewpoint of image quality and gloss expression. Overlapping of both peaks herein is preferably suppressed to as small as 5% from the aforementioned viewpoints, and more preferably 0%.

The surface roughness of the recording medium is preferably adjusted to as small as 20 to 200 nm in terms of Ra, and 1 μm or below in terms of Rz, in view of gloss expression.

It is also allowable to add a matting agent, which is used in printing of silver salt photograph, for the purpose of controlling the surface property and improving the friction resistance. The matting agent preferably has a particle size of 5 to 50 μm, and more preferably 5 to 30 μm.

The matting agent can express its maximum effect when the particle size thereof is selected as 5 to 100 times as large as the particle size of the thermoplastic resin particle. The amount of addition thereof is preferably adjusted within a range from ⅕ to 1/100 of the thermoplastic resin, in view of attaining the above-described object and gloss expression at the same time. The matting agent can be selected from those not deformable at the heating temperature in the post-processing involving heating, in consideration of purpose of its use. Through addition of the matting agent, it is particularly preferable to adjust the coefficient of dynamic friction on the back surface of the recording medium within a range from 0.2 to 0.4.

The ink jet recording medium having the thermoplastic-resin-containing surficial layer preferably has a support. Examples of the available support include those which has conventionally been used for the ink jet recording medium, which include paper supports such as plain paper, art paper, coated paper and cast-coated paper; plastic supports; paper support coated with polyolefin films on both surfaces; and composite supports obtained by bonding these supports. Non-water-permeable supports can preferably be used in view of fully exhibit the effects of the present invention.

The non-water-permeable supports available in the present invention include resin film support, or paper support coated on the both surfaces thereof with resin films. Examples of the resin film support include polyester film, polyvinyl chloride film, polypropylene film, cellulose triacetate film, polystyrene film, and any film support obtained by stacking these films. The plastic film may also be transparent or semi-transparent.

Particularly preferable support for use in the present invention is the paper support having on both surfaces of which covered with resin films, and most preferable one is a paper support having on both surfaces of which covered with polyolefin resin.

The next paragraphs will describe the paper support having both surfaces thereof covered with polyolefin resin, which is a particularly preferable support for use in the present invention.

The paper used for the support in the present invention is mainly composed of wood pulp, and is made while being added, if necessary, with a synthetic pulp such as polypropylene, or with a synthetic fiber composed of nylon, polyester or the like. The wood pulp may be any of LBKP, LBSP, NBKP, NBSP, LDP, NDP, LUKP and NUKP, where it is preferable to use those having a large content of short fiber, examples of which include LBKP, NBSP, LBSP, NDP and LDP. It is to be noted that ratio of LBSP and/or LDP preferably falls within a range from 10 to 70%. It is preferable to use chemical pulp (sulfate pulp and sulfite pulp) having a only a small content of impurities. The pulp having an enhanced whiteness through bleaching is also useful.

The paper may appropriately be added with, for example, sizing agent such as higher fatty acid and alkylketene dimer;

white pigments such as calcium carbonate, talc, titanium oxide; paper strengthening agents such as starch, polyacrylamide, polyvinyl alcohol; fluorescent brightener; moisturizer such as polyethylene glycols; dispersant; and softening agent such as quaternary ammonium.

The freeness of the pulp used for the paper making is preferably adjusted within a range from 200 to 500 ml CSF. The fiber length expressed by the total amount of residues retained on a #24-mesh screen and #42-mesh screen, as being specified by JIS P 8207, preferably accounts for 30 to 70%. It is preferable that the amount of residue retained on a #4-mesh screen preferably accounts for only as low as 20% or below.

The basis weight of the paper is preferably within a range from 50 to 250 g, and more preferably from 70 to 200 g. The thickness of the paper preferably falls within a range from 50 to 210 μm.

The paper may highly be smoothened by calendering during or after paper-making process. The density of the paper generally falls within a range from 0.7 to 1.2 g/cm$^3$ (JIS P 8118). The rigidity of the base paper preferably falls within a range from 20 to 200 g according to conditions specified in JIS P 8143.

The paper may be coated with a surface sizing agent on the surface thereof. The surface sizing agent available herein may be similar to those used for the internal addition to the base paper.

The paper preferably has a pH value of 5 to 9, when measured by the hydrothermal extraction method as specified in JIS P 8113.

Next, the polyolefin resins covering the both surfaces of the paper will be explained.

The polyolefin resins available for this purpose include polyethylene, polypropylene and polyisobutylene. Among others, polyolefins such as copolymers mainly composed of propylene are preferable, and polyethylene is particularly preferable.

Particularly preferable polyethylene will be detailed below.

Polyethylene covering the top surface and back surface of the paper is mainly composed of low-density polyethylene (LDPE) and/or high-density polyethylene (HDPE), and it is also allowable to partially use other LLDPE, polypropylene and so forth.

In particular, the polyolefin layer on the coating-layer side is preferably be added with rutile- or anataze-type titanium oxide so as to raise the opacity and whiteness. The amount of addition of titanium oxide is adjusted to 1 to 20% or around with respect to polyolefin, and more preferably 2 to 15%.

The polyolefin layer may also be added with highly-heat-resistant colorant pigment or fluorescent brightener for the purpose of adjusting the whiteness.

Examples of the colorant pigment include ultramarine blue, prussian blue, cobalt blue, phthalocyanine blue, manganese blue, cerulean, tungsten blue, molybdenum blue and anthraquinone blue. Examples of the fluorescent brightener may be similar to those available for the above-described ink absorbing layer.

The amount of use of polyethylene on the top and back surfaces of the paper is selected so as to optimize the thickness of the ink absorbing layer and the curling under low- and high-humidity environments after the back-coat layer is formed, and is generally selected so as to adjust the thickness of the polyethylene layer to 15 to 50 μm on the ink-absorption-layer side, and 10 to 40 μm on the back-coat-layer side. Ratio of amount of use of polyethylene on the top and back surfaces is preferably set so as to adjust the curling which is variable depending on types and thickness of the ink absorbing layer, and the thickness of the middle paper, and the ratio of the thickness of the polyethylene layers expressed in top/back generally falls within a range from 3/1 to 1/3 or around.

It is further preferable for the support covered with polyethylene to have features (1) to (8) below:

(1) the tensile strength preferably falls within a range from 19.6 to 294 N in the longitudinal direction and 9.8 to 196 N in the transverse direction as specified in JIS P 8113;

(2) the tear strength preferably falls within a range from 0.20 to 2.94 N in the longitudinal direction and 0.098 to 2.45 N in the transverse direction as specified in JIS P 8116;

(3) the compressive elastic modulus is preferably 9.8 kN/cm$^2$;

(4) the opacity is preferably 80% or above, and more preferably 85 to 98% when measured by the method specified in JIS P 8138;

(5) the whiteness is preferably expressed by the values of $L^*=80$ to 96, $a^*=-3$ to +5 and $b^*=-7$ to +2 according to JIS Z 8727;

(6) Clark stiffness preferably falls within a range from 50 to 300 cm$^3$/100 when assessed in the conveying direction of the recording medium;

(7) the moisture content in the base paper is preferably 4 to 10% of that in the middle paper; and (8) the glossiness (75° specular gloss) of the surface on which the ink-absorbing layer is to be formed preferably falls within a range from 10 to 90%.

The texture of the printed surface may be chosen by preference, and it is allowable to obtain a so-called, semi-gloss print if a finely-roughened support is used. In this case, the support available in a particularly preferable manner is such as having a centerline average roughness (Ra) of 1.0 to 5.0 μm when measured at a measurement length of 2.5 mm and a cut-off value of 0.8 mm as being specified in JIS-B-0601, on the surface thereof on which the ink-absorbing layer is to be formed.

It is also allowable to use a water-absorbing support in order to reduce load exerted on the entire ink-absorbing layer on the support inclusive of the surficial layer thereof, or in order to moderate restrictions on temperature during the post-processing involving heating. The water-absorbing support is typified by a porous base. The porous base herein is preferably an ink-absorbing support, available examples of which include paper base mainly composed of wood pulp and loading filler, coated paper and art paper. Among others, the paper base mainly composed of wood pulp and loading filler is particularly preferable.

The paper base preferably used in the present invention will be explained.

The paper bases available herein are such as those mainly composed of wood pulp, and specific examples of which include chemical pulps such as LBKP and NBKP; mechanical pulps such as GP, CGP, RMP, TMP, CTMP, CMP and PGW; and waste paper pulps such as DIP. It is also allowable to appropriately select and use other various fibrous materials such as synthetic pulp, synthetic fiber and inorganic fiber, if necessary.

The paper base may be added with various publicly-known additives such as sizing agent, pigment, paper strengthening agent, fixing agent, fluorescent brightener, wet strengthening agent and cationizing agent. The sizing agent may be exemplified by higher fatty acid and alkylketene dimer; the pigment by calcium carbonate, talc and titanium oxide; the paper strengthening agents by starch, polyacrylamide and polyvinyl alcohol; and the fixing agent by aluminum sulfate and cationic polymer electrolyte, while being not limited to these materials.

The paper base used in the present invention can be manufactured by mixing the aforementioned fibrous material such as the wood pulp with the various additives, and by using a variety of paper-making machines such as Fourdrinier paper machine, cylinder paper machine and twin-wire paper machine. It is also allowable to subject the paper base to size-pressing using starch, polyvinyl alcohol or the like during or after the paper making, various coatings, or calendering if necessary.

The thickness of the water-absorbing support used in the present invention is preferably 200 μm or larger in view of successfully obtaining photographic texture in the photo-printing, more preferably 200 to 300 μm, and still more preferably 200 to 250 μm. The thickness is preferably 300 μm or less also in view of handelability.

The support may be available in either viewing systems using transmitted light and reflected light. A transparent support can preferably be used in order to provide the ink jet recording medium excellent in transparency, glossiness, light-proof property and blurring resistance during storage suitable for the transmissive viewing, and in order to provide the ink jet recording medium excellent in sharpness, ink absorption property and film strength suitable for the reflective viewing. The transparent support available herein is such as showing no or only a small ink absorption, and having a transmissivity of light of 60% or more, and preferably 80% or more. The transmissivity of light of less than 60% will reduce readability of the printed matter based on the transmissive viewing, and makes it unsuitable for OHP sheet or the like.

The transparent support may be composed of various plastic resin film supports, and examples of which include polyester film, polyvinyl chloride film, polypropylene film, cellulose triacetate film, polystyrene film or any film supports obtained by stacking these films. Polyester film is a preferable transparent support as the plastic resin film, where particularly preferable polyester is such as having, as a major component thereof, polyethylene terephthalate obtained by using terephthalic acid as an aromatic dicarboxylic acid component and ethylene glycol as a glycol component. Examples of the aromatic dicarboxlic acid, besides terephthalic acid, available in the preparation of the polyester resin film include isophthalic acid, 2,6-naphthalene dicarboxylic acid, and their lower alkyl esters (derivatives capable of forming esters such as anhydride and lower alkyl esters). Examples of the glycol include ethylene glycol, propylene glycol, butanediol, neopentyl glycol, 1,4-cyclohexane dimethanol, diethylene glycol and p-xylylene glycol. It is particularly preferable to use, as a major component, polyethylene terephthalate obtained by reacting terephthalic acid and ethylene glycol.

"To have polyethylene terephthalate as a major component" herein section that repetitive unit of polyethylene terephthalate is contained in an amount of 80 mol % or more in copolymer, or that polyethylene terephthalate is contained in an mount of 80% by mass or more in polymer blend.

The ink jet recording medium having the surficial layer which contain the thermoplastic resin preferably has an ink-absorbing layer between the surficial layer and the support.

The ink-absorbing layer is roughly classified into those of swelling-type and void-type.

The swelling-type, ink-absorbing layer can be configured by coating a hydrophilic binder such as gelatin, polyvinyl alcohol, polyvinyl pyrrolidone and polyethylene oxide, all of which can be used in a singular manner or in arbitrary combinations.

The void-type, ink-absorbing layer can be configured by coating mixture of a fine particle and a hydrophilic binder, where a glossy layer is particularly preferable. The fine particle is preferably alumina or silica, and more preferably silica having a particle size of 0.1 μm or smaller. Examples of the hydrophilic binder include gelatin, polyvinyl alcohol, polyvinyl pyrrolidone and polyethylene oxide, all of which can be used in a singular manner or in arbitrary combinations.

The ink-absorbing layer having a higher speed of ink absorption is more advantageous in view of ensuring a suitability for continuous or high-speed printing, and therefore the void-type can more preferably be used.

The following paragraphs will further detail the void-type, ink-absorbing layer (also referred to as "void layer", hereinafter).

The void layer is formed based on soft agglomeration mainly of a hydrophilic binder and an inorganic fine particle. There are various known methods of forming the void in the film, and examples thereof include a method of coating a homogeneous coating liquid containing two or more species of polymers onto a support, and allowing these polymers to cause phase separation in a drying process to thereby form the void; a method of coating a coating liquid containing a solid fine particle and a hydrophilic or hydrophobic binder onto a support, drying the resultant ink jet recording medium, and then dipping the medium into water or into a liquid containing an appropriate organic solvent so as to dissolve the solid fine particle, to thereby form the void; a method of coating a coating liquid containing a compound capable of foaming during the film formation onto a support, and allowing the compound to foam during a drying process to thereby form the void; a method of coating a coating liquid containing porous solid fine particles and a hydrophilic binder onto a support, to thereby form the void within the porous fine particle or between the particles; and a method of coating a coating liquid containing a hydrophilic binder and an almost equivalent or larger volume of solid fine particles or fine oil droplet onto a support, to thereby form the void between the solid fine particles. In the present invention, it is particularly preferable that the void is formed in the void layer by adding thereto various inorganic fine particles having an average particle size of 100 nm or smaller.

The inorganic fine particle used for the above-described purpose may be similar to those used for the aforementioned surficial layer.

The hydrophilic binder available herein may be similar to the water-soluble binder used for the aforementioned surficial layer.

The amount of addition of the inorganic fine powder used for the ink-absorbing layer may largely vary depending on necessary capacity of the ink absorption, void ratio of the void layer, species of the inorganic fine particle and species of the waver-soluble resin, but can generally be adjusted to 5 to 30 g, and more preferably to 10 to 25 g per 1 $m^2$ of the ink jet recording medium.

The ratio of the inorganic fine powder and the water-soluble resin used for the ink-absorbing layer is generally adjusted to 2:1 to 20:1 on the mass basis, and preferably to 3:1 to 10:1.

The ink-absorbing layer may contain a cationic water-soluble polymer having a quaternary ammonium base within the molecular structure, where the polymer is used generally in an amount of 0.1 to 10 g, and preferably 0.2 to 5 g, per 1 $m^2$ of the ink jet recording medium.

In the void layer, total volume of the void (void volume) is preferably 20 ml or more per 1 $m^2$ of the ink jet recording medium. The void volume of less than 20 ml/$m^2$ can ensure a desirable ink-absorbing property only when the printing is made using a small volume of ink, but is likely to cause problems of degraded image quality or retarded drying when a large volume of ink is used for the printing, because the ink cannot thoroughly be absorbed.

The ink-absorbing layer can be formed not only by using the inorganic fine particle, but also by using a coating liquid containing a polyurethane resin emulsion in combination with a water-soluble epoxy compound and/or acetoacetylated polyvinyl alcohol, and further in combination with an epichlorohydrin polyamide resin. The polyurethane resin emulsion used herein preferably contains polyurethane particle having polycarbonate chain, or having polycarbonate chain together with polyester chain, and having a particle size of 3.0 μm. It is further preferable that the polyurethane contained therein is obtained by reacting an aliphatic isocyanate compound with polycarbonate polyol, or with a polyol compound having both of polycarbonate polyol and polyester polyol, has sulfuric acid group in the molecule, and has epichlorohydrin polyamide resin and water-soluble epoxy compound and/or acetoacetylated vinyl alcohol.

It is supposed that the ink-absorbing layer using the above-described polyurethane resin can form a weak agglomeration between cation and anion, and at the same time, can produce the void capable of absorbing the solvent in the ink, so as to allow it to contribute to the image formation.

In the present invention, an average void ratio of the entire ink-absorbing layer of the ink jet recording medium preferably falls within a range from 40 to 70%, or the void ratio of the aforementioned surficial layer preferably falls within a range from 30 to 70%.

It is to be noted that the void ratio is defined as a void capacity with respect to the solid component capacity in the entire portion of the ink-absorbing layer having an ink-absorbing ability, or in the surficial layer. One possible method of calculating the void ratio uses the equation below:

void ratio=100×[(total dry film thickness−thickness of coated solid component)/(total dry film thickness)]

The void ratio of the entire portion of the ink-absorbing layer or the surficial layer can readily be measured also by a method, in which the entire portion of the ink-absorbing layer or only the surficial portion thereof is formed by coating on a polyethylene terephthalate film of 100 μm thick, and the amount saturation transfer and water sorption are measurement by Bristow's method.

Proper adjustment and raising of the opacity of the ink-absorbing layer, particularly in the portion thereof adjacent to the surficial layer containing the thermoplastic resin, is a preferable embodiment in view of improving the image density, in particular the maximum density, and the sharpness. A more specific configuration relates to an ink jet recording material having at least three or more ink-absorbing layer on one surface of an opaque support, where the uppermost ink-absorbing layer contains the thermoplastic fine particle, and the ink-absorbing layer adjacent to the uppermost ink-absorbing layer has an opacity larger than that of the ink-absorbing layer closest to the support.

The ink jet recording medium having the surficial layer containing the thermoplastic resin can be manufactured so that the individual component layers are individually or simultaneously formed by coating on the support and the successive drying, where the coating method can appropriately be selected from publicly-known ones. The known coating methods include roll coating method, rod bar coating method, air knife coating method, spray coating method, curtain coating method, slide bead coating method using a hopper disclosed in U.S. Pat. No. 2,761,419 or No. 2,761,791, and extrusion coating method.

The viscosity of the individual coating liquids used in simultaneous multi-layered coating is preferably adjusted within a range from 5 to 100 mPa·s, and more preferably from 10 to 50 mPa·s, for the case where the slide bead coating method is adopted. The curtain coating method prefers a range from 5 to 1200 mPa·s, and further prefers a range from 25 to 500 mPa·s.

The coating liquid preferably has a viscosity at 15° C. of 100 mPa·s or larger, more preferably 100 to 30,000 mPa·s, and most preferably 10,000 to 30,000 mPa·s.

In the coating and drying, it is desirable that the coating liquid is warmed to as high as 30° C. or above, the simultaneous multi-layered coating is carried out, the resultant coated film is once cooled to as low as 1 to 15° C., and then dried at 10° C. or above. For the purpose of avoiding filming of the thermoplastic resin contained in the outer layer during the preparation of the coating liquid, coating or drying, it is preferable to carry out the preparation of the coating liquid, coating and drying at a temperature lower than Tg of the thermoplastic resin. More preferably, the drying is carried out at a wet-bulb temperature within a range from 5 to 50° C., and film surface temperature within a range from 10 to 50° C. The cooling system adopted after the coating is preferably a horizontal setting system in view of ensuring a desirable uniformity of the resultant coated film.

In the present invention, it is preferable to add a process of supplying a hardener for the water-soluble binder after the ink-absorbing layer was formed in the fabrication process of the recording medium. The method of feeding the hardener is not specifically limited, and possible methods include such as coating a hardener-containing solution after the ink-absorbing layer was formed; and such as spraying a hardener-containing solution onto the surface of the recording medium having the ink-absorbing layer already formed thereon. The methods may properly be selected.

In the present invention, it is preferable to store the recording medium during the fabrication process thereof within a temperature range from 35° C. to 70° C., for a period ranging from 24 hours to 60 days. The humidity under which the recording medium is stored at 35° C. to 70° C. for 24 hours to 60 days is not specifically limited, but is preferably adjusted to 80% RH or lower at the respective temperatures, and more preferably to 50% RH or lower.

The annealing can preferably be carried out at 35° C. to 70° C. for 24 hours to 60 days, and more preferably at 36° C. for 3 days to 4 weeks, at 40° C. for 2 days to 2 weeks, and at 55° C. for 1 to 7 days. The annealing is successful in promoting curing reaction or crystallization of the water-soluble binder, and consequently in attaining a desirable ink absorption property. It is necessary to determine the annealing temperature considering Tg of the thermoplastic resin to be employed, so as not to undesirably reduce the void in the recording medium or not to lower the ink absorption speed, as has been described in the above in connection with Tg of the thermoplastic resin.

It is particularly preferable to combine the process for supplying the hardening agent for the water-soluble binder and the process for storing the recording medium at 35° C. to 70° C. for 24 hours to 60 days, in view of obtaining a large ink absorption speed in a constant manner.

The ink jet recording medium having the surficial layer which contains the thermoplastic resin is preferably adjusted so as to have the following features.

It is at least essential that the amount of water absorption should exceed the maximum ink volume of the printer to be adopted, so that the least necessary value is 15 ml/m$^2$, and more preferably 20 ml/m$^2$ or more. The value is still more preferably 22 ml/m$^2$ or more, and particularly preferably 26 ml/m$^2$ or more, in view of constantly ensuring a high image quality even under fluctuated environmental conditions or high-speed printing. The upper limit is not specifically limited, but is preferably set to less than not 40 ml/m$^2$ considering the production cost and film strength. The amount of water absorption can be determined as follows. The recording medium of a given area is allowed to stand in an atmosphere conditioned at 25° C., 50% RH for 24 hours or longer so as to stabilize the moisture content, and the recording medium is then dipped in pure water for 10 seconds. Since the air which has previously been retained in the recording medium comes up as bubbles on the surface with the progress of water absorption, and tends to inhibit the water absorption thereafter, the recording medium is properly vibrated so as to remove the bubbles. Ten seconds after, the recording medium is pulled up from the water, the water on the surface is immediately removed with a water-absorbing material such as filter paper. The amount of water absorption can be determined based on difference between the mass before and after the dipping.

The ink absorption speed is an essential factor in view of adoptability to the high-speed printing and stable printing of high quality image. There are various known methods for evaluating the ink absorption speed, and one preferable method is J.TAPPI Paper and Pulp Test Standards No. 51-87, "Liquid Sorption Test Method for Paper and Board (Bristow's Method)", which yields measurement values showing a good coincidence with various performance evaluations. Besides a coefficient of absorption, which is an effective parameter obtained from evaluation by Bristow's method, it is also effective to use the volume of ink transfer measured under a short-term contact. The volume of transfer under a 20-msec contact is preferably 5 ml/m$^2$ or above, and more preferably 8 ml/m$^2$ or above. The volume of transfer under a 40-msec contact is preferably 10 ml/m$^2$ or above, and more preferably 12 ml/m$^2$ or above. The volume of transfer under a 80-msec contact is preferably 14 ml/m$^2$ or above, and more preferably 16 ml/m$^2$ or above. The volume of transfer under a 200-msec contact is preferably 80% or more of the aforementioned amount of water absorption.

The measurement according to Bristow's method is successful in terms of a good coincidence with the various performances when the ink for ink-jet printer is used, and in particular when a water-base magenta dye ink is used pH of the recording medium is an essential factor in relation to the image quality and color reproducibility, and should be determined considering pH of the ink to be adopted and properties of the colorant materials. This is particularly important when a pigment ink is used, and the value should be determined considering bronzing, gloss, color reproducibility and image density. It is particularly preferable that pH of the surface of the recording medium falls within a range from 5.0 to 7.0, and pH of the ink falls within a range from 7.0 to 9.0. A more preferable pH range of the surface of the recording medium is 5.0 to 6.0

For the case where the pigment ink is used, it is necessary to control the dot diameter and shape in view of improving the image quality, and particularly in view of raising uniformity of solid image. It is therefore preferable to adjust the angle of contact of the pigment ink, having a surface tension of 30 to 45 mN/m, within a range from 30 to 50° on the surface of the recording medium. There are various known methods of adjusting the angle of contact within the above-described range, and possible methods are such as adding a silicon-base compound to the recording medium, or appropriately selecting the species of the active agents, amount of addition thereof, species of the thermoplastic resin to be adopted, and so forth.

The cracking limit diameter is preferably adjusted within a range from 10 to 45 mm so as to ensure a sufficient bending resistance during conveyance using a high-speed printer.

The cracking limit diameter can be determined as follows. The ink jet recording medium is allowed to stand at 23° C., 20% RH for 24 hours to stabilize the moisture content, and wrapped around aluminum-made cylindrical rollers having diameters of 5, 10, 15, 20, 25, 30, 35, 40, 45 and 50 mm, respectively. The diameter of the roller at which the crack appears in the surficial layer for the first time is defined as the cracking limit diameter. The value is assessed as 0 mm when no fracture is observed.

The chromaticity of the white base of the recording medium is preferably expressed by a brightness index L* of 80 or above in the CIE color space, and more preferably 90 or above, by an index a* ranging from −2 to +2, and by an index b* ranging from −10 to +2. The index b* is more preferably adjusted within a range from −10 to −1 in view of obtaining a high-definition image, and this is a particularly desirable embodiment for the case where the thermoplastic resin and inorganic fine particle are used in a mixed manner in the surficial portion of the recording medium.

It is not desirable for the recording medium, containing the thermoplastic resin, to emit odor ascribable to the thermoplastic resin per se, monomer, or other additives often used for the polymerization. In particular, the volatile monomer component emitted from the recording medium to the atmosphere of use is preferably suppressed to as low as 0.5 ppm or below.

It is also preferable to adjust Young's modulus of the recording medium within a specific range so as to effectively develop the gloss for the case where the heating process and pressurizing process take place at the same time during the post-treatment. Assuming now that Young's modulus at Tg−20° C. as E1, and the Young's modulus at Tg+20° C. as E2, it is particularly preferable that the adjustment is made so as to satisfy the relation of $0.6<E1/E2<0.9$.

A product form of the ink jet recording medium having the surficial layer containing the thermoplastic resin may be either of sheet form and roll form, where latter is preferable in view of suitability for high-speed continuous printing. The roll-formed recording medium is generally available in a form of web taken up around a core. The diameter of the core is not specifically limited but preferably 50 to 100 mm in diameter (outer diameter). The roll width of the recording medium is also not specifically limited but preferably selected within a range from 100 to 400 mm. The full length of the recording medium is not specifically limited but preferably selected within a range from 20 to 200 m.

The printing is preferably made based on the ink-jet system using a rolled recording medium and cut into a desirable size after the printing, where it is preferable that the rolled recording medium is hardened with a hardener for the purpose of reducing the dust generation during the cutting, reducing clogging of the head due to the dust, and thereby ensuring an ink-jet printing with an excellent ink ejection stability. It is also preferable to dispose the ink-absorbing layer on both surfaces so as to make the recording medium adoptable to duplex printing. The surficial layer containing the thermoplastic resin may be disposed only on one surface or on both sides. One particularly preferable embodiment relates to that the surficial layers containing the thermoplastic resin are disposed on both surfaces so as to achieve a high-quality and curl-free printing even when printing conditions varied between the top and back surfaces. It is preferable herein that the minimum filming temperature (MFT) of the thermoplastic resin is set so as to differ between those on the top surface and back surface, the recording is made using the dye ink or pigment ink on the surface which contains the thermoplastic resin having the lower MFT (MFT1), the recording medium is heated to a temperature not lower than MFT1 but not higher than MFT (MFT2) which is higher than MFT1, another recording is made using the pigment ink on the surface which contains the thermoplastic resin having the higher MFT (MFT2), and the recording medium is then heated at a temperature not lower than MFT2.

<<Preparation of Recording Medium>>

(Preparation of Silica Dispersion)

A vapor-phase silica (QS-20, product of Tokuyama) having an average particle size of the primary particle of about 0.01 μm in an amount of 125 kg was subjected to suction dispersion into 620 L of a pure water adjusted pH 2.5 with nitric acid at room temperature, using a jet stream inductor mixer Model TDS, manufactured by Mitamura Riken Kogyo Co., Ltd., and adjusted to a total volume of 694 L using a pure water.

Next, 69.4 L of thus-obtained silica dispersion was added to 18 L of an aqueous solution (pH 2.3) containing 1.14 kg of a cationic polymer P-1, 2.2 L of ethanol and 1.5 L of n-propanol under stirring, the mixture was then added with 7.0 L of an aqueous solution containing 260 g of boric acid and 230 g of borax, and further with 1 g of antifoaming agent SN381 (product of San Nopco Ltd.). The obtained mixture was dispersed using a high-pressure homogenizer manufacture by Sanwa Industries Co., Ltd., and the total volume was adjusted to 97 L with pure water, to hereby prepare a silica dispersion.

P-1

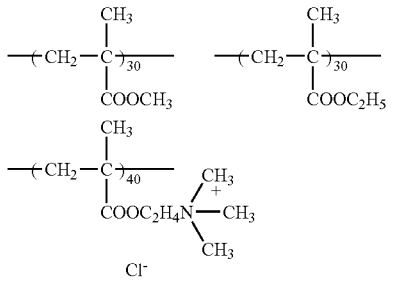

Mn = 13,000

(Preparation of Coating Liquid 1 for Lower Layer)

The above-obtained silica dispersion was stirred at 40° C., and sequentially added with the additives listed below, to thereby obtain a coating liquid 1 for the lower layer.

| | |
|---|---|
| polyvinyl alcohol (PVA203, product of Kuraray Co., Ltd.), 10% aqueous solution | 6 ml |
| polyvinyl alcohol (PVA235, product of Kuraray Co., Ltd.), 7% aqueous solution | 185 ml |
| saponin (50% aqueous solution) | proper quantity |
| pure water | used for adjusting a total volume of 1000 ml |

(Preparation of Coating Liquid 1 for Surficial Layer)

The coating liquid 1 for the lower layer after the preparation was kept under stirring at 43° C. for 30 minutes, and was then added with a thermoplastic fine particle (acrylic latex, Tg=82° C., number-average particle size=160 nm, solid content=25%) over 15 minutes so as to attain a ratio of solid content of the thermoplastic fine particle to the filler (silica) of 55/45, to thereby prepare a coating liquid 1 for the surficial layer. The obtained liquid 1 was used for coating after filtrated through a 10-μm filter.

(Preparation of Recording Medium 1)

On a paper support having both surfaces thereof covered with polyethylene (220 μm thick, polyethylene in the ink-absorbing layer contains anatase-type titanium oxide in an amount of 13% by mass with respect to polyethylene), the coating liquid 1 for the lower layer, as the first layer on the support side, and the coating liquid 1 for the surficial layer, as the second layer stacked thereon, were simultaneously coated using a slide hopper, and then dried to obtain a recording medium 1. The coating liquids herein were coated while being heated to 40° C., cooled immediately after the coating in a cooling zone kept at 0° C. for 20 seconds, then sequentially dried by blowing the air of 25° C. (15% RH) for 60 seconds, the air of 45° C. (25% RH) for 60 seconds, and the air of 50° C. (25% RH) for 60 seconds, further allowed to stand at 20 to 25° C., 40 to 60% RH for 2 minutes so as to stabilize the moisture content, and the sample was taken up. The coating was carried out so as to adjust the amount of adhesion of silica of 18 g/m$^2$ for the lower layer, and 3 g/m$^2$ for the top layer.

The coating liquid for the lower layer used in the above was added with a water-soluble fluorescent brightener (UVITE NFW LIQUID, Product of Ciba Specialty Chemicals, Inc., so as to adjust the amount of adhesion to 100 mg/m$^2$. The same fluorescent brightener was also added to the coating liquid for the top surface, so as to adjust the amount of adhesion to 20 mg/m$^2$.

The following paragraphs will detail the ink available in the aforementioned embodiment.

Available examples of the ink include a variety of publicly known inks such as dye ink, pigment ink and dispersion ink, where the pigment ink is particularly preferable.

The ink used for the image formation may be any of water-base ink composition, oil-base ink composition and solid (phase-change-type) ink composition, and among others, the water-base ink composition (e.g., water-base ink jet recording liquid containing water in an amount of 10% or more by mass with respect to the total mass of the ink) is used in a particularly preferable manner.

The colorant used in the present invention is preferably pigment in view of image storability, and preferable examples of the pigment contained in the pigment ink include insoluble pigment, organic pigments such as lake pigment, and carbon black.

The insoluble pigment is not specifically limited, and examples thereof include azo, azomethine, methine, diphenylmethane, triphenylmethane, quinacridone, anthraquinone, perylene, indigo, quinophthalone, isoindolinone, azine, oxazine, thiazine, dioxazine, thiazole, phthalocyanine and diketopyrrolopyrrole.

Specific examples of preferably available pigment include the followings.

Examples of magenta or red pigment include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

Examples of orange or yellow pigment include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128 and C.I. Pigment Yellow 138.

Examples of green or cyan pigment include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

These pigments may be used in combination with pigment dispersion aid if necessary, and examples of available dispersion aid include activators such as higher fatty acid salt, alkylsulfate salt, alkyl ester sulfuric acid salt, alkylsulfonic acid salt, sulfosuccinic acid salt, naphthalenesulfonic acid salt, alkylphosphoric acid salt, polyoxyalkylene alkyl ether phosphoric acid salt, polyoxyalkylene alkyl phenyl ether, polyoxyethylene polyoxypropylene glycol, glycerin ester, sorbitan ester, polyoxyethylene fatty acid amide and amine oxide; block copolymer or random copolymer comprising two or more monomers selected from styrene, styrene derivatives, vinyl naphthalene derivatives, acrylic acid, acrylic acid derivatives, maleic acid, maleic acid derivatives, itaconic acid, itaconic acid derivatives, fumaric acid, fumaric acid derivatives; and salts of these compounds.

Method of dispersing the pigment is not specifically limited, and can be carried out using various apparatuses such as ball mill, sand mill, Attritor, roll mill, agitator, Henschel mixer, colloid mill, ultrasonic homogenizer, pearl mill, wet jet mill and paint shaker.

It is also allowable to use a centrifuging machine or a filter in order to remove a coarse fraction of the pigment dispersion used in the present invention.

Although it is general practice to select the average particle size of the pigment in the pigment ink considering the stability in the ink, image density, gloss quality and light-proof property, it is preferable, in the ink-jet image forming method of the present using the pigment ink, to select the particle size further from the viewpoints of improved glossiness and texture. While it is not absolutely clear why the present invention is successful in improving the glossiness and texture, it is supposedly because the pigment can exist in a dispersed form in the fused film of the thermoplastic fine particle. It is supposed that the pigment in the image exist in a dispersed form in the fused film of the thermoplastic fine particle. In view of attaining a high-speed processing, it is necessary to fuse the thermoplastic fine particle within a short time and make it into the fused film, and to thoroughly disperse the pigment therein. Surface area of the pigment herein can large affect the speed, and this is supposedly a reason for an optimum range of the average particle size.

The average particle size of the pigment particle available in the present invention is preferably 300 nm or smaller, more preferably falls within a range from 30 to 200 nm, and still more preferably from 30 to 150 nm.

The water-base ink composition, which is a preferable form of the pigment ink, preferably uses a water-miscible organic solvent.

Examples of the water-miscible organic solvent include alcohols (methanol, ethanol, propanol, isopropanol, butanol, isobutanol, secondary butanol, tertiary butanol, pentanol, hexanol, cyclohexanol, benzyl alcohol, etc.); polyvalent alcohols (ethylene glycol, diethylene glycol, triethylene glycol, polyethylene glycol, propylene glycol, dipropylene glycol, polypropylene glycol, butylene glycol, hexane diol, pentane diol, glycerin, hexane triol, thio diglycol, etc.); polyvalent alcohol ethers (ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, ethylene glycol monophenyl ether, propylene glycol monophenyl ether, etc.); amines (ethanolamine, diethanolamine, triethanol amine, N-methyl diethanolamine, N-ethyl diethanolamine, morpholine, N-ethyl morpholine, etylene diamine, diethylene diamine, triethylene tetramine, tetraethylene pentamine pentamine, polyethylne imine, pentamethyl diethylene triamine, tetramethyl propylene diamine, etc.); amides (formaide, N,N-dimethyl fomamide, N-dimethyl acetamide, etc.); heterocyclic compounds (2-pyrrolidone, N-methyl-2-pyrrolidone, cyclohexyl pyrrolidone, 2-oxazolidone, 1,3-dimethyl-2-imidazolidinone, etc.); sulfoxides (dimethyl sulfoxide, etc.); sulfones (sulforane, etc.); urea; acetnitrile and actone. Particularly preferable examples of the water-miscible organic solvent include polyhydric alcohol. It is more preferable to use the polyhydric alcohol in combination with polyhydric alcohol ether.

The water-miscible organic solvent may be used in a singular manner or in combination of two or more species thereof. The amount of addition of the water-miscible organic solvent in the ink totals 5 to 60% by mass, and more preferably 10 to 35% by mass.

The pigment ink used in the present invention preferably contain an acetylene-base surfactant. The acetylene-base surfactant is preferably acetylene diol and its ethylene oxide adduct.

Preferable examples of acetylene diol and its ethylene oxide adduct include Surfinol 82, Surfinol 104, Surfinol 440, Surfinol 465 and Surfinol 485, products of Air Products.

The ink composition may appropriately be added with various additives for the purpose of improving the ejection stability, suitability to print head or ink cartridge, storability, image storability and other performances, where the additives include thermoplastic fine particle, viscosity adjustor, surface tension adjustor, specific resistance adjustor, filming aid, dispersant, surfactant, ultraviolet absorber, antioxidant, antifading agent, mildewproofing agent and rust inhibitor.

The ink composition preferably has a viscosity during the flight of 40 mPa·s or smaller, and more preferably 30 mPa·s or smaller.

The ink composition preferably has a surface tension during the flight of 20 mN/m or larger. At least one ink has a surface tension of 25 to 50 mN/m, and more preferably 30 to 45 mN/m, in view of ensuring a large ink absorption speed, avoiding degradation in the image quality, obtaining a highly glossy image after heating, and preventing heating-induced or spontaneous peeling of the film.

The solid content of the pigment in the ink can be selected within a range from 0.1 to 10%. It is preferable to use so-called, dense-and-light inks, and it is particularly preferable to use dense-and-light inks respectively for the individual colors of yellow, magenta, cyan and black. It is also preferable, in view of obtaining a good color reproducibility, to use specially-blended inks in red, green, blue or the like.

In order to obtain an image with an improved graininess, full gradation and high gloss, it is also preferable that at least one color in the ink set is recorded using two or more inks having different colorant concentrations. It is particularly preferable to use two or more inks having different densities of the colorant material for two or more colors, and more preferably three or more colors from Y, M, C and Bk, where density ratio of the colorant materials of these inks (light ink/dense ink) is preferably within a range from 0.5 to 1.0. The inks may contain the thermoplastic resin fine particle. For the case where a smooth gradation is desired to be expressed using the dense ink and light ink, these inks will be mixed in the printing and can ensure the glossiness and friction resistance over a wide range of density if the relation of $P/B \geqq p/b$ holds, where P (% by mass) is a content of the pigment in the dense ink, B (% by mass) is a content of the thermoplastic resin fine particle in the dense ink, p (% by mass) is a content of the pigment in the light ink, and b (% by mass) is a content of the thermoplastic resin fine particle in the light ink.

In the ink set comprising ink compositions of different colorant densities, a ratio of the surface tension of the dense ink ($\gamma a$) and the surface tension of the light ink ($\gamma b$) preferably satisfies the relation of $1.2 \leqq \gamma a/\gamma b \leqq 0.8$, and more preferably $1.1 \leqq \gamma a/\gamma b \leqq 0.9$. For the purpose of expressing a smooth gradation and ensuring a desirable friction resistance over a wide density range, the different inks preferably have the surface tension equal to each other as possible. A specific example of the pigment contained in the green ink relates to C.I. Pigment Green 7 or C.I. Pigment Green 36.

In order to obtain images having a further improved glossiness, graininess and friction resistance, the recording ink may contain the thermoplastic resin. The thermoplastic resin applicable to the ink may be similar to those applicable to the surficial layer of the recording medium, or those explained in relation to the fine particle. Those not causative of increase in the viscosity or precipitation if added to the ink are particularly preferable. The average particle size of the thermoplastic resin fine particle herein is preferably adjusted to 10 to 200 nm in view of raising the storage stability of the ink or fully expressing the effects of the addition, and more preferably adjusted to 0.2 to 2 times as large as the average particle size of the pigment in the ink in view of raising the stability. The thermoplastic resin to be added is preferably such as melting or softening within a range from 50 to 200° C.

In particular the black ink added with the thermoplastic resin is preferable in view of reducing catching property of fingerprint and raising the maximum density.

It is also allowable to eject an ink containing substantially no colorant over the entire region or a specific region of the image. It is particularly preferable to eject the ink containing substantially no colorant only to the non-text-printing region in view of raising uniformity of the gloss. The uniformity of the gloss herein is an essential feature for obtaining a high-definition image having a high gloss over the entire region of the image containing the white background, and having no variation in the glossy appearance. To eject the ink containing substantially no colorant only into the non-text-printing region is also preferable in terms of reducing the total consumption of the ink. In particular for the case where the recording medium has the thermoplastic resin and inorganic fine powder contained in the surficial portion thereof and consequently has a high ink-absorbing speed, use of the ink containing substantially no colorant is the best embodiment.

The ink containing substantially no colorant can be ejected into the entire region or a specific region of the image as described in the above. It is particularly preferable to select the region having an image density of 0.5 or below and to eject the ink therein. It is particularly preferable to further select the non-text-printing region out of this region and to eject the ink therein.

The ink containing substantially no colorant preferably contains the thermoplastic resin which are available for the addition to the ink as described in the above.

The ink containing substantially no colorant preferably contains a water-miscible organic solvent.

The ink containing substantially no colorant preferably ejected through an ink jet nozzle, and more preferably through a dedicated nozzle.

It is preferable to select the ink containing substantially no colorant having only a small as possible interaction with other inks, and being not causative of increase in the viscosity or deposition after the mixing, in view of constantly obtaining a high-definition image.

<<Preparation of Ink>>

[Preparation of Pigment Ink Set]

(Preparation of Pigment Dispersion)

| <Preparation of Yellow Pigment Dispersion 1> | |
|---|---|
| C.I. Pigment Yellow 74 | 20% by mass |
| styrene-acrylic acid copolymer (M.W. = 10,000, acid value = 120) | 12% by mass |
| diethylene glycol | 15% by mass |
| ion-exchange water | 53% by mass |

The additives listed in the above were mixed, and then dispersed in a horizontal bead mill (System Zeta Mini, product of Ashizawa K.K.) with 0.3-mm zirconia bead under a ratio of filling of 60% by volume, to thereby obtain a yellow pigment dispersion 1. The obtained yellow pigment dispersion was found to have an average particle size of 112 nm.

| <Preparation of Magenta Ink> | |
|---|---|
| C.I. Pigment Red 122 | 25% by mass |
| Joncryl 61 (acryl-styrene-base resin, product of Johnson Polymer) | 18% by mass on solid basis |
| diethylene glycol | 15% by mass |
| ion-exchange water | 42% by mass |

The additives listed in the above were mixed, and then dispersed in a horizontal bead mill (System Zeta Mini, product of Azhizawa K.K.) with 0.3-mm zirconia bead under a ratio of filling of 60% by volume, to thereby obtain a magenta pigment dispersion 1. The obtained magenta pigment dispersion was found to have an average particle size of 105 nm.

| <Preparation of Cyan Pigment Dispersion 1> | |
|---|---|
| C.I. Pigment Blue 15:3 | 25% by mass |
| Joncryl 61 (acryl-styrene-base resin, product of Johnson Polymer) | 15% by mass on solid basis |
| glycerin | 10% by mass |
| ion-exchange water | 50% by mass |

The additives listed in the above were mixed, and then dispersed in a horizontal bead mill (System Zeta Mini, product of Azhizawa K.K.) with 0.3-mm zirconia bead under a ratio of filling of 60% by volume, to thereby obtain a cyan pigment dispersion 1. The obtained cyan pigment dispersion was found to have an average particle size of 87 nm.

| <Preparation of Black Pigment Dispersion 1> | |
|---|---|
| carbon black | 20% by mass |
| styrene-acrylic acid copolymer (M.W. = 7,000, acid value = 150) | 10% by mass |
| glycerin | 10% by mass |
| ion-exchange water | 60% by mass |

The additives listed in the above were mixed, and then dispersed in a horizontal bead mill (System Zeta Mini, product of Azhizawa K.K.) with 0.3-mm zirconia bead under a ratio of filling of 60% by volume, to thereby obtain a black pigment dispersion 1. The obtained black pigment dispersion was found to have an average particle size of 75 nm.

(Preparation of Pigment Ink Set)

| <Preparation of Yellow Dense Ink 1> | |
|---|---|
| yellow pigment dispersion 1 | 15% by mass |
| ethylene glycol | 20% by mass |
| diethylene glycol | 10% by mass |
| surfactant (Surfinol 465, product of Nissin Chemical Industry Co., Ltd.) | 0.1% by mass |
| ion-exchange water | 54.9% by mass |

The additives listed in the above were mixed, stirred and filtered through a 1-μm filter, to thereby prepare a yellow dense ink 1, which is a water-base pigment ink of the present invention. The ink was found to have an average particle size of the pigment of 120 nm, and a surface tension γ of 36 mN/m.

| <Preparation of Yellow Light Ink 1> | |
|---|---|
| yellow pigment dispersion 1 | 3% by mass |
| ethylene glycol | 25% by mass |
| diethylene glycol | 10% by mass |
| surfactant (Surfinol 465, product of Nissin Chemical Industry Co., Ltd.) | 0.1% by mass |
| ion-exchange water | 61.9% by mass |

The additives listed in the above were mixed, stirred and filtered through a 1-μm filter, to thereby prepare a yellow light ink 1, which is a water-base pigment ink of the present invention. The ink was found to have an average particle size of the pigment of 118 nm, and a surface tension γ of 37 mN/m.

| <Preparation of Magenta Dense Ink 1> | |
|---|---|
| magenta pigment dispersion 1 | 15% by mass |
| ethylene glycol | 20% by mass |
| diethylene glycol | 10% by mass |
| surfactant (Surfinol 465, product of Nissin Chemical Industry Co., Ltd.) | 0.1% by mass |
| ion-exchange water | 54.9% by mass |

The additives listed in the above were mixed, stirred and filtered through a 1-μm filter, to thereby prepare a magenta dense ink 1, which is a water-base pigment ink of the present invention. The ink was found to have an average particle size of the pigment of 118 nm, and a surface tension γ of 35 mN/m.

| <Preparation of Magenta Light Ink 1> | |
|---|---|
| magenta pigment dispersion 1 | 3% by mass |
| ethylene glycol | 25% by mass |
| diethylene glycol | 10% by mass |
| surfactant (Surfinol 465, product of Nissin Chemical Industry Co., Ltd.) | 0.1% by mass |
| ion-exchange water | 61.9% by mass |

The additives listed in the above were mixed, stirred and filtered through a 1-μm filter, to thereby prepare a magenta light ink 1, which is a water-base pigment ink of the present invention. The ink was found to have an average particle size of the pigment of 110 nm, and a surface tension γ of 37 mN/m.

| <Preparation of Cyan Dense Ink 1> | |
|---|---|
| cyan pigment dispersion 1 | 10% by mass |
| ethylene glycol | 20% by mass |
| diethylene glycol | 10% by mass |
| surfactant (Surfinol 465, product of Nissin Chemical Industry Co., Ltd.) | 0.1% by mass |
| ion-exchange water | 59.9% by mass |

The additives listed in the above were mixed, stirred and filtered through a 1-μm filter, to thereby prepare a cyan dense ink 1, which is a water-base pigment ink of the present invention. The ink was found to have an average particle size of the pigment of 95 nm, and a surface tension γ of 36 mN/m.

| <Preparation of Cyan Light Ink 1> | |
|---|---|
| cyan pigment dispersion 1 | 2% by mass |
| ethylene glycol | 25% by mass |
| diethylene glycol | 10% by mass |
| surfactant (Surfinol 465, product of Nissin Chemical Industry Co., Ltd.) | 0.2% by mass |
| ion-exchange water | 62.8% by mass |

The additives listed in the above were mixed, stirred and filtered through a 1-μm filter, to thereby prepare a cyan light ink 1, which is a water-base pigment ink of the present invention. The ink was found to have an average particle size of the pigment of 92 nm, and a surface tension γ of 33 mN/m.

| <Preparation of Black Dense Ink 1> | |
|---|---|
| black pigment dispersion 1 | 10% by mass |
| ethylene glycol | 20% by mass |
| diethylene glycol | 10% by mass |
| surfactant (Surfinol 465, product of Nissin Chemical Industry Co., Ltd.) | 0.1% by mass |
| ion-exchange water | 59.9% by mass |

The additives listed in the above were mixed, stirred and filtered through a 1-μm filter, to thereby prepare a black dense ink 1, which is a water-base pigment ink of the present invention. The ink was found to have an average particle size of the pigment of 85 nm, and a surface tension γ of 35 mN/m.

| <Preparation of Black Light Ink 1> | |
|---|---|
| black pigment dispersion 1 | 2% by mass |
| ethylene glycol | 25% by mass |
| diethylene glycol | 10% by mass |
| surfactant (Surfinol 465, product of Nissin Chemical Industry Co., Ltd.) | 0.1% by mass |
| ion-exchange water | 62.9% by mass |

The additives listed in the above were mixed, stirred and filtered through a 1-μm filter, to thereby prepare a black light ink 1, which is a water-base pigment ink of the present invention. The ink was found to have an average particle size of the pigment of 89 nm, and a surface tension γ of 36 mN/m.

The finally-obtained image produced on the ink jet recording medium having the surficial layer which contain the thermoplastic resin will be explained below.

It is preferable to achieve the individual properties as described below by adjusting the recording medium, recording ink, printer, recording conditions, apparatuses used for the post-processing, and process conditions.

Adjustment of the surface roughness of the finally-obtained image is preferable in view of producing high-gloss and high-definition image. The surface roughness is preferably 0.5 μm or smaller in terms of centerline average roughness (Ra), and more preferably 0.01 to 0.5 μm.

The centerline average roughness in the context of the present invention is defined by JIS B 0601. That is, the centerline average roughness (Ra) can be determined by extracting a portion having a measurement length L (preferably 2.5 mm in the present invention) from a roughness curve along the direction of the centerline, while setting a cutoff value of 0.8 mm, and by calculating a value from the equation below while assuming the centerline in the extracted portion as X axis, direction of vertical magnification factor as Y axis, and the roughness curve as Y=f(X):

$$R_a = \frac{1}{L}\int_0^L |f(x)|\,dx$$

The centerline average roughness (Ra) can be measured in an environment conditioned at 25° C., 65% RH, in which the test samples are previously allowed to stand for 24 hours so as to stabilize the moisture content thereof, in a style not causative of overlapping of the test samples. The style not causative of overlapping of the test samples can be attained by a technique in which the recording medium is taken up around a core while thickening the edge portions of the support, by stacking the supports while placing a sheet of paper in between, or by immobilizing the support at four corners thereof onto a frame made of cardboard or the like. A measurement apparatus available herein can be exemplified by a non-contact, three-dimensional micro surface morphology measurement system RSTPlus, manufactured by WYKO.

The C value (image sharpness) of the final image is preferably adjusted to 60 or above. In particular for the case where the pigment ink is used, this is essential for obtaining glossiness equivalent to that of silver salt photograph, and for obtaining ink jet pigment image having no bronzing, excellent water-proof property and anti-oxidative-gas property. The C value is one of the indices for expressing image sharpness specified in JIS K 7105, and the value obtained by the reflective method using a 2-mm optical frequency comb was adopted herein. It is to be noted that, in the present invention, a sample was irradiated by light at an angle of incidence of 60°, which is generally set at 45°.

In view of further raising the aforementioned desirable properties, the C value is preferably not less than 70, more preferably not less than 75 and still more preferably not less than 80.

It is also essential to adjust the glossiness of the finally-obtained image.

In addition, it is preferable in the present invention that the ink jet pigment image has a C value of 60 or larger together with a 60° gloss of 70% or more, or a combination of a C value of 60 or larger, an Ra of 0.5 μm or smaller, and a 60° gloss of 70% or more, under which the present invention expresses its full effects. The 60° gloss in the present invention is measured conforming to JIS K 8741 using a variable-angle gloss meter VGS-1001DP, manufactured by Nippon Denshoku Industries Co., Ltd.

The best specification relates to the C value which is not less than 80, Ra ranging from 0.01 to 0.2 μm, and the 60° gloss of 90% or more, under which the present invention can yield a maximum effect.

It is also preferable to adjust the C value and 60° gloss so that they can be expressed for the individual colors (e.g., Y, M, C, B, G, R, Bk, etc.), or for the individual density range without exception.

It is also essential to adjust the individual materials, apparatuses and conditions so as to prevent the C value and 60° gloss from being largely fluctuated depending on environment of the image formation, and they are preferably adjusted so as to ensure a large gloss, which is typically expressed by a C value of 70 or larger, and a 60° gloss of 90% or more, in an environment ranging typically from 10° C., 20% RH to 30° C., 80% RH.

Among others, adjustment of the relation between the maximum ink volume of the printer and the amount of water absorption is effective to obtain large values for C value and 60° gloss under the above-described temperature and humidity environment. More specifically, it is preferable to set the amount of water absorption of the recording medium larger by 2 ml/m$^2$ or more than the maximum ink volume of the printer, and more preferably larger by 4 ml/m$^2$ or more, in view of ensuring a stable and excellent gloss property even under high-temperature, high-humidity conditions.

The film surface of the finally-obtained image is preferably tough, and preferably has a scratch strength being adjusted to as large as 25 g or more.

The scratch strength can be measured conforming to JIS K 6717. Measurement was made using a continuous-loading-type scratch tester (e.g., HEIDON-18, product of Shinto Kagaku Co., Ltd.), under the conditions of a scratch length of 100 mm, a load of 100 g, and a diameter of the scratching needle (sapphire needle) of 0.5 mm. In the present invention, the load was varied from the start point (load=0 g) of scratching, and a value of load (g) where the surface began to get scratch was detected and defined as an index for expressing the scratch strength.

Ideally saying, the wider color range is the better. It is, however, not always allowable to design the color without any limitations in relation with the image storability, so that it is a desirable embodiment to expand the color range in the post-processing involving heating. In other words, it is preferable to increase the absolute value of at least either one of the brightness and saturation after the post-processing involving heating. More specifically, the total of ΔE of the individual colors of yellow, magenta, cyan, blue, green and red is preferably 10 or more, and more preferably within a range from 15 to 50.

The fixing belt will further be detailed below.

<<Base>>

Bases for composing the belt components of the fixing belt in the present invention, and the individual bases for composing the heating roller and pressure roller of the fixing roller in the present invention will be explained below.

In view of successfully obtaining the above-described effects of the present invention, the base used for the belt component is preferably composed of a seamless nickel electro-formed member, and the base used for the heating roller and pressure roller is preferably composed of nickel. The thickness of the base preferably falls within a range from 10 to 100 μm.

Besides nickel, other possible materials for composing the base include aluminum, iron, polyethylene or the like.

The surface roughness of the base used for the fixing belt is preferably 0.1 μm or less, and more preferably 0.08 μm or less. Young's modulus is preferably 50 $kN/mm^2$ or above, and more preferably within a range from 50 to 300 $kN/mm^2$.

<<Surface-Treated Layer>>

The surface treated layer will be explained in the next.

For the purpose of successfully expressing the effect of the present invention, that is, reducing variation in the glossiness during the image formation and suppressing separation of the releasing layer during fixation, it is essential for the surface-treated layer to have a pencil hardness of HB or larger, as being specified in JIS K 5401, more preferably within a range from H to 5H, and particularly preferably from 2H to 5H.

For the purpose of further effectively suppressing variation in the gloss, the surface-treated layer preferably has a rate of swelling, specified in JIS K 6911, of less than 5%, more preferably not more than 3%, and especially preferably not more than 1%.

The surface-treated layer having the pencil hardness and rate of swelling within the above-described ranges will be more successful in raising the adhesiveness of the fixing belt or fixing roller with the releasing layer, and in appropriately preventing variation in the glossiness from generating during the fixation, if a surface modifier is contained therein. The surface modifier is preferably an aluminum coupling agent or a zirconium coupling agent, where the former is more preferable.

The above-described aluminum coupling agent and zirconium coupling agent express no adhesiveness by themselves, but when they are coated in a form of solution on the surface to be adhered (i.e., base materials for the fixing belt and fixing roller), they can raise the adhesiveness of the surface of the base material through hydrolysis and condensation reaction.

Specific examples of the aluminum coupling agent and zirconium coupling agent are listed below, while the present invention is by no section limited thereto.

<<Specific Examples of Aluminum Coupling Agent>> acetomethoxy acetomethoxy aluminum diisopropylate,
acetoethoxy aluminum diisopropylate,
acetoalkoxy aluminum diisopropylate,
aluminum di-n-butoxide monomethyl acetate,
aluminum di-n-butoxide monoethyl acetate,
aluminum isopropylate,
mono-sec-butoxy aluminum diisopropylate,
aluminum sec-butylate,
aluminum ethylate,
ethyl acetoacetate aluminum diisopropylate,
aluminum tris(ethyl acetoacetate),
alkyl acetoacetate aluminum diisopropylate,
aluminum monoacetyl acetoacetate bis(ethyl acetoacetate),
aluminum tris(acetyl acetonate),
aluminum=monoisopropoxy monooleoxyethyl acetoacetate, and
cyclic aluminum oxide isopropylate.

<<Specific Examples of Zirconium Coupling Agent>> zirconium chelate compounds such as:
zirconium tetra(acetyl acetate),
zirconium dibutoxy bis(acetyl acetonate),
zirconium tributoxyacetyl acetonate,
zirconium tetrakis(ethyl acetoacetate),
zirconium butoxy tris(ethyl acetoacetate),
zirconium butoxy bis(ethyl acetoacetate),
zirconium tributoxy mono(ethyl acetoacetate),
zirconium tetrakis(ethyl lactate),
zirconium dibutoxy bis(ethyl lactate);
bisacetyl acetonate bis(ethyl acetoacetate) zirconium,
monoacetyl acetonante tris(ethyl acetoacetate) zirconium, and
bisacetyl acetonate bis(ethyl lactate) zirconium; and
zirconium alkoxide such as zirconium n-butylate and zirconium n-propylate.

<<Thickness of Surface-Treated Layer>>

The thickness of the surface-treated layer is preferably within a range from 0.2 to 10 μm, and more preferably 0.2 to 3

<<Contents of Aluminum Coupling Agent and Zirconium Coupling Agent>>

Contents of the aluminum coupling agent and zirconium coupling agent preferably resides within a range from 1 to 100% by mass, and more preferably from 50 to 100% by mass.

The surface-treated layer in the present invention can preferably be added with the titanium coupling agent listed below. Specific examples of the titanium coupling agent include isopropyl triisostearoyl titanate, isopropyl tri(N-aminoethyl-aminoethyl)titanate, diisopropyl bis(dioctyl pyrophosphate)titanate, tetraisopropyl bis(dioctyl phosphite)titanate, tetraoctyl bis(ditridecyl phosphite)titanate, tetra (2,2-diallyloxy-methyl-1-butyl)bis(ditridecyl)phosphite titanate, bis(dioctyl pyrophosphate)oxy acetate titanate, bis (dioctyl pyrophosphate)ethylene titanate, dibutoxy titanium-bis (octylene glycolate), dipropoxy titanium-bis (ethyl acetylacetate), dipropoxy titahium-bis(triethanol aminate), tetrapropoxy titanium and tetrabutoxy titanium.

<<Releasing Layer>>

The releasing layer used in the present invention will be explained.

The releasing layer used in the present invention contains a silicone resin. The silicone resin used in the present invention may be any of publicly-known ones, and may preferably be selected from those having a releasing force of the releasing layer of 30 g/5 cm or larger, in view of successfully obtaining the effects of the present invention.

The silicone resin available in the present invention is preferably such as being prepared using the solvent-added silicone of cured-silicone such as condensation-cured silicone as listed below, and among others, silicone resin prepared using the solvent-added silicone is preferable.

The solvent-added silicone can be obtained by reacting a straight-chain methylvinyl polysiloxane, having vinyl groups on both ends or additionally within the chain, with methyl hydrogen polysiloxane under the presence of a platinum-base catalyst.

Specific examples of the solvent-added silicone include KS-887, KS-779H, KS-778, KS-835, X-62-2456, X-62-2494, X-62-2461, KS-3650, KS-3655, KS-3600, KS-847, KS-770, KS-770L, KS-776A, KS-856, KS-775, KS-830, KS-830E, KS-839, X-62-2404, X-62-2405, KS-3702, X-62-2232, KS-3503, KS-3502 and KS-3703, KS-5508, all manufactured by Shin-Etsu Silicone Co., Ltd.

Specific examples of the condensation-cured silicone include KS-881, KS-882, KS-883, X-62-9490 and X-62-9028, all manufacture by Shin-Etsu Silicone Co., Ltd.

The angle of surface contact on the releasing layer in the present invention is preferably within a range from 100 to 120°, and more preferably 105 to 115°. The angle of surface contact herein is defined with respect to pure water, and was measured using an automated contact angle meter DAC-VZ (product of Kyowa Interface Science Co., Ltd.) based on the droplet method (approximately 15 μl of pure water is gently dropped on the surface to be measured, and the angle of contact achieved 0.5 seconds after the contact is measured).

The surface roughness (definition thereof will be described later) of the releasing layer used in the present invention is preferably 0.2 μm or smaller, and more preferably 0.1 μm or smaller.

The thickness of the releasing layer used in the present invention preferably falls within a range from 1 to 50 μm, and more preferably from 10 to 30 μm.

The releasing force of the releasing layer used for the fixing belt and fixing roller in the present invention is preferably adjusted to 30 g/5 cm or larger, more preferably 30 to 1000 g/5 cm, and particularly preferably from 50 to 600 g/5 cm.

The releasing force of the releasing layer can be measured by the method described in the next.

(Method of Measuring Releasing Force of Releasing Layer)

An adhesive tape (Nitto polyester tape No. 31B, product of Nitto Denko Corporation) was placed on the releasing layer of the fixing belt when the fixing belt such as being shown in FIG. 5 is used, and was placed on the releasing layer of the heating roller or pressure roller when the fixing roller such as being shown in FIG. 12 is used. The pressure roller was rotated by a single turn to effect pressurizing while setting the pressure value thereof to 2 kg, the fixing belt or fixing roller was then allowed to stand at room temperature for 20 hours, and the adhesive tape was pulled at an angle of 180° and a speed of 0.3 m/minute using a commercial tensile tester, to measure the releasing force.

For the case where the releasing layer is provided on both of the heating roller and pressure roller of the fixing roller, only the releasing layer placed on the side to be brought into contact with the recording medium was measured.

The fixing belt and fixing roller used in the present invention are configured as having the surface-treated layer and releasing layer formed on the base, and further preferably as having an adhesion-modifying layer described below, in view of further effectively preventing separation of the releasing layer.

<<Adhesion-Modifying Layer>>

The adhesion-modifying layer available in the present invention will be described.

The adhesion-modifying layer available in the present invention preferably contains a compound having at least one reactive group selected from hydroxyl group, carboxyl group, group expressed by the above-described general formula (a), and a group expressed by the above-described general formula (b).

(Compounds Having Reactive Group)

The compounds having reactive group may be low-molecular compounds or polymers, where examples thereof preferably available in the present invention include polyvinyl alcohol resins (e.g., PVA-124, 224 and 424, products of Kuraray, Co., Ltd.); butyral resin (e.g., 3000K, product of Denki Kagaku Kogyo Kabusiki Kaisha); ethylene-vinyl acetate copolymer; olefinic resins such as vinylidene chloride and polybutadiene; urethane resin; polyester resin; acrylic resin; epoxy resin; and polyethylene imine resin.

The content of the compounds having the reactive group in the adhesion modifying layer is preferably within a range from 1 to 100% by mass, and more preferably 50 to 100% by mass. For the case where the adhesion-modifying layer used in the present invention is composed of a resin having a reactive group (may be of a single resin, or a mixture of two or more resins), the ratio of content of the repetitive unit having the reactive group is preferably 20% or less of the total repetitive units composing the resin, more preferably 1 to 20%.

(Coupling Agents, Isocyanate Compounds)

The adhesion-modifying layer used in the present invention preferably contains, in view of allowing it to exhibit the adhesion property further preferably, at least any one compound selected from the group consisting of silane coupling agent, titanium coupling agent and isocyanate compound, more preferably contains titanium coupling agent and isocyanate compound, and still more preferably contains titanium coupling agent.

Examples of the titanium coupling agent include tetrabutyl titanate, tetraoctyl titanate, isopropyl triisostearoyl titanate, isopropyltridecylbenzene sulfonyltitanate, and bis(dioctylpyrophosphate)oxy acetatetitanate.

Still other examples include monoalkoxy-type agent having isopropoxy group; chelate-type agent having oxyacetic acid residue or ethylene glycol residue; and coordinate-type agent which comprises tetraalkyl titanate added with phosphorous ester.

Examples of the monoalkoxy-type agent include isopropyl dimethacryl stearoyl titanate, isopropyl tri(dioctylphosphate)titanate, isopropyl tricumylphenyl titanate, isopropyl tri(N-aminoethylaminoethyl)titanate, isopropyl trioctanoyl titanate, isopropyl triisostearoyl titanate, isopropyl tridecylbenzene sulfonyltitanate, isopropyl tridodecylbenzene sulfonyltitanate and isopropyl tris(dioctylpyrophosphate)titanate.

Other available examples include titanium-i-propoxy octylene glycolate (TOG: product of Nippon Soda Co., Ltd.), tetra-i-propoxy titanium, tetra-n-butoxy titanium, tetrakis(2-ethylhexoxy)titanium, tetrastearoxy titanium, di-i-propoxy-bis(acetyl acetonate)titanium, di-n-butoxy-bis(triethanole aminate)titanium and dihydroxy titanium tri-i-stearate.

Examples of the chelate-type agent include bis(dioctyl pyrophosphate)oxy acetate titanate, dicumylphenyloxy acetate titanate and diisostearoyl ethylene titanate.

Examples of the coordinate-type agent include tetraisopropyl bis (ditridecyl phosphite) titanate and tetraoctyl bis (ditridecyl phosphite)titanate.

Examples of the silane coupling agent include γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl) γ-aminopropyl trimethoxysilane hydrochlorate, hexamethyl disilazane, methyl trimethoxysilane, butyl trimethoxysilane, isobutyl trimethoxysilane, hexyl trimethoxysilane, octyl trimethoxysilane, decyl trimethoxysilane, dodecyl trimethoxysilane, phenyl trimethoxysilane, o-methylphenyl trimethoxysilane, KBM503 (product of Shin-Etsu Chemical Co., Ltd.) and p-methylphenyl trimethoxysilane.

The isocyanate compound can be exemplified by those expressed by the general formula below:

$$O{=}C{=}N{-}L{-}(N{=}C{=}O)_v$$

where, v represents an integer of 0, 1 or 2, and L represents a divalent linkage group having any of alkylene group, alkenylene group, arylene group or aralkyl group as a partial structure thereof.

These groups may further have a substitutive group, and preferable examples of the substitutive group include halogen (e.g., Br and Cl), hydroxyl group, amino group, carboxyl group, alkyl group and alkoxyl group.

Specific examples of commercially available isocyante compounds are listed below, where the present invention is by no section limited to these compounds.

IC-1: Desmodur N100, Mobay Corporation, aliphatic isocyanate;

IC-2: Desmodur N3300, Mobay Corporation, aliphatic isocyanate;

IC-3: Mondur TD-80, Mobay Corporation, aromatic isocyanate;

IC-4: Mondur M, Mobay Corporation, aromatic isocyanate;

IC-5: Mondur MRS, Mobay Corporation, polymer isocyanate;

IC-6: Desmodur W, Mobay Corporation, aliphatic isocyanate;

IC-7: Papi 27, Dow Chemical, polymer isocyanate;

IC-8: isocyanate T1890, Huels AG, aliphatic isocyanate; and

IC-9: octadecyl isocyanate, Aldrich Corporation, aliphatic isocyanate.

Still other examples include Coronate 2030, Coronate 2255, Coronate 2513, Coronate 2507, Coronate L, Coronate HL, Coronate HK, Coronate HX, Coronate 341, Coronate MX and Coronate 2067 (all manufactured by Nippon Polyurethane Industry Co., Ltd.); Takenate D103H, Takenate D204EA, Takenate D-172N and Takenate D-170N (all manufactured by Takeda Chemical Industries, Ltd.); and Sumidur 3200, Sumidur 44V-20 and Sumidur IL (all manufactured by Sumitomo Bayer Urethane Co., Ltd.).

In the present invention, it is also allowable too use aluminum coupling agent, which is typified by acetoalkoxy aluminum diisopropylate.

The above-listed coupling agents and isocyanate compounds are contained in the adhesion-modifying layer preferably in an amount of 1 to 99% by mass, and more preferably in an amount of 1 to 50% by mass.

(Thickness of Adhesion-Modifying Layer)

The thickness of the adhesion-modifying layer used in the present invention is preferably adjusted within a range from 1 to 300 μm, more preferably 1 to 100 μm, and particularly preferably 1 to 50 μm.

(Flow/Softening Point of Resin)

At least one resin contained in the adhesion-modifying layer used in the present invention preferably has a flow/softening point of 130° C. or higher, and more preferably within a range from 130 to 400° C., and particularly preferably 130 to 300° C. The above-described resin may be any of those used as the compounds having the aforementioned reactive groups, or any of the above-described thermoplastic resins.

The flow/softening point in the present invention was measured using an elevated flow tester CFT-500 (product of Shimadzu Corporation).

<<Surface Roughness>>

The following paragraphs will describe measurement of the surface roughness of the releasing layer, fixing belt, and fixing roller base.

In the present invention, average surface roughness Ra was measured according to the methods below.

An atomic force microscope (AFM) used herein was SPI3800N Probe Station manufacture by Seiko Instruments Inc., combined with multi-functional unit SPA40. A sample cut into approximately 1-cm square was placed on a horizontal sample table on a piezo-scanner, a cantilever was approached to the surface of the sample to as close to where the atomic force emerges, and scanned in X-Y direction so as to sense the surface irregularity of the sample as a piezoelectric dislocation in Z direction. The piezo-scanner adopted herein had a scanning range of 20 μm in XY direction and 2 μm in Z direction. The cantilever adopted herein was a silicon cantilever SI-DF20 manufactured by Seiko Instruments Inc., has a resonant frequency of 120 to 150 kHz, and a spring constant of 12 to 20 N/m. The measurement was made in the DFM (dynamic force mode), in which the measurement area of 2-μm square was measured under a single (or double) field(s) at a scanning frequency of 1 Hz. The obtained three-dimensional data was process by the least-square approximation so as to correct a minute inclination of the sample, and thereby obtained a reference plane.

The surface roughness was analyzed using an analytical software SPIwin (ver.2.05D2, product of Seiko Instruments Inc.), and more specifically, by activating surface roughness analysis from "Analysis" menu, to thereby determine the average surface roughness based on the obtained three dimensional data.

The measurement plane was expressed as Z=F(X,Y), where (X,Y) can range from (0,0) to (Xmax,Ymax). Assuming now the measurement plane as a designated plane* which is a target for the roughness analysis, surface area S0 can be calculated by the equation below:

$$S0 = Xmax \cdot Ymax$$

When an average value for the Z data in the designated plane is given as Z0, and a plane where Z=Z0 holds is defined as the reference plane, Z0 can be calculated from the equation below:

$$Z_0 = \frac{1}{S_0}\int_0^{Y_{max}}\int_0^{X_{max}} F(X, Y)\,dX\,dY$$

Besides this, the centerline average roughness (Ra) based on JIS B 601 is defined by extracting a measurement length L from a roughness curve along the direction of the centerline, and by calculating a value from the equation below while assuming the centerline in the extracted portion as X axis, direction of vertical magnification factor (normal to X axis) as Y axis, and the roughness curve as Y=f(X):

$$R_a = \frac{1}{L}\int_0^{L} |F(X)|\,dX$$

In the present invention, the centerline average roughness was expanded to a three-dimensional value so as to be adoptable to the measurement plane, and this value was defined as the surface roughness (also referred to as average roughness Ra) in the context of the present invention. The surface roughness herein was expressed by an average of absolute values of deviations between the reference plane and designated plane, as calculated based on the equation below:

$$R_a = \frac{1}{S_0}\int_0^{Y_{max}}\int_0^{X_{max}} |F(X, Y) - Z_0|\,dX\,dY$$

<<Methods of Fabricating Fixing Belt and Fixing Roller>>

Methods of fabricating the fixing belt and fixing roller will be described in the next.

In a preferable process of fabricating the fixing belt and fixing roller for use in the present invention, the surface of the fixing belt or fixing roller, which is to be brought into contact with the recording medium, is subjected to coating for forming the adhesion-modifying layer through the dip coating process, bar coating process, blade coating process, air knife process, slide coating process or curtain coating process, the coated layer is dried, and further on the adhesion-modifying layer, a curing-type silicone, such as solvent-added silicone or solvent-condensed silicone, is coated by dipping, and the coating is cured by heating, to thereby form the releasing layer.

A particularly preferable process is such as carrying out the coating on the adhesion-modifying layer and releasing layer both by dipping. The viscosity of the coating liquid used for the dipping is preferably adjusted within a range from 0.01 to 0.5 Pa/s.

In the present invention, it is also preferable to carry out ageing A after the releasing layer was formed by coating, which is followed by ageing B.

The ageing A herein refers to a process in which the fixing belt or fixing roller, having the releasing layer already formed thereon by coating, is dipped into water, or sprayed with vapor, or allowed to stand under a hot-and-humid environment. The hot-and-humid environment herein is preferably such as having a temperature range of 25 to 100° C., a relative humidity of 50% RH or above, and more preferably ranging from 50 to 95% RH.

The ageing B refers to a process in which the fixing belt or fixing roller after completion of the ageing A is allowed to stand in a hot-and-less-humid environment. The hot-and-less-humid environment herein is preferably such as having a temperature range of 40 to 200° C., more preferably 40 to 150° C., and a relative humidity of less than 50% RH.

<<Fabrication of Fixing Belt>>

(Fabrication of Fixation Belt Sample 1)

On a base of the belt (seamless nickel electro-formed belt), the surface-treated layer was formed by coating the coating liquid for forming the surface-treated layer shown below, the adhesion-modifying layer was formed by coating the coating liquid for forming the adhesion-modifying layer, and then the releasing layer was formed by coating, to thereby fabricate a fixing belt sample 1.

(Preparation of Coating Liquid for Forming Surface-Treated Layer: Totals 1920 ml)

| | |
|---|---|
| aluminum coupling agent Plenact AL-M (product of Kawaken Fine Chemicals Co., Ltd.) | 120 g |
| toluene | 1800 ml |

The above ingredients were mixed and stirred to thereby prepare a coating liquid for forming the surface-treated layer.

(Formation-by-Coating of Surface-Treated Layer)

Thus-obtained coating liquid for forming the surface-treated layer was placed in a cylindrical beaker 15 cm in inner diameter and 50 cm in height, a seamless electro-formed belt (65 mm in diameter, 240 mm in length and 40 μm in thickness: product of Nitto Denko Corporation) was set on a commercial dip coater, and the belt was descended to be immersed into the liquid in the beaker. The pull-up speed was set to 4 mm/sec so as to effect coating, the belt was allowed to stand at room temperature for 3 minutes, annealed in an oven at 140° C. for 1 hour, to thereby form the surface-treated layer.

| (Preparation of Coating Liquid for Forming Adhesion-Modifying Layer: totals 2 liters) | |
|---|---|
| Denka butyral 6000C(product of Denki Kagaku Kogyo Kabusiki Kaisha) | 10 g |
| ethyl acetate | 1790 ml |
| n-butanol | 200 ml |
| silane coupling agent KBM503 (product of Shin-Etsu Chemical Co., Ltd.) | 1.6 ml |

The ingredients listed in the above were mixed and stirred so as to thoroughly dissolve Denka butyral, to thereby prepare a coating liquid for forming the adhesion-modifying layer.

(Formation-by-Coating of Adhesion-Modifying Layer on Surface-Treated Layer)

Two liters of thus-obtained coating liquid for forming the adhesion-modifying layer was placed in a cylindrical beaker 15 cm in inner diameter and 50 cm in height, the seamless electro-formed belt having the surface-treated layer already formed thereon was set on the commercial dip coater, and the belt was descended to be immersed into the liquid in the beaker. The pull-up speed was set to 4 mm/sec so as to effect coating, the belt was allowed to stand at room temperature for 3 minutes, annealed in an oven at 100° C. for 30 minutes, to thereby form the adhesion-modifying layer.

| (Preparation of Coating Liquid for Forming Releasing Layer: totals; 2 liters) | |
|---|---|
| releasing agent for released paper KS830E (product of Shin-Etsu Chemical Co., Ltd.) | 500 g |
| curing catalyst CAT-PL-50T (product of Shin-Etsu Chemical Co., Ltd.) | 5 ml |
| toluene | 1500 ml |

The above ingredients were mixed and stirred to thereby prepare a coating liquid for forming the releasing layer.

(Formation-by-Coating of Releasing Layer on Adhesion-Modifying Layer)

Two liters of thus-obtained coating liquid for forming the releasing layer was placed in a cylindrical beaker 15 cm in inner diameter and 50 cm in height, the seamless electroformed belt having the surface-modifying layer already formed thereon was set on the commercial dip coater, and the belt was descended to be immersed into the liquid in the beaker. The pull-up speed was set to 15 mm/sec so as to effect coating, the belt was allowed to stand at room temperature for 5 minutes, annealed in an oven at 100° C. for 1 hour, to thereby form the releasing layer.

(Hydrolysis and Condensation)

The belt having the releasing layer already formed thereon was allowed to stand in an atmosphere at 40° C., 80% RH for 12 hours, and further annealed at 140° C. for 15 hours, to thereby fabricate a fixing belt sample 1.

It is to be understood that the present invention is by no section limited to the above-described embodiments and allows any modification and alteration in the design thereof without departing from the spirit of the invention.

For example the image forming method is not limited to those effected in a serial manner as described in the above, but may be based on line system in which a line head is disposed so as to extend along the width-wise direction of the recording medium P (a direction normal to the conveying direction Z of the recording medium) so as to form the image as the recording medium P is conveyed.

While the embodiment described in the above employed only a single fixing member 7, the present invention is not limited thereto, and it is also allowable to dispose a plurality of fixing members and to dispose also a sorting mechanism on the midway of the route of conveyance, so as to raise the fixation speed. Even with a single fixing member 7, the fixing speed can be raised by disposing the sorting mechanism on the upstream side of the fixing member, if the width of the recording medium P is narrower than that of the route of conveyance at the fixing member 7 to a degree enough to allow a plurality of recording media P to be introduced into the fixing member 7.

The entire disclosure of Japanese Patent Application No. Tokugan 2002-359824 filed on Dec. 11, 2002 including specification, claims, drawings and summary are incorporated herein by reference in its entirety.

What is claimed is:

1. An ink jet printer comprising:

an image forming section for forming an image by ejecting a pigment ink toward a recording medium in which a surficial layer includes thermoplastic fine particles, in a case;

a fixing member for fixing the image by heating and pressurizing the recording medium on which the image is formed by the image forming section;

a drying member for drying the ink used to form the image before the image is fixed to the recording medium by the fixing member;

a temperature detecting member for detecting a temperature in the case;

a humidity detecting member for detecting a humidity in the case;

a drying member control section for controlling an operation of the drying member in accordance with the temperature detected by the temperature detecting member and the humidity detected by the humidity detecting member;

a vapor volume calculating section for calculating a vapor volume per unit volume of air in the case in accordance with the temperature detected by the temperature detecting member and the humidity detected by the humidity detecting member; and a vapor volume judging section for judging whether the vapor volume calculated by the vapor volume calculating section is not less than a predetermined value;

wherein the drying member control section operates the drying member when the vapor volume judging section judges that the vapor volume calculated by the vapor volume calculating section is not less than the predetermined value.

2. The ink jet printer of claim 1, wherein the drying member comprises an air blowing member for blowing air to the recording medium, and a heating member for heating the recording medium; and wherein the drying member control section controls at least one of air blowing carried out by the air blowing member and heating carried out by the heating member.

3. An ink jet printer comprising:

an image forming section for forming an image by ejecting a pigment ink toward a recording medium, in a case;

a drying member for drying the ink used to form the image, before the image is fixed to the recording medium;

a temperature detecting member for detecting a temperature in the case;

a humidity detecting member for detecting a humidity in the case;

a drying member control section for controlling an operation of the drying member in accordance with the temperature detected by the temperature detecting member and the humidity detected by the humidity detecting member;

a vapor volume calculating section for calculating a vapor volume per unit volume of air in the case in accordance with the temperature detected by the temperature detecting member and the humidity detected by the humidity detecting member; and a vapor volume judging section for judging whether the vapor volume calculated by the vapor volume calculating section is not less than a predetermined value;

wherein the drying member control section operates the drying member when the vapor volume judging section judges that the vapor volume calculated by the vapor volume calculating section is not less than the predetermined value.

4. The ink jet printer of claim 3, wherein the drying member comprises an air blowing member for blowing air to the recording medium, and a heating member for heating the recording medium; and wherein the drying member control section controls at least one of air blowing carried out by the air blowing member and heating carried out by the heating member.

* * * * *